US012716230B2

(12) United States Patent
Stewart et al.

(10) Patent No.: US 12,716,230 B2
(45) Date of Patent: Aug. 25, 2026

(54) METHODS AND APPARATUSES FOR CONSTRUCTING HIGH-RISE BUILDINGS

(71) Applicant: Urban Redwood, New York, NY (US)

(72) Inventors: Graham S Stewart, New York, NY (US); Sherwood Conde, New York, NY (US)

(73) Assignee: Urban Redwood, New York, NY (US)

( * ) Notice: Subject to any disclaimer, the term of this patent is extended or adjusted under 35 U.S.C. 154(b) by 544 days.

(21) Appl. No.: 18/302,784

(22) Filed: Apr. 18, 2023

(65) Prior Publication Data

US 2023/0374775 A1 Nov. 23, 2023

Related U.S. Application Data

(60) Provisional application No. 63/343,543, filed on May 19, 2022.

(51) Int. Cl.
*E04B 1/35* (2006.01)
*E04B 1/38* (2006.01)
*E04B 1/343* (2006.01)

(52) U.S. Cl.
CPC ..... *E04B 1/3516* (2013.01); *E04B 1/3511* (2013.01); *E04B 1/388* (2023.08); *E04B 1/34347* (2013.01); *E04B 1/34363* (2013.01); *E04B 1/34384* (2013.01); *E04B 2001/3572* (2013.01); *E04B 2001/3588* (2013.01)

(58) Field of Classification Search
None
See application file for complete search history.

(56) References Cited

U.S. PATENT DOCUMENTS 3,579,935 A * 5/1971 Regan ..... E04B 1/3511 254/105
2022/0154449 A1* 5/2022 Ding ..... E04B 1/58
2022/0154450 A1* 5/2022 Ding ..... F16B 7/0453
(Continued)

FOREIGN PATENT DOCUMENTS

CA 3212836 A1 * 3/2024 ..... F16B 5/0088
CN 208734055 U * 4/2019
CN 209653362 U * 11/2019
(Continued)

*Primary Examiner* — Phi D A
(74) *Attorney, Agent, or Firm* — Whitestone Law, PLLC

(57) ABSTRACT

Embodiments are directed to a lock for securing a structural assembly having a primary beam for constructing a core-supported high-rise building, and a building core wall defining an outer face. The lock includes a fixed bracket that couples to the primary beam of the structural assembly, a structural pin, a moveable component connected to the fixed bracket by the structural pin, and a recessed pocket embedded in the building core wall. The moveable component defines a bearing surface that contacts the outer face of the building core wall during the raising of the structural assembly. The recessed pocket receives the moveable component of the locking device when the structural assembly reaches one of the predetermined positions. The moveable component automatically engages with and disengages from the recessed pocket as the structural assembly rises, enabling temporary support and securement of the structural assembly at the predetermined positions during construction.

20 Claims, 33 Drawing Sheets

(56) References Cited

U.S. PATENT DOCUMENTS

2022/0341161 A1* 10/2022 Love ..... E04B 1/388

FOREIGN PATENT DOCUMENTS

| | | | | | |
|---|---|---|---|---|---|
| CN | 111456403 | B | * | 1/2022 | ..... E04G 5/046 |
| CN | 119900399 | A | * | 4/2025 | ..... B66C 17/06 |
| CN | 120006881 | A | * | 5/2025 | ..... F16B 41/002 |
| CN | 120211400 | A | * | 6/2025 | ..... E04G 21/14 |
| FR | 2987856 | A1 | * | 9/2013 | ..... E04G 5/06 |
| FR | 2987856 | B1 | * | 2/2021 | ..... E04G 5/062 |

* cited by examiner

METHODS AND APPARATUSES FOR CONSTRUCTING HIGH-RISE BUILDINGS

BACKGROUND

The present invention includes methods, systems, and apparatuses relating to the field of building construction, more particularly to the construction of tall buildings, such as high-rise buildings. Tall building construction requires a secure and efficient means of assembling and supporting structural components, such as primary beams, during the building process.

SUMMARY

The present disclosure provides various exemplary embodiments for a safe and reliable method of connecting structural assemblies to a building core, supporting the occupied assembly with sufficient load capacity and safety factors. The disclosure also provides exemplary embodiments for a fire protection water supply system, a method of raising structural assemblies, an automated process for installing façade panels, a method for limiting deflection of cantilevered structural assemblies, a strand protection system, a system for placing mechanical and electrical service risers, and a system for placing prefabricated three-dimensional modular units. A preferred embodiment provides an improved locking device apparatus that offers a more efficient and cost-effective means of supporting and securing structural components during the construction of tall buildings.

The methods and techniques are achieved through the use of different techniques, including a locking device, carrier beams, deflection control ties, strand jack hoisting system, and slip form system. These methods and techniques enable the efficient and safe construction of buildings while eliminating the need for large cranes and minimizing the risk of incidental damage to structural components. Some embodiments include a system, method, or apparatus that relates to the field of building construction.

During the construction process, it is necessary to support the structural assembly on the building core at each level until the structural assembly is secured in place. Existing methods of supporting the structural assembly require significant time and resources, resulting in increased construction costs. Moreover, existing support methods may lead to structural damage or safety hazards. Therefore, there is a need for an improved locking device apparatus that can securely support the structural assembly at each level during construction, while reducing construction costs and minimizing the risk of structural damage or safety hazards. The locking device apparatus of the present invention overcomes the limitations of existing methods and provides a simple, efficient, and safe solution for supporting structural assembly during high-rise building construction.

Preferred embodiments are for a locking device/apparatus that locks together parts of a tall building during construction. It consists of a fixed bracket that attaches to a main beam and a movable part that can rotate around a pin attached to the bracket. The movable part has a surface that touches the building's inner core wall, and there are special pockets in the wall at certain levels that the movable part can fit into. As the building is constructed and rises higher, the movable part will automatically move into and out of these pockets to help support and secure the building at different stages of construction.

BRIEF DESCRIPTIONS OF THE DRAWINGS

Various exemplary aspects of the systems and methods will be described in detail, with reference to the following figures, wherein.

DETAILED DESCRIPTION

Figure 1:
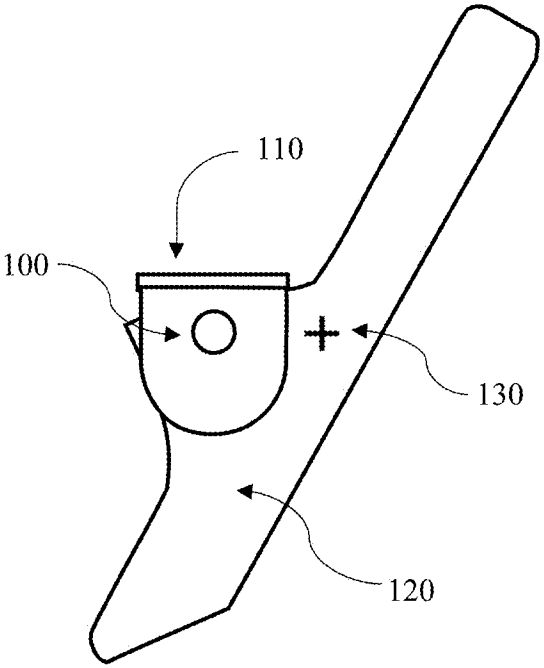
FIG. 1 is a schematic illustrating a locking device, according to various exemplary embodiments.

These and other features and advantages are described in, or are apparent from, the following detailed description of various exemplary embodiments.

It will be understood that when an element is referred to as being "on", "connected", or "coupled" to another element, it can be directly on, connected, or coupled to the other element or intervening elements that may be present. In contrast, when an element is referred to as being "directly on", "directly connected", or "directly coupled" to another element, there are no intervening elements present. As used herein the term "and/or" includes any and all combinations of one or more of the associated listing items. Further, it will be understood that when a layer is referred to as being "under" another layer, it can be directly under or one or more intervening layers may also be present. In addition, it will also be understood that when a layer is referred to as being "between" two layers, it can be the only layer between the two layers, or one or more intervening layers may also be present.

It will be understood that, although the terms "first", "second", etc. may be used herein to describe various elements, components, regions, layers, and/or sections, these elements, components, regions, layers and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of exemplary embodiments.

In the drawing figures, the dimensions of layers and regions may be exaggerated for clarity of illustration. Like reference numerals refer to like elements throughout. The same reference numbers indicate the same components throughout the specification.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For exemplary, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of exemplary embodiments. As used herein, the singular forms "a", "an", and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Exemplary embodiments are described herein with reference to cross-sectional illustrations that are schematic illustrations of idealized embodiments (and intermediate structures) of exemplary embodiments. As such, variations from the shapes of the illustrations as a result, for exemplary, of manufacturing techniques and/or tolerances, are to be expected. Thus, exemplary embodiments should not be construed as limited to the particular shapes of regions illustrated herein but are to include deviations in shapes that result, for exemplary, from manufacturing. For exemplary, an implanted region illustrated as a rectangle will, typically, have rounded or curved features and/or a gradient of implant concentration at its edges rather than a binary change from implanted to non-implanted region. Likewise, a buried region formed by the implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of exemplary embodiments.

Unless otherwise defined, all terms (including technical and scientific terms) used herein have the same meaning as commonly understood by one of ordinary skill in the art to which exemplary embodiments belong. It will be further understood that all terms, such as those defined in commonly-used dictionaries, should be interpreted as having a meaning that is consistent with their meaning in the context of the relevant art and will not be interpreted in an idealized or overly formal sense unless expressly so defined herein. As used herein, expressions such as "at least one of", when preceding a list of elements, modify the entire list of elements and do not modify the individual elements of the list.

When the terms "about" or "substantially" are used in this specification in connection with numerical values, it is intended that the associated numerical value include a tolerance of ±10% around the stated numerical value. Moreover, when reference is made to percentages in this specification, it is intended that those percentages are based on weight, i.e., weight percentages. The expression "up to" includes amounts of zero to the expressed upper limit and all values therebetween. When ranges are specified, the range includes all values therebetween such as increments of 0.1%. Moreover, when the words "generally" and "substantially" are used in connection with geometric shapes, it is intended that the precision of the geometric shape is not required but that latitude for the shape is within the scope of the disclosure. Although the tubular elements of the embodiments may be cylindrical, other tubular cross-sectional forms are contemplated, such as square, rectangular, oval, triangular, and others.

Although corresponding plan views and/or perspective views of some cross-sectional view(s) may not be shown, the cross-sectional view(s) of device structures illustrated herein provide support for a plurality of device structures that extend along two different directions as would be illustrated in a plan view, and/or in three different directions as would be illustrated in a perspective view. The two different directions may or may not be orthogonal to each other. The three different directions may include a third direction that may be orthogonal to the two different directions.

Reference will now be made in detail to embodiments, exemplaries of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain exemplary embodiments of the present description.

FIGS. 1-8 are schematics illustrating exemplary embodiments of the engagement and use of a locking device which serves as an automated, reliable and safe method of connecting structural assemblies to a building core, with sufficient load capacity and safety factor to support the occupied assembly, according to various exemplary embodiments. Reference will be made in detail to each figure further below.

Figure 9:
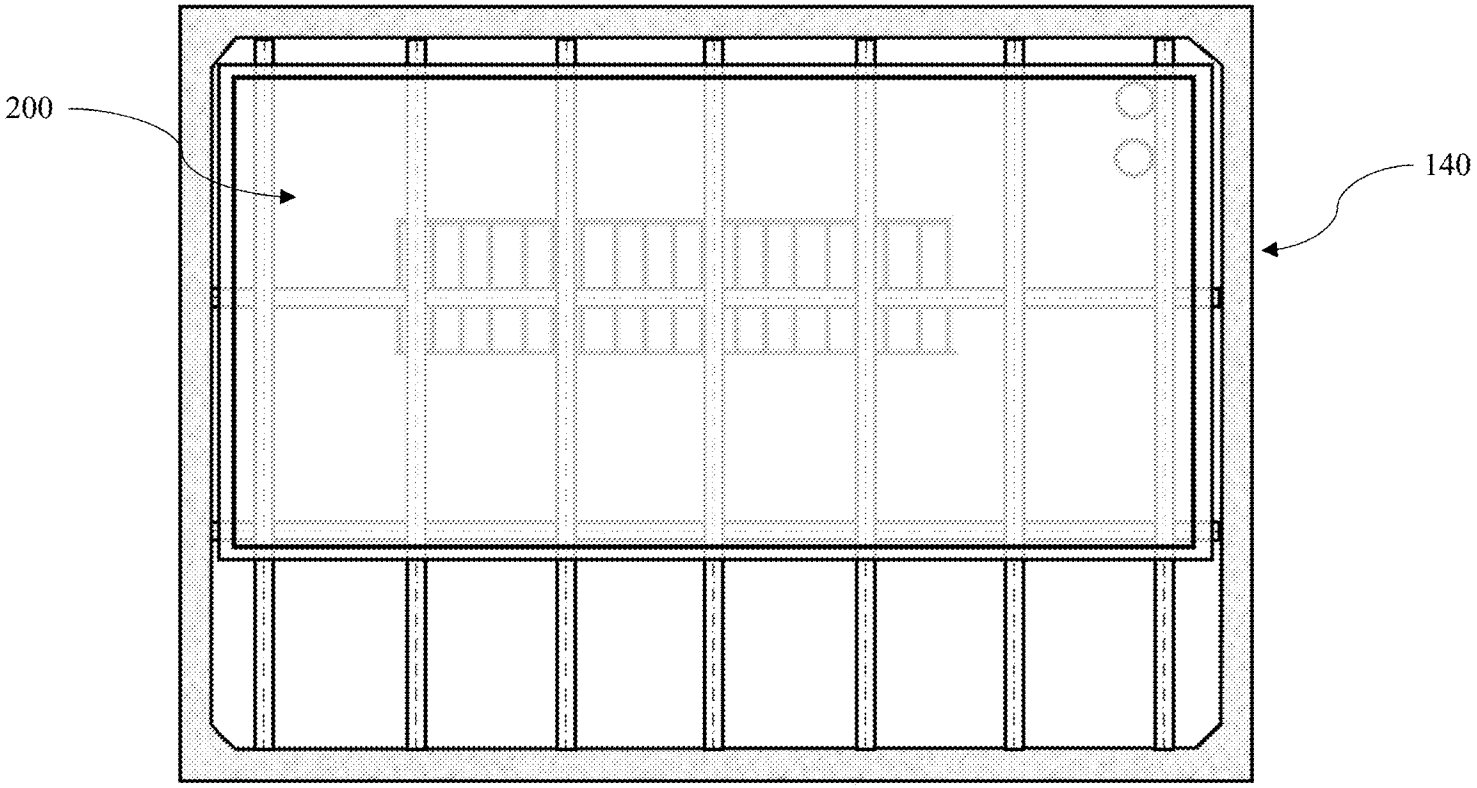
FIG. 9 is a schematic illustrating the plan view of a water tank located above a stairway within a building core, according to various exemplary embodiments.
Figure 10:
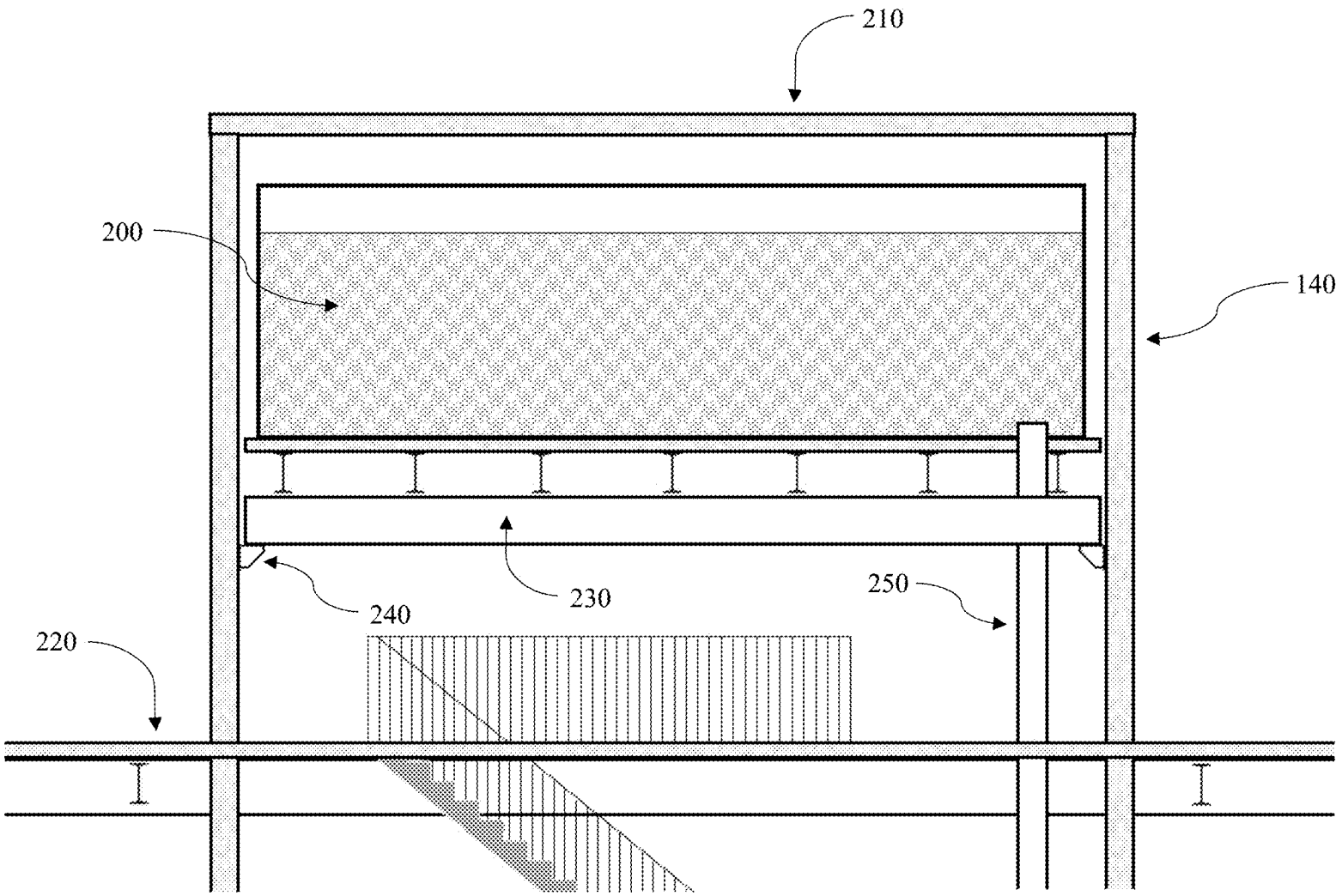
FIG. 10 is a schematic illustrating a section view of a water tank located within the building core below the core cap and above building roof level, according to various exemplary embodiments.

FIGS. 9-10 are schematics illustrating an exemplary embodiment of a fire protection water supply system, in which permanent water storage tanks are installed at, or above, a building's roof level early in the construction process, according to various exemplary embodiments. Reference will be made in detail to each figure further below.

FIGS. 11A-15B are schematics illustrating exemplary embodiments of a method of raising structural assemblies in which raising devices are simple temporary carrier beams. Exemplary embodiments shall exhibit sufficient load capacity and safety factor, allowing assemblies to remain stable, balanced and level as they are raised, according to various exemplary embodiments. Reference will be made in detail to each figure further below.

FIGS. 16-19 are schematics illustrating exemplary embodiments of an automated process for safely installing façade panels that is not dependent on particularly calm weather conditions and does not require manual positioning of individual panels at height. Reference will be made in detail to each figure further below.

FIGS. 20-25 are schematics illustrating exemplary embodiments of a method for limiting deflection of cantilevered structural assemblies in a manner that does not require decreasing member lengths or increasing member section sizes. Exemplary embodiments are achieved through the use of vertical structural members serving as deflection control ties. Reference will be made in detail to each figure further below.

FIGS. 26A-28 are schematics illustrating exemplary embodiments of a strand protection system in which a temporary protection sleeve is installed vertically around a bundle of strand jack cables or hoisting strands, allowing for protection from incidental damage to the strands during construction. Reference will be made in detail to each figure further below.

Figure 29:
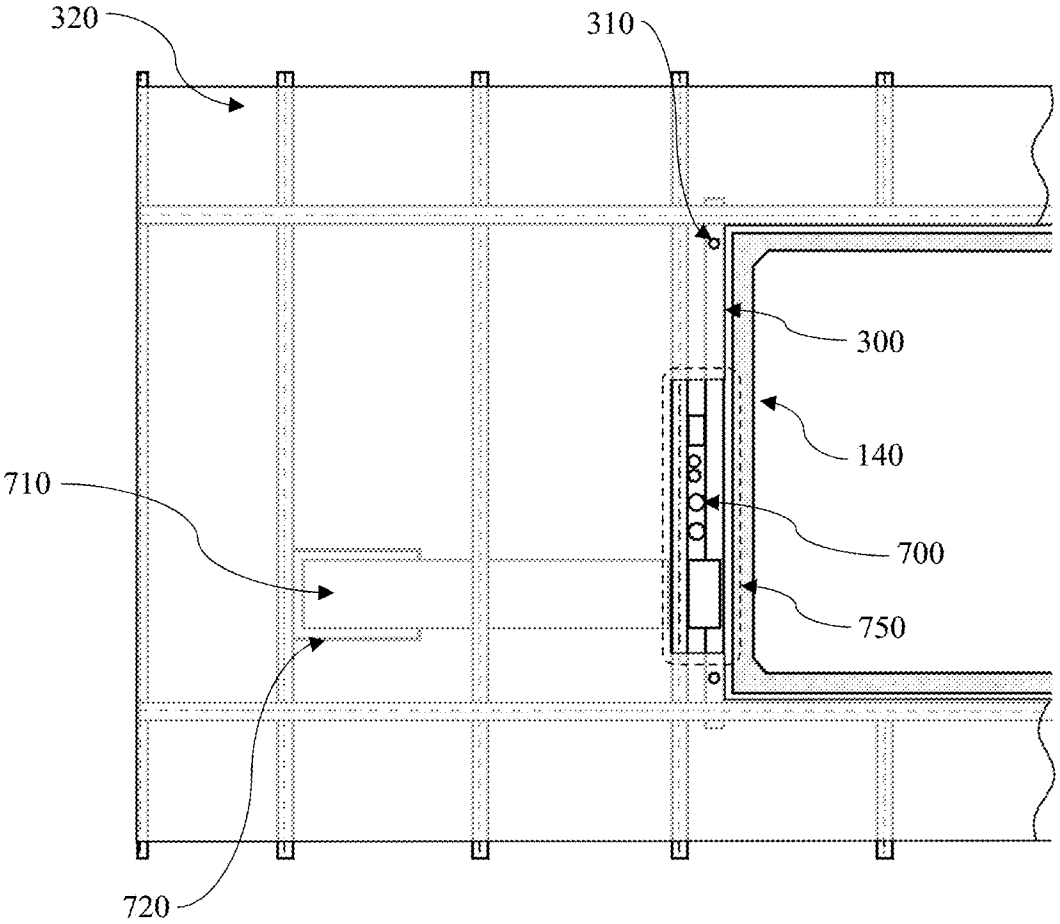
FIG. 29 is a schematic illustrating the plan view of a structural assembly with mechanical, electrical and plumbing service risers being raised alongside the external face of a building core, according to various exemplary embodiments.
Figure 30:
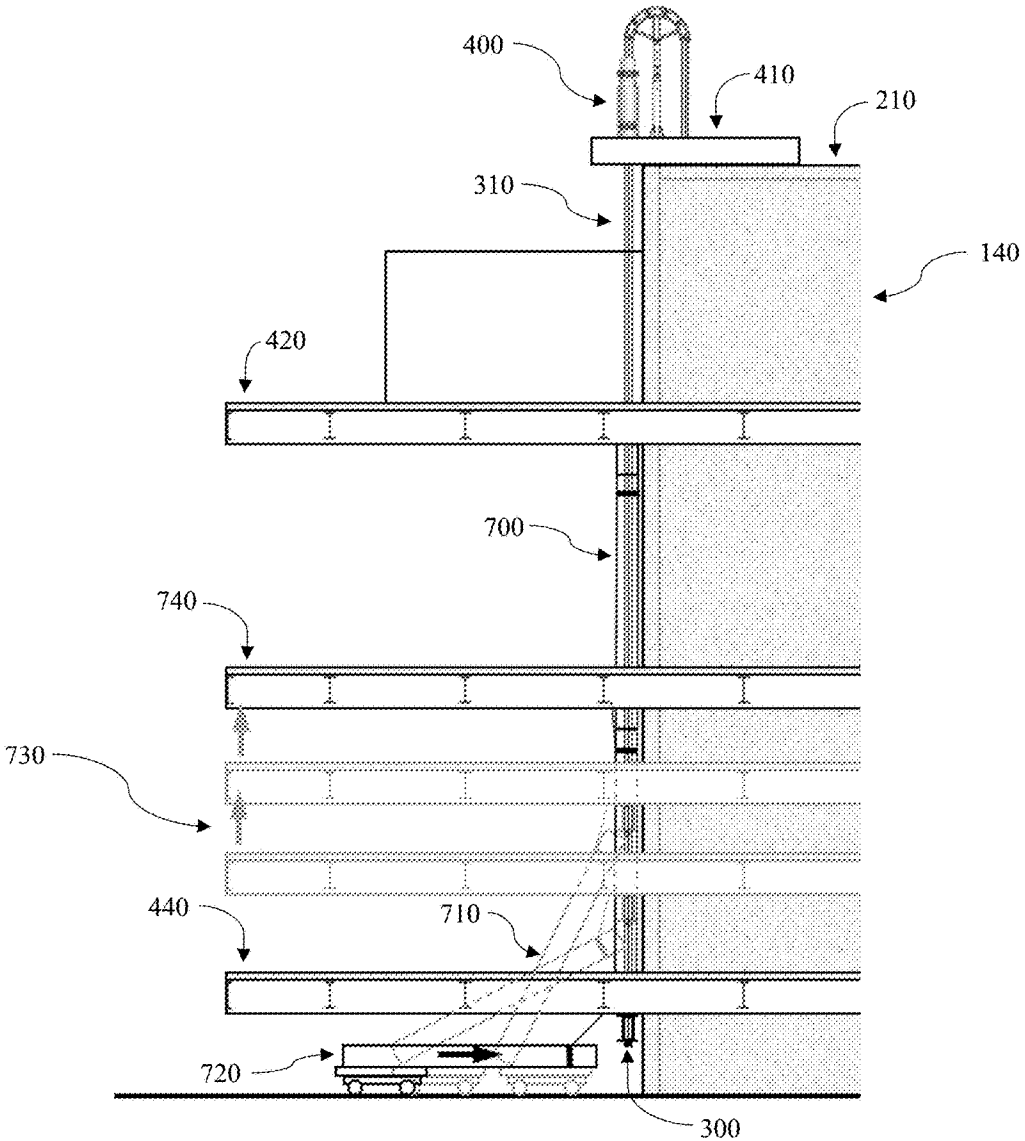
FIG. 30 is a schematic illustrating a section view through a building with structural floor assemblies and utility service risers, such as mechanical ductwork, piping and electrical busways, being raised, according to various exemplary embodiments.

FIGS. 29-30 are schematics illustrating exemplary embodiments of a system for placing mechanical and electrical service risers in which the need to individually raise each riser section using construction hoists or cranes is eliminated. Exemplary embodiments are achieved through the use of the strand jack hoisting system to allow risers to be attached to structural assemblies at ground level. Reference will be made in detail to each figure further below.

Figure 31:
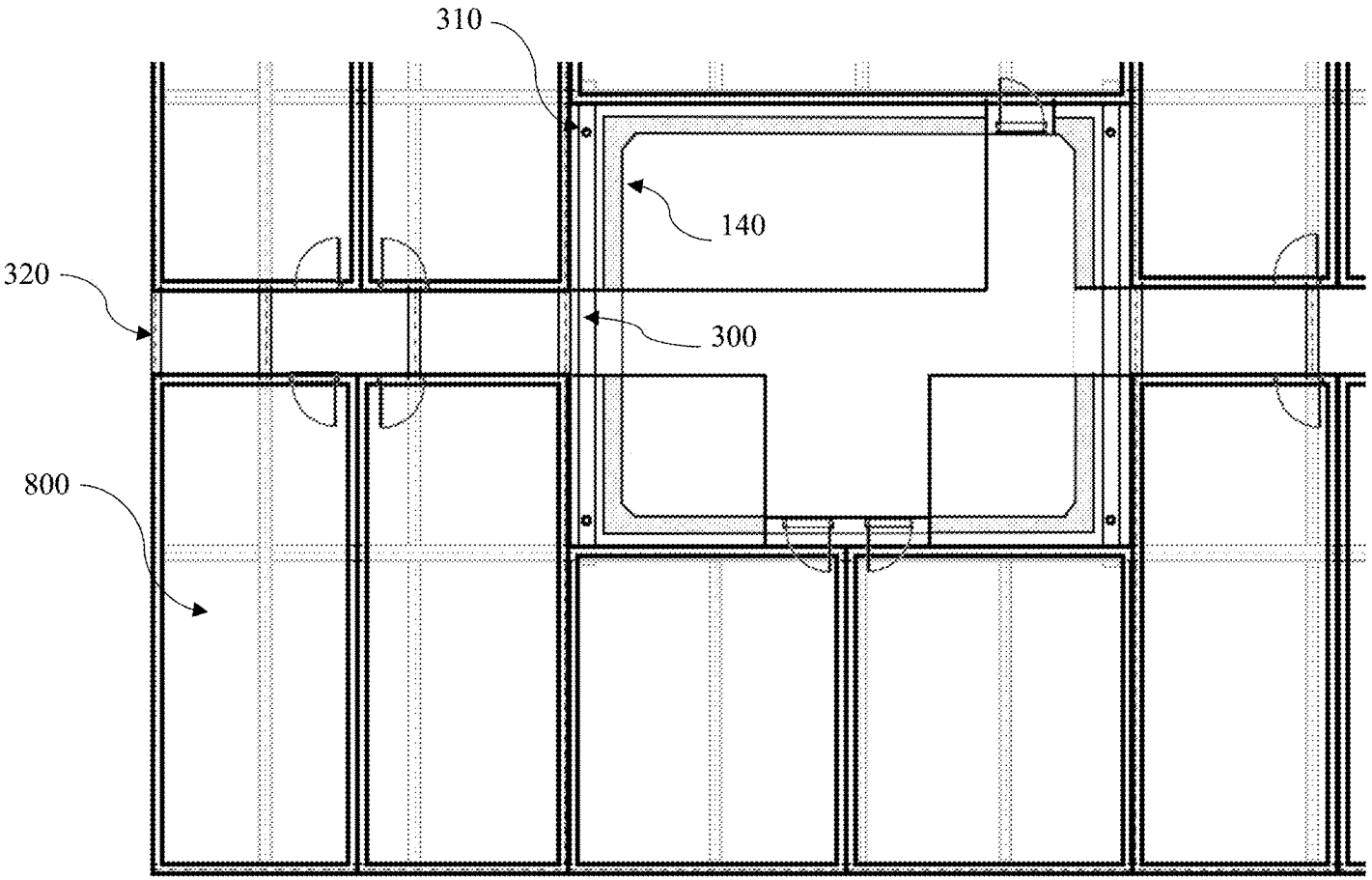
FIG. 31 is a schematic illustrating the plan view of a structural assembly carrying prefabricated three-dimensional modular units being raised alongside the external face of a building core, according to various exemplary embodiments.
Figure 32:
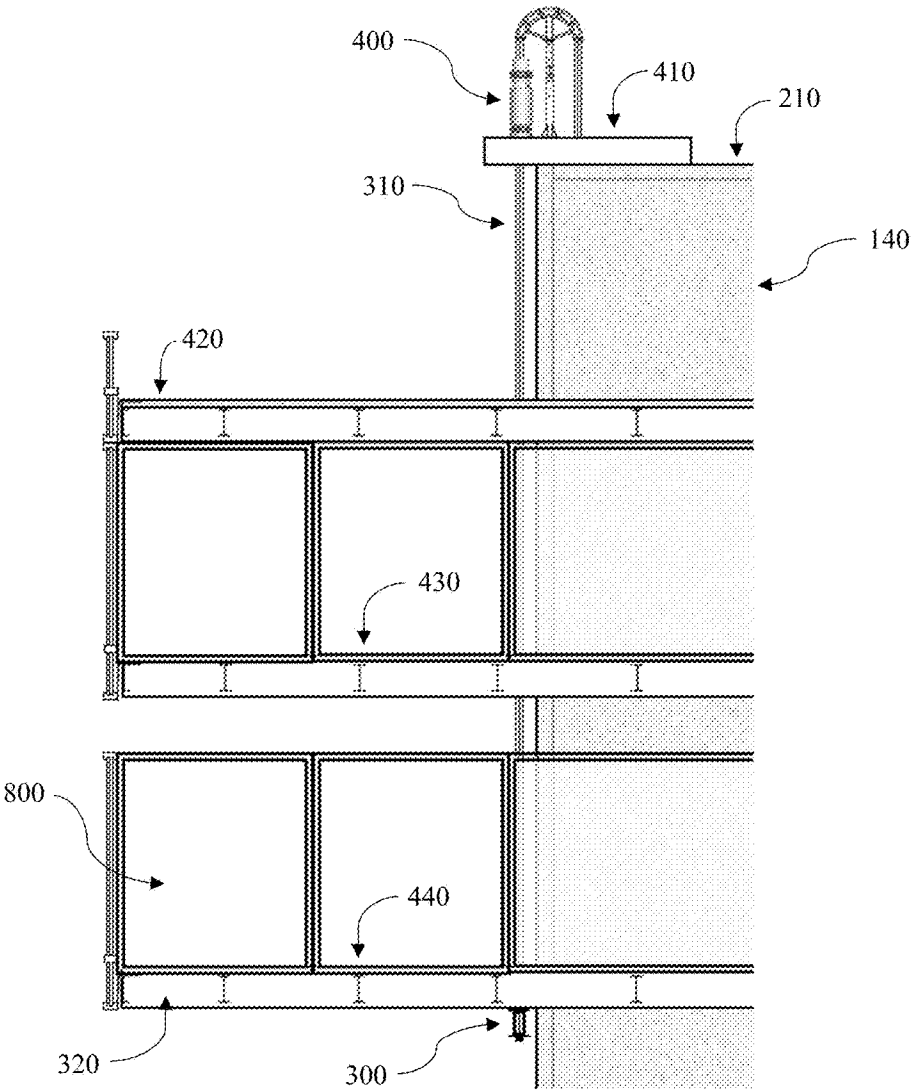
FIG. 32 is a schematic illustrating a section view through a building with structural floor assemblies and prefabricated modular units being raised, according to various exemplary embodiments.

FIGS. 31-32 are schematics illustrating exemplary embodiments of a system for placing prefabricated three-dimensional modular units in which the need to individually raise each modular unit using large cranes is eliminated. Exemplary embodiments are achieved through the use of the strand jack hoisting system to allow modular units to be attached to structural assemblies at ground level. Reference will be made in detail to each figure further below.

Figure 33:
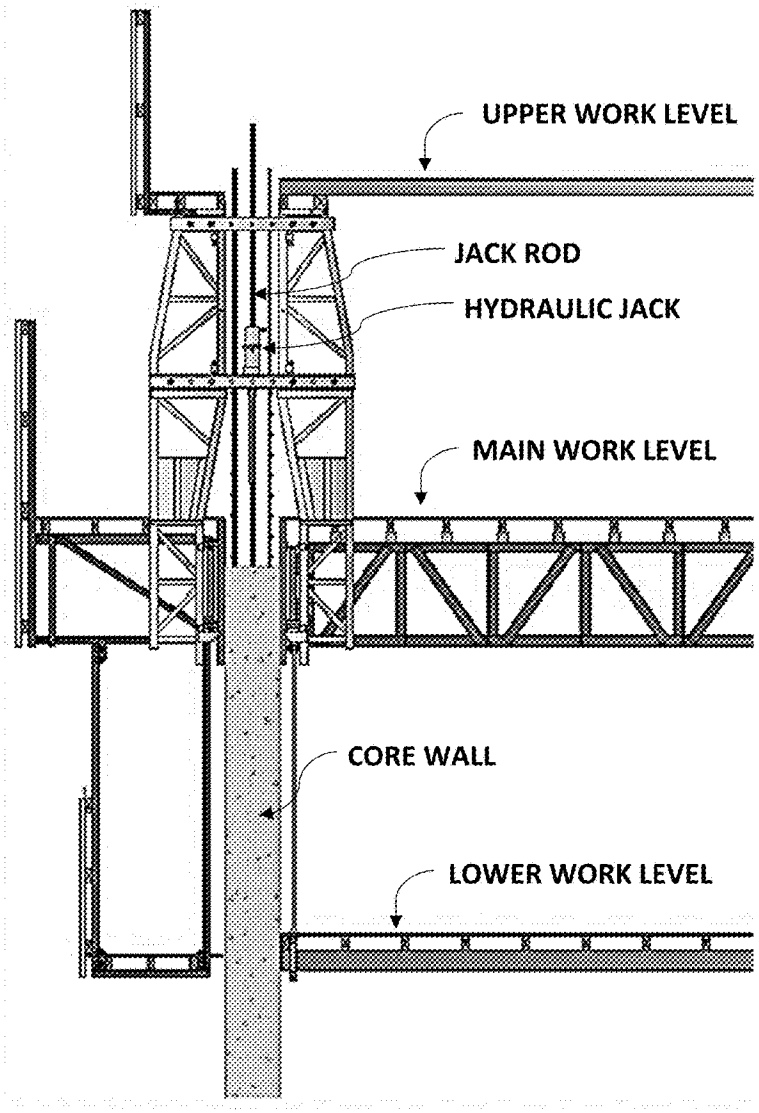
FIG. 33 is a schematic illustrating a section view through a slip form with three work levels, according to various exemplary embodiments.

FIG. 33 is a schematic illustrating exemplary embodiments of a slip form system for construction of a building core. Exemplary embodiments are achieved through the use of telescoping hydraulic jacks, moveable forms that extrude a hardenable substance such as concrete, and multiple work platforms. Reference will be made in detail to the figure further below.

Certain terms used in this application are defined below.

Current Conventional Construction Method for High-Rise Buildings means the construction approach whereby cranes and hoists are used to install individual structural components, and building equipment and systems at their final installed locations. Typically, this results in successive floors being constructed above those that have been previously completed with most work being performed at height.

Current Construction Method for Modular High-Rise Buildings means the construction approach whereby cranes are used to install individual prefabricated three-dimensional modular units. Typically, modular units are stacked directly above previously installed units such that installation involves hoisting each unit from street level to the uppermost level being constructed. This requires that lower modular units must be capable of supporting the cumulative loads from all units above.

Core-Supported High-Rise Building means a high-rise building structure that derives all support for horizontal load-bearing assemblies from vertical building cores, eliminating the need for supplementary support columns, posts or walls.

Current Construction Method for Core-Supported High-Rise Buildings means the construction approach whereby horizontal structural assemblies are secured to the building cores using manual methods requiring construction personnel to be physically located at these connection points in order to install support members. The current method does not provide; early fire protection water supply, temporary carrier beams that are balanced, automated façade engagement, deflection control for cantilevered assemblies, strand protection, utility service riser solutions, and modular building solutions.

Proposed Construction Method for Core-Supported High-Rise Buildings means the construction approach whereby horizontal structural assemblies are secured to the cores using automated methods to install support members. The proposed method provides; early fire protection water supply, temporary carrier beams that are balanced, automated façade engagement, deflection control for cantilevered assemblies, strand protection, utility service riser solutions, and modular building solutions.

Proposed Construction Method for Core-Supported Modular High-Rise Buildings means the construction approach whereby a core-supported high-rise building incorporates prefabricated three-dimensional modular units into structural assemblies prior to the assemblies being raised to their permanent positions. A core-supported modular high-rise building has the modular units installed on a structural framework such that they are securely and permanently attached to the framework, prior to the resulting structural assembly being raised and subsequently connected to the vertical building cores. The proposed method also provides; early fire protection water supply, temporary carrier beams that are balanced, automated façade engagement, strand protection, and utility service riser solutions.

Prefabricated Component means a factory assembled item that can be in the form of a specialty pod (such as bathroom or kitchen module), a wall assembly, a utility rack, or other prefabricated sub-assembly that is incorporated into a structural assembly.

Three-Dimensional Modular Unit means a prefabricated six-sided volumetric module that has been manufactured off-site and can include within its enclosed space all necessary plumbing, electrical and mechanical systems, as well as furniture, fixtures and finishes.

Primary Beam means a primary horizontal structural member that supports secondary beams and transfers loads to the building cores. Primary beams resist vertical forces by bending and shear and span between, or cantilever from, building cores.

Secondary Beam means a secondary horizontal structural member that supports a decking or slab system and transfers loads to the primary beams. Secondary beams resist vertical forces by bending and shear and span between, or cantilever from, primary beams.

Spandrel Beam means a horizontal structural member that connects the free ends of primary and secondary beams to each other, forming a perimeter boundary around the structural framework.

Structural Assembly means a structural framing system designed to carry distributed loads. A structural assembly is comprised of primary beams, secondary beams, spandrel beams and a decking or slab system.

Temporary Support Pedestals means an adjustable structural support on which a structural framework is assembled until such time that the framework can be raised by the strand jacks for completion of the structural assembly. A temporary support pedestal supports the primary beams, secondary beams, and spandrel beams, and is adjusted to allow assembly of all structural components to be completed, such that all members are accurately positioned both horizontally and vertically.

Core Cap means the permanent structural and weathertight enclosure that is installed at the top of a completed building core.

Locking Device means an assembly of structural components that provides an automated and reliable method of connecting a structural assembly to a building core, for core-supported high-rise structures.

Recessed Pocket means a confined opening in the steel component in the exterior face of a building core that is designed and reinforced to accept a locking device, and which allows safe and efficient transfer of loads from a structural assembly to a building core.

Overjack means a minimum vertical distance that a structural assembly must be raised above its final locked position in order to allow engagement of the locking device.

Water Storage Tank means an elevated water tank that is provided to support a gravity-fed fire suppression capability both during building construction, and once the completed building is occupied. A water storage tank contains enough available water to satisfy fire suppression requirements, as stipulated by local fire codes.

Tank Support Framework means a structural framing system designed to carry a water tank. A tank support framework transfers the tank loads to a building core.

Temporary Carrier Beam means a hoisting device that is used as a temporary support for a structural assembly during strand jacking operations. A temporary carrier beam is securely attached to the strand jack cables or hoisting strands and provides the means by which a structural assembly is raised up a building core. A temporary carrier beam is attached to sets of hoisting strands of at least two strand jacks such that the temporary carrier beam is always level and balanced during both raising and lowering operations.

Façade Panel means a prefabricated unitized façade panel that can be readily transported to the project site for installation on a structural assembly. A façade panel includes all framing, glazing, opaque materials, weatherproofing seals and gaskets, and insulation necessary for assembly of a complete exterior building envelope.

Façade Stack Joint means the horizontal interface between two adjacent façade panels and includes all seals and gaskets necessary to achieve a weathertight joint with appropriate tolerances for movement of the supporting structural assemblies under varying load conditions.

Façade Support Bracket means a structural bracket used to connect a façade panel to a spandrel beam or edge of a structural assembly slab, allowing three-dimensional adjustment.

Deflection Control Tie means a structural member that links together two adjacent cantilevered horizontal assemblies such that vertical loads are shared between the linked cantilevered assemblies resulting in limited and consistent vertical deflections.

Permanent Strand Sleeve means a circular embedded pipe that creates an opening in the structural assembly slab such that the strands can pass through the assembly without impinging on any portion of the structure in a manner that may damage the hoisting strands. Upon completion of all hoisting operations, and once hoisting strands have been removed, the permanent strand sleeves are fully closed using fire-resistant materials.

Strand Protection Sleeve means a temporary enclosure that is installed around strand jack cables or hoisting strands to protect them from potential damage during construction.

Utility Service Riser means a vertical component of a utility distribution system that connects all floors to a building's utility service entry point which is generally located at or below street level. A utility service riser can convey a mechanical, electrical plumbing or fire protection utility service, and can take the form of ductwork, piping, conduit, wireway or electrical busway.

A greater description and discussion of core-supported high-rise building construction is provided below.

In some embodiments of methods for constructing core-supported high-rise buildings, roof and floor assemblies are constructed at ground level and raised to their final positions using strand jacks or other hoisting equipment. Exemplary embodiments are revolutionary processes that allow for decreased construction time, costs, and safety concerns, as well as increased useable floor space when compared with conventional methods for construction of high-rise buildings.

Many embodiments of such core-supported high-rise building construction may allow for many construction steps to be completed simultaneously, which may save overall time for construction. For exemplary, in some embodiments, curtain walls or other exterior facade systems may be installed while roof and floor assemblies are constructed at ground level. Installation of such facade systems may eliminate the additional time that may be required in embodiments of conventional high-rise construction, wherein façade installation requires hoisting of each component such that it may be individually positioned at its final elevation. Additionally, in other embodiments of core-supported high-rise building construction, fire proofing, service equipment and horizontal distribution systems such as those for heating, ventilation, and air conditioning (HVAC), fire suppression, and electrical power may be installed while roof and floor assemblies are being constructed at ground level, which may allow for further reduction in time associated with performing these installations for conventional high-rise construction, whereby installation of the above-mentioned components and systems occurs following completion of roof and floor levels at their final elevations. Lastly, in some embodiments of core-supported high-rise building construction, floors may be completely finished, and material supplies and equipment loaded onto structural assemblies during their construction at ground level, which may eliminate the need for time spent hoisting or otherwise carrying such supplies and equipment to their corresponding floors.

Such methods of constructing core-supported high-rise buildings may, in many embodiments, allow for decreased costs of construction. For exemplary, the construction of the entirety of the structural assemblies at ground level may minimize work at height and may minimize any costs associated with hoisting construction personnel, material or other equipment to elevated floors during assembly of the structure. Also, because of the time saved using this more efficient method of construction, labor costs associated with construction personnel may be minimized, as they may be working fewer hours. Examples of such time-saving benefits of this method are provided above.

Additionally, many embodiments of this method of constructing core-supported high-rise buildings may allow for increased safety measures. For exemplary, the construction of the entirety of all structural assemblies at ground level may allow for the prevention of work at height in many instances. Such work at height may typically subject construction personnel to hazardous work conditions, possibly without proper structural support or safety conditions, that may lead to falls resulting in injuries or fatalities. Despite ongoing efforts by employers and safety professionals to prevent falls, provide fall protection systems, and train construction personnel, falls continue to be the leading cause of death in the construction industry in the USA (according to the Occupational Safety and Health Administration). By constructing assemblies at ground level, the need for work at height is largely eliminated, along with these safety concerns. Additionally, the possibility for installing curtain walls or other exterior façade systems at ground level may eliminate the need for construction personnel to work on exterior elements at height. Working with exterior elements at height may subject construction personnel to extreme ambient temperatures and possibly inclement weather conditions which may impose additional safety hazards. Additionally, assembly work conducted at ground level may eliminate risks associated with objects, such as materials and small hand tools, that may be at risk of falling from a work area. The second most common source of construction fatalities and injuries in the USA (according to the Occupational Safety and Health Administration) results from personnel being struck by an object. This category of accident may be defined as an impact between a person and an object or piece of equipment, including being hit by falling materials or tools.

Additionally, many embodiments of this method of constructing core-supported high-rise buildings may allow for increased levels of quality assurance. For exemplary, quality assurance inspections may be carried out more readily and may be conducted more thoroughly as many of these inspections are performed at ground level and are not required to be performed at height.

Finally, such methods of core-supported high-rise building construction may, in many embodiments, allow for increased useable floor space. The entirety of the building's structural support is provided by one or more building cores, which eliminates the need for any additional vertical structural support elements located throughout the building. Therefore, elimination of such structural support elements allows for additional space within the footprint of each assembly. Since each structural assembly is a floor or roof assembly, there may be additional floor space available for use in the final, finished building.

In some embodiments of such a method of core-supported high-rise building construction, one or more foundations may first be provided to transfer building loads, both static and dynamic, to underlying soils or rock. The foundation may be shallow or deep. Merely by way of example, shallow foundations may include spread footings or mat/raft foundations. Also by way of example, deep foundations may include pre-fabricated driven pile foundation systems, caissons, drilled piers, cast-in-drilled-hole piles, underreamed piles, or auger cast piles.

The method of core-supported high-rise building construction may then include slip forming, vertically, at least one building core with a moldable and hardenable substance. In some embodiments, the moldable and hardenable substance may be concrete. Merely by way of example, this concrete material may be regular concrete, high-strength concrete, or high-performance concrete. In some embodiments, slip forms may be provided which slip vertically by continuously rising up the building core which they are forming by extrusion. In some embodiments, extendable elements, for example, telescoping hydraulic jacks, may be used to raise the slip form up off the foundation at ground level. The extrusion rate at which the slip form moves upward may be dependent on a number of factors including the curing time of the hardenable substance. In some embodiments, the slip form may move upward at a rate of up to 16 inches per hour (400 mm per hour) until the final height of the building core is reached.

In some embodiments where there will be a plurality of building cores formed, each slip form may be coupled with one or more other slip forms. In embodiments where a large number of stories are to be provided (or even in embodiments with fewer stories), coupling the slip forms with each other may at least assist in ensuring that the formed building cores are parallel to each other. In some embodiments, lightweight trusses may be used to couple any one slip form to another. Additionally, in some embodiments, one or more walkways may be coupled with the coupling component(s) to allow construction personnel to move between coupled slip forms.

In some embodiments then, extending elements will raise the slip form upwards away from fixed points on the wall of the formed building core. Fixed points may be provided by inserting a plurality of vertical hollow sleeves into the top of the slip form. The hollow sleeves are temporarily filled with vertical, extendable jack rods which will protrude above the sleeves. The extending elements may then raise the slip form upwards off the jack rods, thereby using the jack rods and the wall of the recently formed building core to support the movement of the slip form. Once the slip form has risen to near the top of the hollow sleeve sections and their associated jack rods, both the sleeves and rods may be extended to allow the slip form to continue upward. Once the building core has reached full height and the slip form operation has been concluded, the jack rods can be removed for reuse on another core. The sleeves remain embedded in the core wall.

A sensing and control mechanism may be used to ensure each extending element moves upward at the proper rate. In some embodiments, multiple lasers may be coupled with the slip form at various locations and utilized to measure the distance of the slip form from the ground. Individual extending elements may then be controlled, possibly by an automated system, to ensure that each extending element works with all other extending elements to ensure the slip form stays level and the building core is formed at least substantially vertically. In other embodiments, one or more lasers, possibly located in the interior or on the exterior of the slip form may inform an automated system of the orientation of the slip form and thereby control the extending elements.

Any slip form used in core-supported high-rise building construction may have two or three work levels. Merely by way of example, a main work level may be provided on the slip form to allow construction personnel to adjust and maintain the extendable elements. The main work level may support the power system for the extendable elements and provide an area where reinforcing steel is staged and prepared for use in the slip form process. The main work level may also allow construction personnel to insert horizontal reinforcing members and a variety of prefabricated elements or temporary inserts per architectural and engineering plans provided beforehand. Merely by way of example, prefabricated structural support elements (for example, plates on the interior walls by which structural beams may be coupled at various levels), temporary blockouts or collapsible and re-usable frames (to define where doors will later be installed within the building core wall), and other inserts which will allow future installed mechanical, plumbing, and electrical equipment to penetrate the building core walls. The main work level may allow the hardenable substance to be deposited and vibrated.

An upper work level may also be provided on the slip form in some embodiments. The upper work level may allow construction personnel to insert vertical reinforcing members and/or reinforcement assemblies, and the hollow sleeves and associated jack rods into the hardenable substance as it is deposited into the slip form. Reinforcing members inserted into the slip forms may initially be coupled with reinforcing members protruding from the foundation.

The upper and/or main work level may include a number of devices to facilitate the operations of the slip form. Merely by way of example, the work levels may include hoisting jibs or gantry hoists to lift work materials and supplies (for example, those described above) to the work levels of the slip form from the ground below.

A lower work level may also be provided on the slip form in some embodiments. The lower work level may allow construction personnel to inspect the building core, remove excess hardenable substance material and perform finishing activities as needed.

During slip forming, a plurality of support member receptacles may also be deposited within the hardenable substance, possibly at a perimeter of the slip form (i.e. the perimeter of the building core). These support member receptacles may be inserted into the hardenable substance from the main work level of the slip form. The support member receptacles may have a temporarily filled void. In some embodiments, the support member receptacle may have a vertical element coupled to, or couplable with it such that the vertical member assists in determining the distance between adjacent floors and/or between the uppermost floor and the roof.

In some embodiments then, a vertical member may be inserted into the slip form to identify a vertical distance to the first set of support member receptacles at a first elevation, which will be used to assist in supporting the second floor of the building (with the first floor being at ground level). Additional vertical members may then be coupled with the top of the support member receptacles to identify the vertical height to the next set (which will be used to assist in supporting the third floor and upward of the building). Any coupling of vertical members and support member receptacles may be done prior to encasement of the immediate coupling surfaces in the hardenable substance within the slip form.

The method may include supporting a plurality of structural roof members on temporary support pedestals. Such temporary support pedestals may be located around the base of each building core so that a plurality of structural members may be supported. Temporary support pedestals may vary in shape and size to support different sizes of structural members. The method may further include coupling the plurality of structural roof members with the plurality of temporary support pedestals to create a stable and safe structural roof assembly.

The method may further include coupling at least one of the plurality of structural roof members with at least one other of the plurality of structural roof members to create a structural roof assembly. In some embodiments, one or more of the plurality of structural roof members may include vertical openings through themselves. Another structural roof member or members may then be passed through these vertical openings and coupled together by a variety of methods such as welding or mechanical fastening. In these or other embodiments, some shorter structural roof members may be employed and coupled without vertical openings and pass-through type couplings.

Any number of different types and sizes of structural members may be used for the roof members dependent on many factors. While in some embodiments, I-beams may be employed, in other embodiments, hollow structural section beams, castellated beams, channels, etc. may also be used. Some of the factors affecting which type of structural members are used may include different static and dynamic structural loads, as well as different building use requirements.

Decking, such as corrugated metal sheeting, may then be coupled with the top surface of at least some of the structural roof members. A hardenable substance, for example concrete, may then be poured on top of the decking to complete the structural roof assembly. In some embodiments, other materials may be used to finish the structural roof assembly. Merely by way of example, composite materials may be coupled with the roof members to complete the structural roof assembly for lightweight roof constructions.

The method may further include raising the structural roof assembly to a first elevation from the top of at least one building core. The first elevation may be in proximity to the top of this building core or building cores. In some embodiments this may be accomplished by coupling one or more strand jacks with the top of the building core or cores. The strands from the strand jacks may then be coupled with the structural roof assembly, and the strand jacks activated to raise the roof assembly. When more than one strand jack is employed, automatic or manual systems may assist in ensuring that the structural roof assembly is raised in a level and stable manner.

In some embodiments, assembly and installation of any rooftop components such as a roof parapet, and mechanical and electrical equipment may begin before the structural roof assembly is raised to its final position. By loading any rooftop components, construction materials, supplies and equipment onto the roof assembly before raising, the need for a crane or hoist to lift such components, materials, supplies and equipment to the roof, after it is in its elevated position, is obviated.

In some embodiments, materials and/or other components with significant weight are coupled with the structural roof assembly before the roof assembly is raised.

As the structural roof assembly is raised, construction personnel may remove the temporary filling from the support member receptacles. Furthermore, any other temporary block-outs, collapsible and re-usable frames or inserts within proposed openings in the building core may also be removed as the structural roof assembly is raised. Any other finishing of the building core(s) may also be performed as the roof assembly is raised.

The method may further include raising the structural roof assembly to a first elevation from the top of at least one building core and supporting the roof assembly at the first elevation with the first plurality of support members. Once the roof assembly has reached the first elevation, support members may be engaged with the support member receptacles. Therefore, in some embodiments, the support member receptacles may allow a support member to be inserted and supported by the support member receptacle, and consequently the building core structure.

The method may further include performing the same or similar steps to those described above to construct a structural floor assembly.

The method may include supporting a plurality of structural floor members on temporary support pedestals. The method may further include coupling the plurality of structural floor members with the plurality of temporary support pedestals to create a stable and safe structural floor assembly.

The method may further include coupling at least one of the plurality of structural floor members with at least one other of the plurality of floor members to create a structural floor assembly. In some embodiments, one or more of the plurality of structural floor members may include vertical openings through themselves. Another floor member or members may then be passed through these vertical openings and coupled together by a variety of methods such as welding or mechanical fastening. In these or other embodiments, some shorter floor members may be employed and coupled without vertical openings and pass-through type couplings.

Any number of different types and sizes of structural members may be used for the floor members dependent on many factors. While in some embodiments, I-beams may be employed, in other embodiments, hollow structural section beams, castellated beams, channels, etc. may also be used. Some of the factors affecting which type of structural members are used may include different static and dynamic structural loads, as well as different building use requirements.

Decking, such as corrugated metal sheeting, may then be coupled with at least some portion of the structural floor members. A hardenable substance, for example concrete, may then be poured on top of the decking to complete the structural floor assembly. In some embodiments, other materials may be used to finish the floor assembly. Merely by way of example, composite materials may be coupled with the floor members to complete the structural floor assembly for lightweight floor constructions.

The method may further include raising the structural floor assembly to a second elevation from the top of at least one building core, where the second elevation may be lower than the first elevation. In some embodiments this may be accomplished by coupling one or more strand jacks with the top of the building core or cores. The strands from the strand jacks may then be coupled with the structural floor assembly, and the strand jacks activated to raise the floor assembly. When more than one strand jack is employed, automatic or manual systems may assist in ensuring the structural floor assembly is raised in a level manner.

In some embodiments, assembly and installation of any floor-mounted components, such as mechanical and electrical equipment, and prefabricated components may begin before the structural floor assembly is raised to its final position. By loading any floor-mounted components, construction materials, supplies and equipment onto the floor assembly before raising, the need for a crane or hoist to lift such components, materials, supplies and equipment to the floor, after it is in its elevated position, is obviated.

In some embodiments, materials and/or other components with significant weight are coupled with the structural floor assembly before the floor assembly is raised.

Additionally, after a structural floor assembly has been constructed on the temporary support pedestals, a curtain wall or other exterior façade may also be constructed around the perimeter of the floor. Such facades may be constructed while the floor assembly is still being supported by the temporary pedestals, or while the floor assembly is suspended by the strand jack cables or hoisting strands and the temporary carrier beams. The facade panels installed on the completed floor assembly will provide the exterior wall between the roof and this first floor assembly (the top floor of the building).

The method may further include raising the structural floor assembly to a second elevation from the top of at least one building core and supporting the floor assembly at the second elevation with the second plurality of support members. Once the floor assembly has reached the second elevation, support members may be engaged with the support member receptacles. Therefore, in some embodiments, the support member receptacles may have openings to allow a support member to be inserted and supported by the support member receptacle, and consequently the building core.

Embodiments of this method greatly decrease the amount of manual work to be done in constructing core-supported high-rise buildings, thus saving a substantial amount of time in construction. Embodiments further decrease safety risks posed to construction personnel, as a majority of construction is completed on temporary support pedestals located at ground level. However, in the current method for core-supported high-rise building construction, manual work at-height is still required in a number of areas, creating potentially unsafe conditions for construction personnel.

For exemplary, in many embodiments of the aforementioned current method, support members used to connect structural roof and floor assemblies to a building's core, must be physically moved to allow for engagement with support member receptacles in the core. Such movement requires construction personnel to work at-height when securing structural assemblies to the building core(s).

Additionally, some processes in embodiments of the current method may procure additional costs, preventing minimum construction costs. For exemplary, the possibility of fire events during building construction may result in increased risks of structure and material loss, construction personnel injuries and/or fatalities, and increased construction time and costs. In many embodiments of current conventional high-rise building construction, the roof is the final portion of the assembly to be built. In some embodiments where a water storage tank is to be placed on the roof, it is the last component to be installed. Thus, there is no significant water source to rely on in cases of fire emergencies, and fire protection must rely on pumps located at ground level. This can result in delays in extinguishing fires and procure additional costs.

Additionally, in many embodiments of the current method, temporary hoisting devices used to carry structural assemblies during raising operations are customized to accommodate a specific structural framing configuration, which procures additional costs. Also, when structural assembly loads are transferred from the temporary hoisting devices to permanent support members the hoisting devices must be physically disengaged from the structural assembly once it is in place. Such a process requires construction personnel to be located at the hoisting device which involves safety risks, prolongs construction time and, in turn, increases costs of construction.

Additionally, embodiments of the current method in which exterior façade panels are to be installed, require construction personnel to manually position and couple the panels with structural roof or floor assemblies which are already positioned at their final height. In such embodiments, construction personnel must manually adjust each panel prior to the positioning and securing of the assembly, which is a labor-intensive process.

In some embodiments of the current method, deflection of cantilevered structural members is controlled by decreasing member lengths or increasing member stiffness. However, decreasing member lengths decreases overall area of the structural framework and therefore available floor space. Increasing member stiffness is typically achieved by increasing member section sizes and results in heavier and more costly members. Larger section sizes may have greater vertical dimensions resulting in increased floor-to-floor height, which in turn procures additional construction costs.

Additionally, many embodiments of the current method rely on the use of strand jacks to lift structural assemblies. In such embodiments, strands must pass through openings in previously raised structural assemblies. Lateral movement of these strands may result in contact with structural assemblies or other objects. Such contact may damage strands, forcing them to be replaced prematurely, and procuring unnecessary costs and delays to construction.

Also, exemplary embodiments of current methods typically include the installation of utility and service risers after all structural framing has been constructed and enclosed by the facade. In some embodiments, risers may require final manual positioning of each element within enclosed shafts where work is performed in severely confined spaces under poorly illuminated conditions and at height, posing considerable safety concerns for construction personnel.

Embodiments of current conventional high-rise construction in which modular buildings are to be constructed, require prefabricated six-sided volumetric modular units to be hoisted into position individually by crane. Modular units can be large, heavy and unwieldy components that are lifted to their permanent positions, where they are manually positioned and secured by construction personnel working at height. Such a process, involving large loads being lifted by cranes, that is subject to conditions of excessive wind and other inclement weather conditions, and requires construction personnel to be located at the highest, exposed level of the structure, can result in significant safety risks.

Finally, embodiments of current conventional modular high-rise construction, require prefabricated modular units to be engineered and fabricated to support the full weight of any modular units that may ultimately be stacked above it. This results in modular units from different levels being engineered and fabricated to be capable of supporting different loads, which may require variation in the materials and structural members used for fabrication of each unit. Such a requirement may reduce the repetition that is desired in modular construction, and in turn, may prolong fabrication duration and increase costs of construction.

Current methods for both core-supported high-rise building construction and modular high-rise building construction can improve safety for construction personnel, decrease time required for construction, and decrease costs of construction when compared with conventional high-rise building construction. Exemplary embodiments of the proposed method for core-supported high-rise building construction can further improve safety for construction personnel, decrease the time required for construction, and decrease costs of construction, as more of the work is done at ground level and many processes are automated.

Therefore, it may be advantageous to provide a new method for constructing core-supported high-rise buildings in which embodiments build upon the previously described method for constructing such buildings. Exemplary embodiments may include locking device solutions, fire protection water supply solutions, temporary carrier beam solutions, façade mounting solutions, deflection control solutions, strand protection solutions, utility service riser installation solutions, and modular building solutions.

I. Locking Device

A greater description and discussion of locking device exemplary embodiments is provided below.

In many embodiments of the current method for constructing core supported high-rise buildings, the method may include slip forming, vertically, at least one building core with a hardenable substance, where during slip forming, a plurality of support member receptacles may be deposited at least partially within the hardenable substance at a perimeter of the slip form.

The current method may further include supporting a plurality of structural roof members with temporary support pedestals. The method may also include coupling at least one of the plurality of structural roof members with at least one other of the plurality of roof members to create a structural roof assembly.

The method may further include raising the structural roof assembly to a first elevation from the top of at least one building core. The method may also include supporting the roof assembly at the first elevation with a first plurality of support members that are in turn supported by at least four of the plurality of support member receptacles.

The method may further include supporting a plurality of structural floor members with the temporary support pedestals. The method may further include coupling at least one of the plurality of structural floor members with at least one other of the plurality of floor members to create a structural floor assembly.

The method may also include raising the structural floor assembly to a second elevation from the top of at least one building core, where the second elevation may be lower than the first elevation. The method may further include supporting the floor assembly at the second elevation with a second plurality of support members that are in turn supported by at least four of the plurality of support member receptacles.

In many embodiments of the current methods described above, a reliable system for supporting structural roof and floor assemblies from at least one vertical building core is necessary to ensure that the roof and floor assemblies are adequately supported by the building core(s). In the absence of such a reliable system, roof and floor assemblies may be inadequately supported, and subject to structural failures resulting in damage to façade systems or, in extreme cases, potential injuries to occupants and property losses. In many embodiments of the current method for constructing core-supported high-rise buildings as detailed above, a system for supporting structural roof and floor assemblies may include a plurality of receptacles and a plurality of support members. In some embodiments, each of the plurality of receptacles may be located at a corner of an exterior perimeter of the building cores. In these or other embodiments, each of the plurality of receptacles may also at least partially define an opening and the opening may open to two different sides of the building core.

In some embodiments, each of the plurality of support members may be configured to pass through the opening of at least one of the plurality of receptacles. In these or other embodiments, the support members may also be configured to be supported by at least one of the plurality of receptacles, and possibly extend outward from two different sides of the building core. In some embodiments, each of the plurality of support members may also be configured to support the structural floor assembly on two different sides of the building core.

In some embodiments, the structural floor assembly surrounds at least some portion of the building core and may be configured to move up and/or down some portion of the height of the building core. In these or other embodiments, the support members may be movably coupled with the underside of the structural floor assembly. As such, the support members may initially be in a first position which allows the floor assembly to move up and/or down the central structure without interference by the support member.

When the structural floor assembly is finally located at a desired elevation, the support members may be moved horizontally from the first position to a second position where each support member passes through an opening in a receptacle, possibly extending outward from two different sides of the building core. The floor assembly may then be lowered slightly such that the structural floor members are supported by the support members. Therefore, in some embodiments, the support member may support the floor assembly on two different sides of the building core. Note that in some embodiments, the floor may be supported as such from more than one building core.

In some embodiments, the system for supporting the structural floor assembly from a building core may also include a means for moving a support member between the first position and the second position described above. In some embodiments, the means for moving the support member may be manually or mechanically actuated from either the upper surface of the supported floor assembly, or from a temporary platform suspended below the floor assembly.

In many embodiments, the coupling of a structural floor assembly to a building core requires support members to be moved horizontally by manual or mechanically motorized means. Thus, in such embodiments, construction personnel must have direct access to the undersides of all structural assemblies at their final elevated positions. In some embodiments, access may be achieved by means of temporary platforms suspended below the structural assembly. Temporary platforms allow construction personnel to gain access to undersides of structural assemblies through openings in the core or temporary openings in the structural assembly itself. The requirements for this access may result in exposure of construction personnel to potential safety risks involving exterior work at height while being subjected to ambient weather conditions.

In another embodiment having a means for moving the support member, the means may also include the support member being slidably coupled with the underside of the structural floor assembly. A flexible member, such as cabling or rope, may be coupled with the support member in proximity to the end of the support member furthest from the building core. A breach in the structural floor assembly may allow the flexible member to penetrate the floor assembly and protrude from the topside of the floor assembly.

The flexible member may be pulled by a person or automated device on the upper side of the structural floor assembly to move the support member from the first position to the second position. In some embodiments, a pulley or other pivot point may assist in directing the force of pulling on the moveable member to more appropriately align with the location of the opening with respect to the support member.

In yet other embodiments, the support member may be spring loaded, or compressed gas and/or magnets may be used to move the support member into position remotely from the topside of the structural floor assembly.

In some embodiments in which moveable members may be employed to assist in the locking and engagement of structural roof and floor assemblies with building core(s), the moveable member may be pulled by a person or automated device on the topside of the structural floor assembly, as described above. Such a method may eliminate the need for construction personnel to have access to the underside of the structural assemblies. However, embodiments may still result in labor-intensive and slow processes requiring moveable members be pulled by manual or mechanically motorized means.

Such methods of pushing or pulling moveable support members may be reliant on precise positioning of the structural assembly and also require significant force to be applied to the moveable support members, increasing risk that a support member may not readily be positioned correctly. The methods may therefore require construction personnel to visually verify that the structural assembly is at the correct elevation and that support members are accurately positioned before they may be moved to the second position. Such processes may increase safety risks to construction personnel, prolong construction and procure additional expenses.

Due to the aforementioned requirements to physically move support members from a first position to a second position using manual or mechanically motorized means, and the corresponding safety, cost, and timing concerns, it may be advantageous to provide a solution that does not require such physical movement using manual or mechanically motorized means. Embodiments of such a solution may provide an automated, more reliable method of connecting structural assemblies to building core(s) with sufficient load capacity and safety factor to support the fully occupied floor, entire roof, or other assembly at the building core(s) or other vertical elements. The effective transfer of assembly loads to the building core(s) or other vertical elements may be achieved through use of automated locking devices providing adequate structural attachment to the building core(s).

In the proposed method for constructing core-supported high-rise buildings, many embodiments of the aforementioned locking devices may automatically engage with steel components in the exterior face of the building core through the action of gravitational forces only, whereby a component of the device rotates vertically around a pivot point using gravity, eliminating the need for direct access to the device by construction personnel, and thus minimizing safety concerns. Additionally, embodiments of the automated solution may minimize labor requirements, thus reducing construction time, in addition to decreasing construction costs.

In some embodiments, engagement of locking devices with building core(s) may require overjack of the structural assembly above the final desired position prior to the structural assembly being lowered back down to its final locked position. Overjack of such structural assemblies, with their coupled locking devices, may be limited by joint tolerances associated with secondary components, including façade members.

Overjack of the structural assembly is necessary to allow automated engagement of the locking device. As engagement typically involves vertical rotational movement of a component of the locking device, the clearance required to achieve that movement governs the magnitude of necessary overjack. Overjack is limited by the reasonable amount of temporary movement that can be tolerated by horizontal joints between secondary components such as façade panels and deflection control ties. Ideally, overjack should be limited to a maximum of about 75 mm (3 inches) so that the façade stack joint is not overly large.

In some embodiments, locking devices may operate in a fail-safe mode that results in consistently reliable engagement with the steel components in a building core, to ensure secure support of a structural assembly.

Proper engagement of the locking device is essential for necessary support of the structural assembly, such that assembly loads are fully transferred into the vertical building core(s) once strand jacks have lowered the structural assembly to its locked position. For locking device engagement to be fail-safe, its movement must be automated and independent of the need for external manual or mechanical operators to accomplish engagement, or any actions requiring direct access to the locking device by construction personnel. Fail-safe mode also requires that release of the locking device cannot occur without deliberate action to disengage the device from a steel component. This would only be possible if the structural assembly is raised by the strand jacks from its locked position such that the locking device could be disengaged. The assembly could then only be lowered below the locked position if the locking device was restrained in its disengaged mode.

For locking device movement to be automated, the device must be able to accommodate all anticipated tolerances associated with the assembly of the structural frame and the raising process for the completed structural assembly. To satisfy these tolerances, the steel component that receives the moveable portion of the locking device must be fabricated with adequate clearances to ensure unimpeded rotation of the locking device.

In some embodiments, verification of locking device engagement may be achieved using visual confirmation via camera or through activation of electrical sensors.

For complete reliability that full engagement of the locking device has been achieved, use of electronic load sensors (including strain gauges) attached to the locking device, or visual monitoring methods (including cameras) whereby the complete movement of the locking device is observed, can be implemented to verify the correct alignment and positioning of the locking device.

In one embodiment of the invention, a locking device apparatus is provided. Exemplary embodiments of such locking devices may have retractable capability such that automatic disengagement may occur following temporary engagement with the building core(s). Such automatic disengagement may allow structural assemblies to pass upwards freely. Exemplary embodiments may be readily attached to structural assemblies using simple connections and may result in minimal encroachment into interior floor spaces.

Exemplary embodiments may be standardized fabricated or manufactured components that exhibit consistent quality at reasonable costs. Embodiments may be standardized based on specific load ranges and deflection limits for typical structural assemblies. Because there is an optimum size of structural floor assembly that can be supported by each building core, governed by deflection limitations for a typical structural assembly and expected loading conditions for a particular occupancy, embodiments of locking devices may be categorized and standardized for particular load limits such that two or three standard sizes may be offered. For exemplary, an 80-ton (73-tonne) locking device may be appropriate for more lightly loaded, smaller floors (typical for residential or hotel usage), while a 120-ton (109-tonne) locking device may be appropriate for more heavily loaded, larger floors (typical for office, laboratory, or hospital usage).

Some embodiments of locking devices may be comprised of two components, including a fixed bracket and a moveable component. In many embodiments, such a fixed bracket may be connected to the moveable component by means of a structural pin to allow vertical rotation.

For efficient transfer of loads from the structural assembly to the core, the preferred location for attachment of the locking device is at the underside of the lower flange of the primary beam. Supporting the structural assembly from below allows the full strength of the primary beam to be preserved, with appropriate stiffening being added as necessary. The locking device bracket could be attached using bolts, weldments or retaining clips.

Exemplary embodiments of the aforementioned fixed bracket may be rigidly attached to the underside of the structural assembly. In many embodiments, such an attachment may be made using simple bolted connections.

Use of a bolted connection between the locking beam bracket and the primary beam allows for rapid attachment and detachment that is both reliable and simple. Typically this involves four bolts for each locking device bracket, requiring conventional tools such as wrenches or bolting machines for attachment to the primary beam.

Methods of attachment may include use of regular structural or torque control bolts with compatible washers and nuts.

As structural assemblies are raised upwards, locking device exemplary embodiments may automatically engage with building core recesses by means of vertical rotation around a pivot point using gravity, when a recessed pocket is encountered. The moveable component may be proportioned or otherwise weighted such that engagement with a steel component occurs automatically, through rotation around a pin, where location of the moveable component's center of gravity is offset from the pivot point. Rotation occurs when gravity acts on the center of gravity of the moveable component causing rotation at a recessed pocket, when the outer face of the building core wall no longer offers resistance to such rotation. Lowering the structural assembly may engage the locking device such that the full load of the assembly may be supported by the locking device, which may then transfer the load to the building core. In some embodiments, temporary counterweights may be attached to locking devices to facilitate rotation and engagement with the steel component.

Automated engagement of the locking device with a steel component requires the moveable portion of the locking device to rotate about the pin that connects it to the fixed bracket. This can only occur if the center of gravity of the moveable portion is outwardly offset from the position of the pin. This condition is satisfied either by extending the length of the moveable portion of the locking device, or temporarily attaching counterweights which can be removed once the structural assembly has been locked in place.

In another embodiment of the invention, a method for implementing and utilizing locking devices is provided. The method may include embedding prefabricated steel components into the building core(s) at predetermined positions and elevations, corresponding with each roof and floor level. Such an embedding process may be completed during slip forming and building core construction. Along with steel components, additional inserts may also be deposited at the proper locations per architectural and engineering plans provided beforehand. Merely by way of example, support mounting elements (for example, plates on the interior walls by which structural beams may be coupled at various levels), blockouts or collapsible and re-usable frames (to define where doors will later be installed within the building core wall), and other inserts which will allow future installed mechanical, plumbing, and electrical equipment to penetrate the building core walls.

Steel components must be installed during construction of the building core to ensure that they become structurally integrated with the core. This allows for proper transfer of the load from the structural assembly to the building core.

Each steel component must be precisely fabricated to accommodate the moveable portion of a locking device, with appropriate clearances that account for tolerances associated with the construction of the building core. Typically building cores can be slip formed within a one-inch (25 mm) out-of-vertical tolerance over a height of 150 feet (45 meters). The steel component must also allow the overjack requirement to be satisfied when the structural assembly is raised. The steel components can be fabricated from welded steel plates or can consist of a steel casting. In either case the steel component will need to have structural anchors attached to it such that the anchors are embedded into the concrete of the building core and can adequately transfer structural loads from the locking device into the core.

The proposed method may further include supporting a plurality of structural members with temporary support pedestals. Such temporary support pedestals may be located around the base of each building core(s) so that a plurality of structural members may be supported. Temporary support pedestals may vary in shape and size to support different sizes and numbers of structural members. The method may further include coupling at least one of the plurality of structural members with at least one other of the plurality of structural members to create a structural assembly.

The method may further include the coupling of locking devices to the undersides of the structural assembly's primary beams. In many embodiments, four locking devices may be permanently attached to the assembly, located adjacent to the corners of each building core. In some embodiments wherein there may be multiple cores, additional locking devices may be implemented such that four locking devices are located adjacent to the corners of each of the building cores. In many embodiments, engagement of such locking devices with the steel components may be sufficient for the permanent connection of the structural assembly with the building core. In other embodiments, when located in high seismic zones or where other circumstances may call for locking devices to be more securely connected to the steel components and building cores, additional mechanical fastening such as weldments of bolted fittings may be used to secure locking device into place. Such additional fastening may further secure structural assemblies to core(s) and minimize damage in the event of an earthquake.

Typically, where cores are rectangular in shape and of a size where the dimension of the largest side does not exceed 50 feet (15.24 m), there should be no need for more than one locking device at each corner of the core. There may be core configurations or sizes where additional locking devices would be beneficial to provide adequate support of a structural assembly. In each case a structural analysis would be performed to determine the exact configuration and number of locking devices.

The method may also include raising the structural roof or floor assembly to a final elevation. In some embodiments this may be accomplished by coupling one or more strand jacks with the top of the building core or cores. The strands from the strand jacks may then be coupled with temporary carrier beams located at the underside of the structural assembly, and the strand jacks activated to raise the roof or floor assembly. Automatic or manual systems may assist in coordinating the strand jacks, ensuring the roof or floor assembly is raised in a level manner. The method may also include the rising of the articulated locking devices with the structural assembly being raised. In many embodiments, the positioning of the locking devices may allow for the bearing ends of such devices to be in direct contact with the external surface of the building core wall. Such direct contact may occur over the vertical sections of the building core wall between recessed pockets within the core(s).

The method may further include automated engagement of the locking devices with steel components located in the walls of the building core(s). Such engagement may be defined by a vertical rotation of the locking device around a pivot point, into the recessed pocket using gravity. In the event the current level is not the final intended level for the structural assembly being raised, locking devices may employ retractable capability to automatically rotate out of the recessed pocket, as the assembly continues to rise freely.

The structural assembly can continue to rise even though locking devices encounter recessed pockets in the building core. The moveable portion of the locking device will rotate into, and out of, a recessed pocket as long as the upward movement of the structural assembly continues. In the event that there is a need to stop the raising operation for a prolonged period of time, the strand jacks can lower the structural assembly to the first set of steel components that are encountered and allow the entire assembly to be temporarily, fully supported by the building core. Once the temporary stop is concluded, the jacking operation can be resumed and the locking devices will automatically disengage from the steel components allowing assembly raising to continue.

Locking devices do not recognize whether the structural assembly is at, or approaching, the intended final level for that assembly. Recognition that an assembly is at its final intended level is dependent on observation by construction personnel or remote detection by sensing devices. This can be achieved using cameras or proximity sensors. Generally, the final position is reached following overjack and subsequent lowering of the structural assembly until it is fully supported by the locking devices.

In some embodiments, as the structural assembly reaches its permanent elevation or level, the method may include overjacking the assembly above the designated level by a distance amount that is limited by tolerances associated with secondary components such as façade panels and deflection control ties. Such overjack may allow for locking devices to engage with the steel components in the face of the building core(s) through vertical rotation. The method may further include lowering locking devices into aforementioned steel components until the entire load of the structural assembly is fully supported by locking devices. In other embodiments in which a temporary stop in the raising operation is required, a similar or identical process may be performed to facilitate engagement of the assembly with the building core(s).

In some embodiments of the proposed method for core-supported high-rise building construction, materials and/or other components with significant weight are coupled with a structural roof or floor assembly after the assembly has been raised clear of the temporary support pedestals but is still in close proximity to ground level. Once the structural assembly has been raised clear of the temporary support pedestals, the proposed method may allow the structural assembly to be stopped and temporarily secured, through automatic engagement of the locking devices with the steel components, at a level where the structural assembly is in close proximity to ground level to allow coupling of materials and components with significant weight. Such materials and components may include a hardenable material, for example concrete, that is poured on top of the roof or floor members to complete the structural assembly. Coupling of materials and components, with significant weight, to the structural assembly while supported by the locking devices, allows deflection of the structural members to occur before hardening of the concrete which minimizes cracking of the finished surface of the roof or floor.

As the structural roof assembly is raised, the proposed method may also allow the roof assembly to be stopped and temporarily secured at any level where steel components are positioned, through automatic engagement of the locking devices with the steel components. Construction personnel may then safely access the fully supported roof assembly to remove temporary filling from the recessed pockets at the level above. Furthermore, any other temporary block-outs, collapsible and re-usable frames or inserts within proposed openings in the building core may be removed as the structural roof assembly is raised. Any other finishing of the building core(s) may also be performed once the roof assembly has been raised to, and stopped at, an interim level.

Following coupling of a structural assembly with the building core(s) by means of engagement of locking devices with steel components, the method may further include lowering carrier beams by strand jacks, in the same way in which they were raised, allowing for the raising and locking process to be repeated for the following structural assembly.

Turning now to FIG. 1, a schematic of a locking device exemplary embodiment is shown. In some embodiments, the device may be comprised of two parts, including a fixed bracket 110 and a moveable component 120, coupled by means of a structural pin 100. The positioning of the pin 100 and the fixed bracket 110 is such that the center of gravity 130 of the moveable component 120 is offset from the pin 100 which allows for the rotation of the moveable component 120 around the pin 100.

Figure 2:
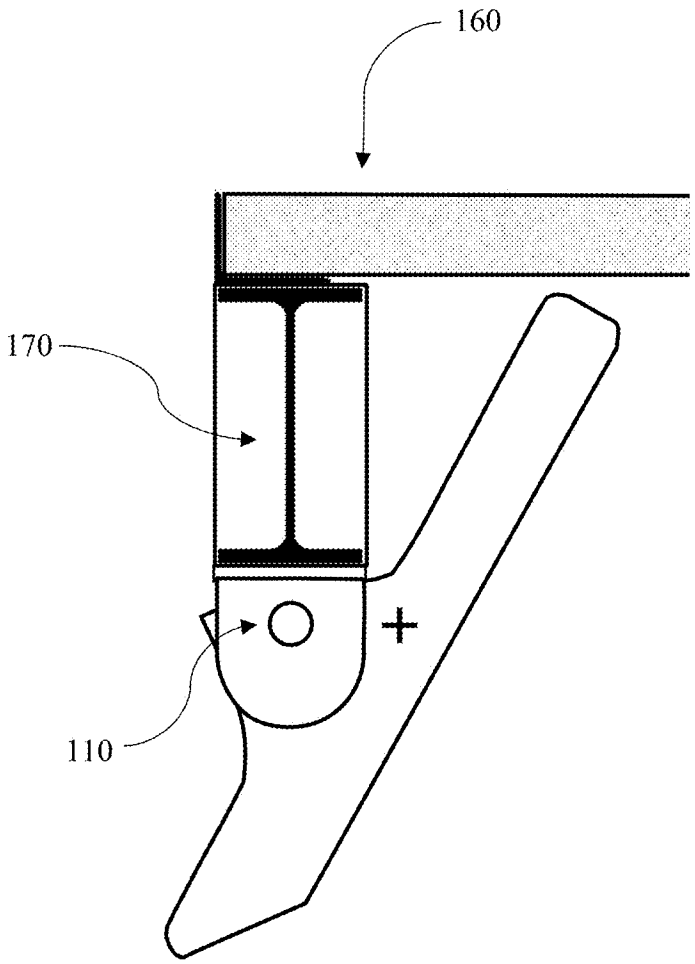
FIG. 2 is a schematic illustrating a locking device coupled with a primary beam that is part of a larger structural assembly, according to various exemplary embodiments.

The attachment of the locking device is shown in FIG. 2. Exemplary embodiments include rigidly coupling the fixed bracket 110 with the underside of the primary beam 170. In many embodiments, the primary beam 170 is then coupled to other structural members via a simple bolted connections to result in a completed structural assembly 160.

Figure 3:
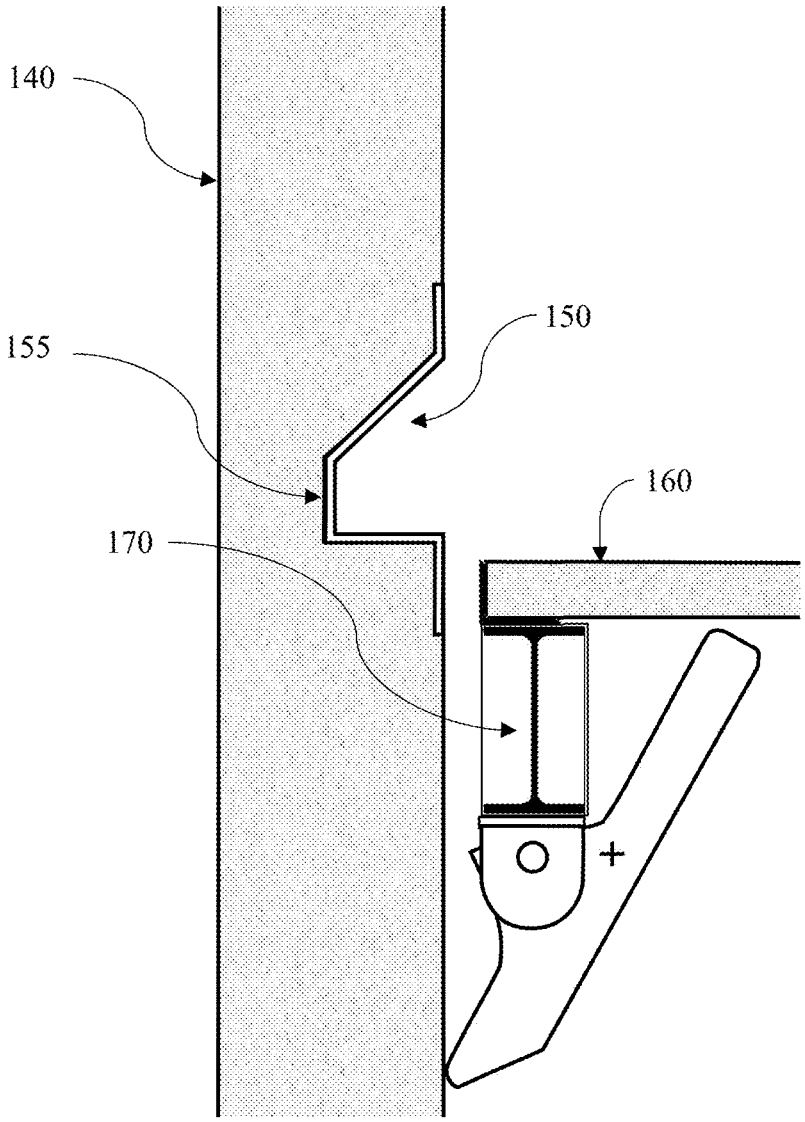
FIG. 3 is a schematic illustrating a locking device as it rises vertically alongside a building core, according to various exemplary embodiments.

FIG. 3 shows the initial position and use of the locking device. An exemplary process begins by embedding a prefabricated steel component 155 into the building core 140 at positions and elevations of each roof and floor level. Structural assemblies 160 are then constructed at ground level, supported by temporary support pedestals located around the base of each building core.

After the structural assembly has been constructed, locking devices may be coupled to the primary beam 170 using simple bolted connections or alternative forms of mechanical fastening as described above. A minimum of four locking devices should be permanently attached to the primary beams 170, located at each corner of the building core 140 in order to fully support the assembly 160 on the building core. Following completion of the structural assembly 160, it may be raised by carrier beams and the synchronized operation of strand jacks. Locking devices may rise with the structural assembly such that the bearing surfaces of the moveable components of the locking devices are in direct contact with the outer face of the building core wall 140.

Figure 4:
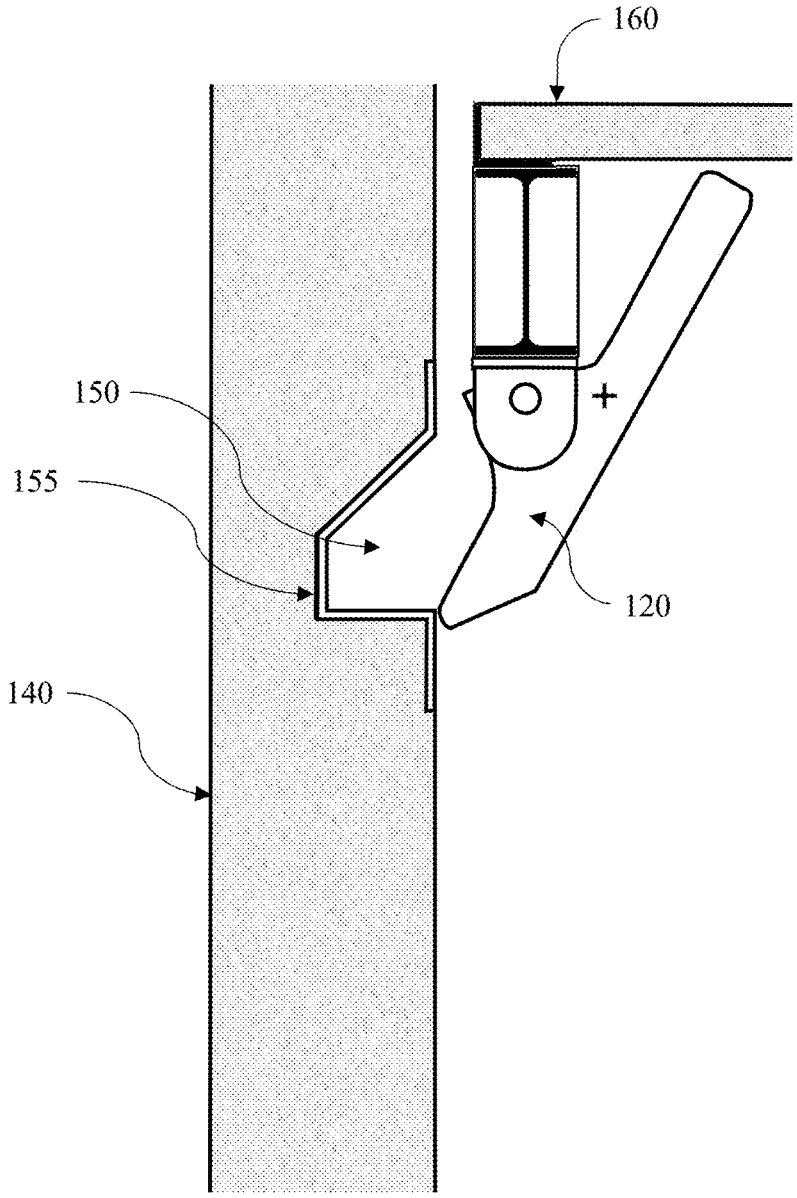
FIG. 4 is a schematic illustrating a locking device immediately prior to encountering a recessed pocket in the external face of a building core, according to various exemplary embodiments.
Figure 5:
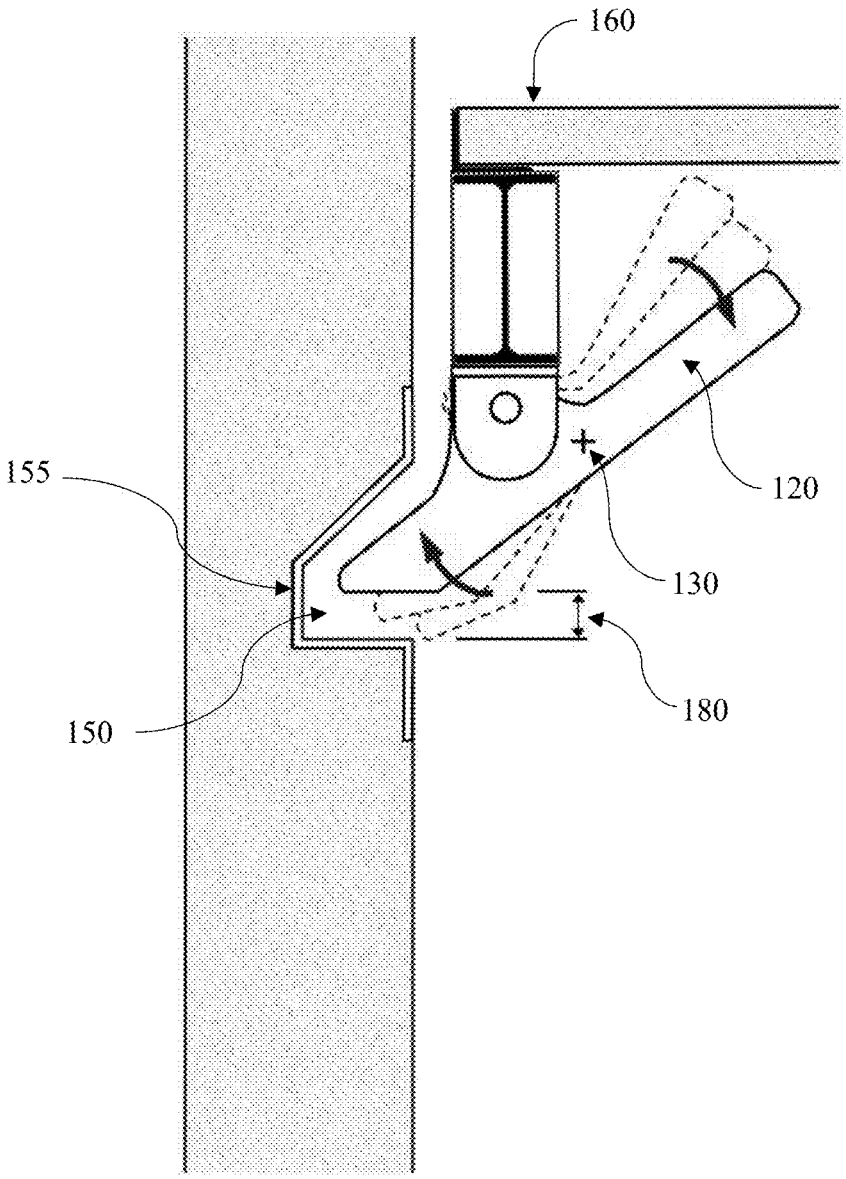
FIG. 5 is a schematic illustrating a locking device as it rotates into a recessed pocket in the external face of a building core, according to various exemplary embodiments.

FIG. 4 illustrates embodiments of the locking device as it encounters a floor or roof level in the building core 140. Such floor and roof levels are designated by recessed pockets 150 in the outer face of the building core 140. When the assembly 160 encounters a recessed pocket 150, the moveable component 120 may automatically engage with the steel component 155 by means of vertical rotation. Such engagement of the locking device with the core is shown in FIG. 5. Vertical rotation may result from gravitational force, acting upon the moveable component's center of gravity 130. The moveable component embodiment 120 may rotate into the recessed pocket 150.

Figure 6:
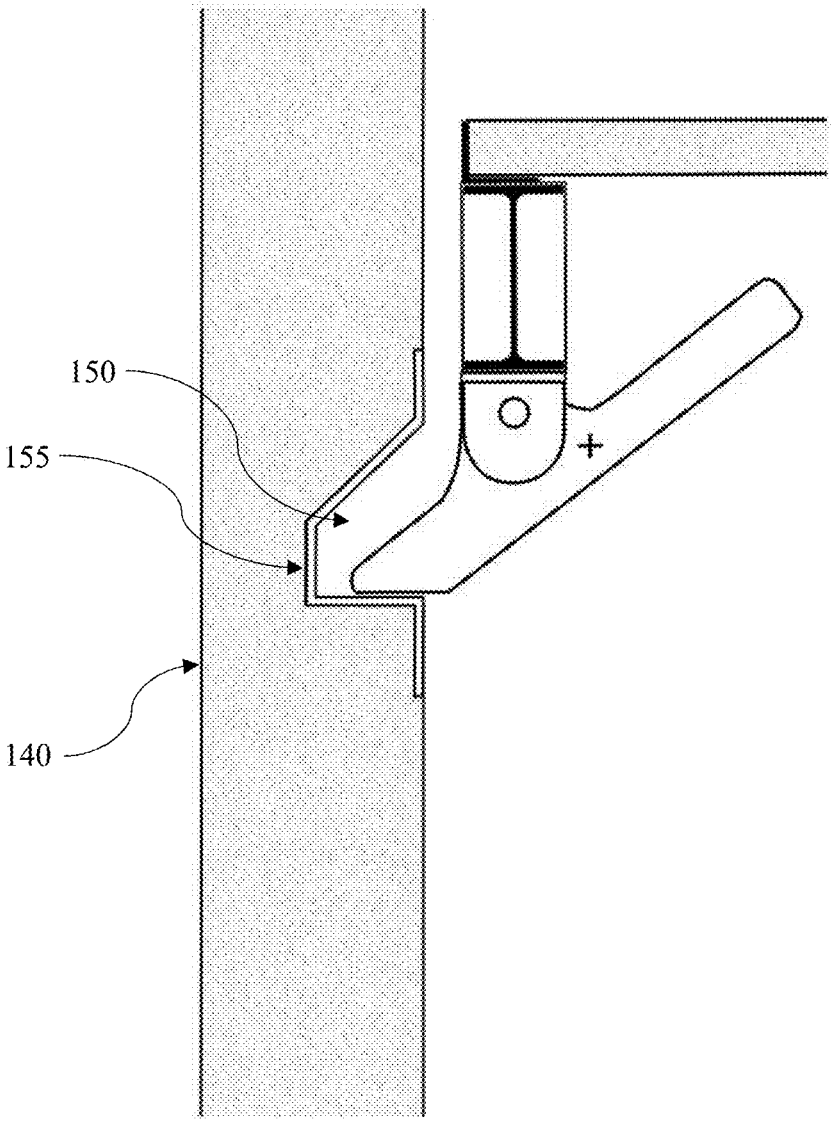
FIG. 6 is a schematic illustrating a locking device once it has engaged with a steel component in the external face of a building core, according to various exemplary embodiments.

In exemplary embodiments, the structural assembly may be raised, using carrier beams and the synchronized operation of strand jacks, above the intended designated level by an overjack distance 180. The moveable component 120 of the locking device may then freely rotate into the recessed pocket 150. The structural assembly 160 may then be lowered by the strand jacks until the entire weight of the assembly is fully supported by the locking devices, as illustrated in FIG. 6.

Figure 7:
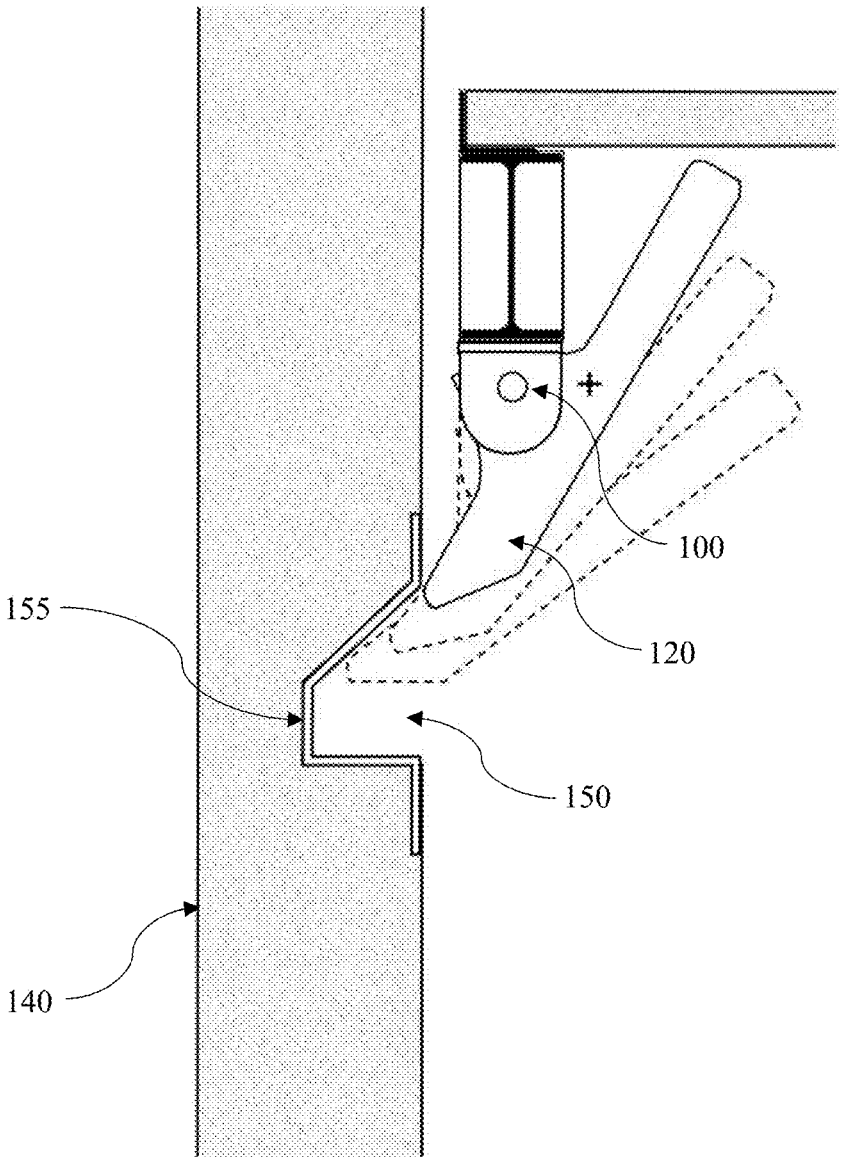
FIG. 7 is a schematic illustrating a locking device as it rotates out of a recessed pocket in the external face of a building core allowing a structural assembly to continue to rise, according to various exemplary embodiments.
Figure 8:
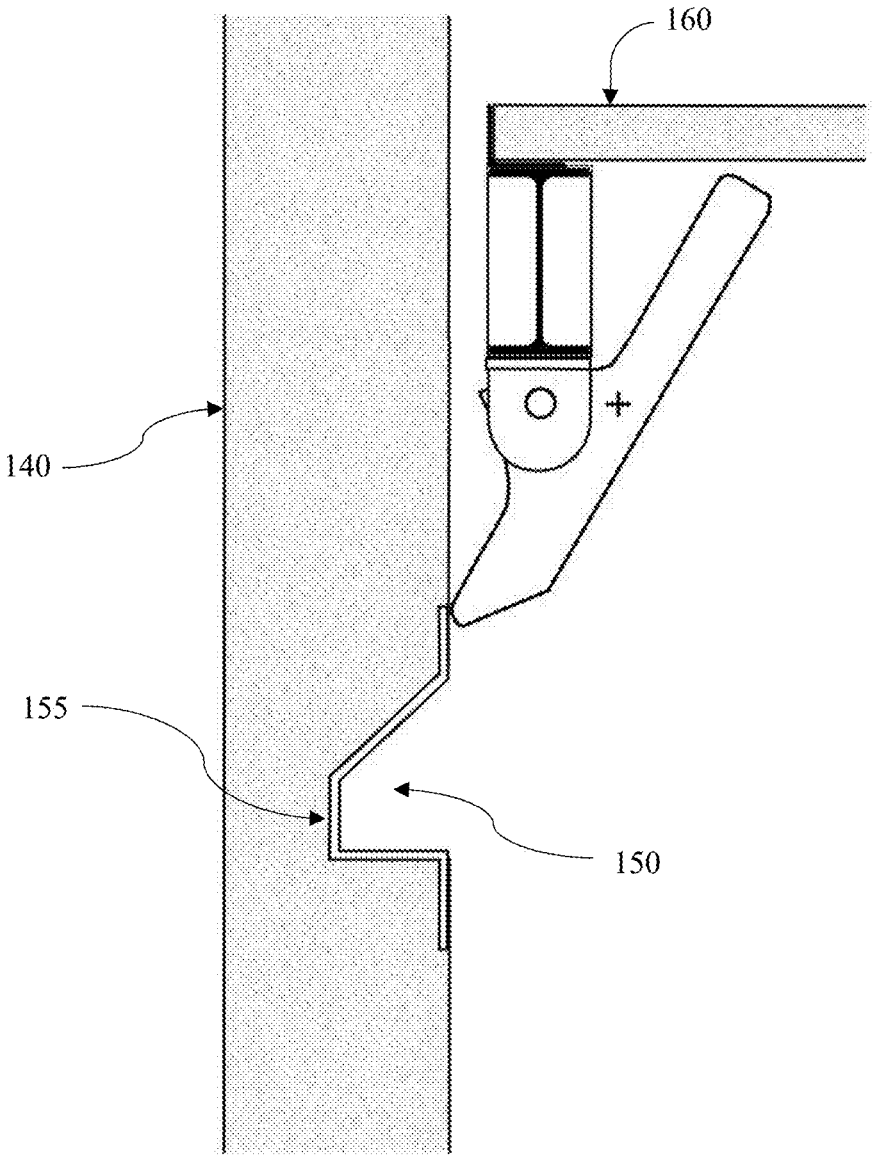
FIG. 8 is a schematic illustrating a locking device as it continues moving upwards alongside the external face of a building core, according to various exemplary embodiments.

In the event that the current level is not the intended final level for the structural roof or floor assembly, it will disengage from the building core and continue to rise. This disengagement is illustrated in FIG. 7. The locking device's moveable component 120 disengages from the steel component 155 by vertical rotation around its pin 100, in the same manner by which it engaged initially. FIG. 8 shows the structural assembly 160 continuing the rise along the face of the building core 140 after engagement and disengagement of the locking device with the steel component 155.

II. Fire Protection Water Supply

A greater description and discussion of fire protection water supply exemplary embodiments is provided below.

In many embodiments of high-rise building construction, a major safety concern during construction may be the risk of fire outbreak and spread without availability of immediate fire protection systems. In some embodiments where work is to be done with flammable and combustible materials, such materials may ignite easily and thus cause fires to erupt on construction sites. In other embodiments where construction sites are open and accessible, such sites may be more vulnerable to theft, vandalism, and arson.

In some embodiments, if such a fire erupts early in the construction process, fire-stopping elements such as gypsum and perlite boards, fiberglass and mineral wool insulation and fire-resistant sealants may not be installed yet. Thus, fires may be able to spread easily throughout buildings that are under construction.

In other embodiments wherein work involving heat is to be done, heated materials and equipment may allow for ignition and spread of fires. In one embodiment, exemplary work may be represented by welding. In another embodiment, exemplary work may be represented by soldering. In yet another embodiment, exemplary work may be represented by grinding.

In other embodiments, where construction personnel may be engaging in activities such as installation of high voltage electrical equipment and wiring which may evoke the eruption of fires at construction sites. In one embodiment, occurrence of electrical arc flash accidents or accidental electrical grounding may result in fires. Such fires may feed off of flammable materials being used in construction.

It is well-documented that fires during building construction, due to these or additional factors, invoke extensive property damage annually. Such additional costs may significantly impede upon construction timelines and may even halt construction for a temporary or indefinite periods of time, in addition to depleting funds. In addition to imposing additional expenses, construction fires may result in death or injury of construction personnel.

In some embodiments of the current conventional construction method for high-rise buildings (using cranes to erect the structure from the ground up), the building's roof structure may be the final portion of the building to be built. In some embodiments wherein water storage is to be contained on the roof, a water storage tank may be one of the final components to be installed in the building. In such embodiments, such a lack of reliable water supply may necessitate the dependency of fire protection upon high-pressure pumps located at ground level and risers to convey water to upper levels, in addition to portable fire extinguishers. In some embodiments, risers may not be completely installed and secured at the time in which a fire may occur. In such embodiments, there may not be an effective method for extinguishing fires at upper levels. In other embodiments wherein risers have been previously installed and secured, problems associated with pumps located at ground level may cause a delay in conveyance of water to extinguish fires. In many embodiments, such a delay may increase property damage and, in turn, increase construction costs and extend completion periods.

In other embodiments, the building's structural roof assembly may be one of the initial portions of the building to be constructed, but the necessary water storage may not be installed until a later point in the construction process. In such embodiments, such a lack of reliable water supply may necessitate the dependency of fire protection upon high-pressure pumps located at ground level and risers to convey water to upper levels, in addition to portable fire extinguishers. In some embodiments, risers may not be completely installed and secured at the time in which a fire may occur. In such embodiments, there may not be an effective method for extinguishing fires at upper levels. In other embodiments wherein risers have been previously installed and secured, problems associated with pumps located at ground level may cause a delay in conveyance of water to extinguish fires. In many embodiments, such a delay may increase damage and, in turn, increase construction costs and extend completion periods. Therefore, it may be advantageous to provide a solution wherein a reliable gravity-fed water supply for suppression of fires during all phases of construction may be provided. Exemplary embodiments of such a solution may allow for water to be readily available, allowing for the minimization of delay in conveyance of water to extinguish fires at upper levels. Such minimization of delay may allow for a decrease in damage and costs as well as increased safety measures and decreased potential for death or injury of construction personnel. Exemplary embodiments of such a solution may allow for water to be gravity-fed, allowing for quicker conveyance of water to extinguish fires at upper levels without dependency on high-pressure pumps during fire emergencies, thus minimizing delay, damage, and costs, as well as increasing safety measures and decreasing potential for death or injury of construction personnel. Exemplary embodiments of such a solution should contain a volume of water satisfying code requirements for flow rates and durations.

In one embodiment of the invention, permanent water storage tanks may be installed at the roof level at a point early in the construction process. In one embodiment, water storage tanks may be installed as part of the core cap, which may be defined as a permanent structural and weathertight enclosure that may be constructed at ground level during slip form assembly. In another embodiment, water storage tanks may be installed as part of the structural roof assembly prior to the assembly being raised by the strand jacks to its permanent position at the highest level of the building.

Exemplary embodiments of such water tanks may have a capacity that will satisfy all applicable fire codes once the building is complete and occupied. In some embodiments, such codes may require a tank to supply a fire for 30 minutes at a maximum flow rate of 1,000 gallons per minute (3,785 liters per minute). This may, in such embodiments, require a 30,000-gallon (114,000-liter) tank, or approximately 4,000 cubic feet (115 cubic meters) of water storage. In other embodiments wherein buildings are extremely tall, a possibility exists wherein water pressure at lower levels may become excessive if supplied from the roof only. In such embodiments, it may be necessary to provide multiple water tanks at lower levels, in addition to water tanks located at the roof level. Exemplary embodiments of such gravity-fed fire protection systems may include pressure-reducing valves or intermediate tanks to limit the static water pressure in standpipes and fire sprinklers to acceptable pressure levels. In such embodiments, tanks may be required to be placed every 15-20 floors.

In all embodiments, the preferred location of all elevated tanks may be within the building core(s). In embodiments wherein such placement is not feasible, tanks may be located as close to the building core(s) as possible. In embodiments wherein water tanks may be located within the building core(s), tanks may be installed during construction of the core cap.

The preferred location for an elevated tank is within the building core due to the significant load that a full water tank will impose. Typical code requirement for a high-rise building would be for a storage tank holding a minimum of 30,000 gallons (114,000 liters) of water with a weight of 125 tons (114 tonnes). When a tank is raised as part of the core cap, the tank would be empty. Construction of a building core poses exceptionally low risk of fire due to the minimal quantity of combustible and flammable materials associated with core construction. Prior to raising of the first structural floor assembly (together with any staged construction materials and equipment), the tank may be filled with water for use in the event of fire emergencies.

Where it is not feasible to locate the tank within the building core, it should be as close to the core as possible and can also be split into two or more tanks, arranged around the core and interconnected with piping. Where a building employs two or more cores, the water storage tank may be located between the building cores where the structural roof assembly typically exhibits the greatest load-carrying capacity.

In exemplary embodiments, water storage tanks shall be filled with water after being raised, allowing immediate availability of protection in the event of construction fire occurrences. Exemplary embodiments may contain fire risers or standpipes extending downward within the building core(s) and allowing for distribution of a reliable and gravity-fed water supply for suppression of fires. Such fire risers or standpipes may be installed during the raising of the core cap or structural roof assembly. Immediately following the raising of the core cap or roof assembly, such fire risers or standpipes may be connected to pumps located at ground level allowing water storage tanks to be filled to a capacity satisfying building codes.

In one embodiment of the invention, a method for installing and filling water storage tanks at roof level at early stages in the construction process is provided. In one embodiment, the method may include slip forming, vertically, at least one building core with a hardenable substance, wherein a permanent structural and weathertight enclosure, known as a core cap, may be integrated into the design of the slip form platform. Such construction of a core cap may occur at ground level, prior to slip forming and core construction.

Where slip forming is used for construction of the building core, structural framing and decking, that will become part of the core cap, will be assembled at ground level and serve as the upper deck of the slip form system. Once the core reaches full height the decking for the core cap will be completed and a waterproofed concrete slab, or other form of roofing system, will be constructed to create a weathertight cap over the core.

The core cap will not utilize locking devices. Structural connection of the core cap assembly will be achieved through bolted or welded attachment to steel plate embedments that are cast into the building core walls.

The method may further include raising the core cap or roof assembly to its final, elevated position, with empty water storage tanks enclosed.

The method may further include constructing a structural frame known henceforth as a tank support framework. The tank will be supported on the tank support framework. Such a tank support framework may be structurally sturdy enough to ensure full support of the water tank after its installation and filling with water. The method may further include constructing and installing an empty water storage tank upon the aforementioned tank support framework. In one embodiment, brackets may be bolted or welded to steel plate embedments that have been cast into the interior face of the building core walls to support the tank support framework in a manner similar to that of the core cap described above. This bolted or welded attachment of brackets may be completed from the work platforms of the slip form equipment.

Where slip forming is used for construction of the core, both the tank and the tank support framework will be assembled at ground level as part of the slip form platform assembly. This entire assembly will then be carried by the slip form system. Once the core reaches its full height and the concrete has reached the necessary strength (usually 2 to 3 days), brackets will be welded to steel embedment plates that have been cast into the core walls. These brackets will be located beneath the primary beams of the tank support framework, such that they will carry the load of the framework and the tank when full of water. Final connections between the tank support framework and the brackets will be made using either bolts or welds. Once the tank loads are being supported by the brackets, the framework will be disconnected from the temporary slip form system which will then be disassembled and lowered back to ground level.

In another embodiment, the solution may include slip forming, vertically, at least one building core with a hardenable substance, wherein a structural roof assembly may be raised using strand jacks or other means of hoisting. The method may first include coupling at least one of the plurality of structural roof members with at least one other of the plurality of structural roof members to create a structural roof assembly. Such construction of a roof assembly may occur atop temporary support pedestals located at the base of the core.

In an exemplary embodiment wherein water storage tanks are to be provided as part of the building's roof assembly, such water storage tanks may be constructed and installed along with any additional roof-mounted components and machinery before the structural roof assembly is raised. By loading roof top equipment such as water storage tanks, elevator machinery, HVAC equipment, plumbing and electrical equipment, together with construction materials and supplies onto the roof assembly before raising, the need for a crane to lift such materials and supplies to the roof, after it is in its elevated position, is obviated.

When water tanks are to be located on the structural roof assembly, the tank support framework will be completed at the time of roof assembly construction, and the tank will be installed on the framework. Following waterproofing of the roof assembly and insulation and testing of the water tank, the entire roof assembly will be raised to its final position and locked into place.

Following the raising and locking of the structural roof assembly, the uppermost floor will then be assembled and raised. When the uppermost structural floor assembly is raised, it will be used as a platform from which locking beam pockets and other embedments will be inspected for accuracy of placement.

The method may further include fitting enclosed water tanks with premanufactured openings and welded pipe fittings attached to them including pipe flanges that will allow riser and standpipe connections.

Sections of the fire water riser and standpipe may be carried on the uppermost structural floor assembly and as the assembly is stopped at each successive level, riser and standpipe sections may be added to the sections below. Fire riser and standpipe sections may be incrementally added from the ground level up to the tank using typical pipe connectors. These will generally involve bolted flange joints with gaskets, or mechanical grooved couplings.

Each riser and standpipe section may be supported on the sections below and secured to the building core at each floor level. Support brackets attaching the riser pipe to the core wall and the structural floor assemblies may use conventional and readily available attachment components, including clamps and stand-offs, etc.

The riser may then be tested, connected to high-pressure pumps located at ground level, and used to convey water up to the water storage tank at roof level, allowing for the tank to be filled with adequate water supply for use during any fire emergencies.

The completed standpipe may provide a reliable, readily available, gravity-fed path for water to travel to each floor level in the event of fire emergencies.

The method may further include filling the tanks with water to an amount governed by building codes. Once the water storage tanks are filled, such a fire suppression system may minimize delay in water reaching and extinguishing fires, which may in turn improve fire safety conditions and prevent procurement of additional construction costs and expenses, as well as preventing unnecessary prolonging of the construction process.

Turning now to FIG. 9, a plan view of exemplary embodiment wherein a water storage tank 200 is placed within the building core 140 is shown. FIG. 10 shows the section view of FIG. 9, with the water tank 200 being supported by a tank support structure 230. Exemplary embodiments of a tank support structure are structural frames which are in turn supported by brackets 240 connected to the core walls 140, as described in detail further above.

In many embodiments, building cores must extend above the roof level to provide stairway or elevator access to the roof, allowing water tanks to be placed immediately below the core cap 210 and above the roof level 220. FIG. 10 also shows attached riser pipes and standpipes 250, used in embodiments to convey water up from pumps at ground level and down to each level in the event of a fire emergency as described above.

III. Temporary Carrier Beam

A greater description and discussion of temporary carrier beam exemplary embodiments is provided below.

In the current construction method for core-supported high-rise buildings, as described in detail further above, structural roof and floor assemblies may be constructed upon temporary support pedestals located at the base of slip for med building cores. Roof assemblies may be constructed by coupling one structural roof member with at least one other roof member, and may then be lifted to a first elevation, supported with a first plurality of support members. Floor assemblies may be constructed by coupling one structural floor member with at least one other floor member, and may then be lifted to a second elevation, where the second elevation is lower than the first elevation and supported with a second plurality of support members.

In some embodiments, the raising of the aforementioned structural roof and floor assemblies may be accomplished by coupling one or more strand jacks with the top of the building core or cores. Strand jacks are used to lift very heavy loads vital in construction of core-supported high-rise buildings, as they allow for the raising of assemblies weighing up to thousands of tons. An embodiment of a strand jack is a hollow hydraulic cylinder with a set of steel cables or strands that pass through the open center, with each strand passing through two independent sets of clamps that grip the strands. The jack operates to raise or lower the strands by alternating between gripping and releasing strands while the hydraulic cylinder expands and contracts. During the raising operation, an upper set of clamps grip the strands while a lower set of clamps release the strands allowing the strands to be raised during expansion of the hydraulic cylinder. At the limit of the cylinder's stroke, the lower set of clamps grip the strands while the upper set of clamps release the strands allowing the strands to be raised again during contraction of the cylinder. These actions are reversed to allow a strand to be lowered. Once strand jacks are coupled with the top of the building core(s), the strands may then be coupled with the structural roof or floor assembly, and the strand jacks activated to raise the roof or floor assembly. When more than one strand jack is employed, automatic systems may assist in ensuring the roof or floor assembly is raised in a level manner.

In many embodiments, the coupling of the strands from the strand jacks with assemblies is achieved through the use of fixed anchor blocks. Strand jack cables or hoisting strands are inserted into cavities at the top of the block, containing two-part or three-part strand anchor wedges that are forced into a tapered hole. Exemplary embodiments of such hardened steel wedges may have teeth on their inner face that allow wedges to grip the strands. Such a grip allows the strands to be securely coupled with the anchor blocks, and in turn securely coupled with structural assemblies that are to be raised.

In the current method strand anchor blocks are attached to lifting beams using bolted connections. The lifting beams temporarily support the roof and floor framing during jacking operations. The positioning of the lifting beam is dependent on manual placement beneath the framing to be lifted. This could result in imprecise positioning which in turn could:

- Introduce uncertainty in the distribution of the assembly loads, which may affect operation of the strand jacks, and
- Allow the strands to be located too near to obstructions as the strands pass through openings in the assembly, which can expose strands to the risk of unanticipated wear or other damage during lifting operations.

The current method relies on a diagonal arrangement of the lifting beam which must support both the primary beam and the secondary beam at each corner of the building core. This may result in an asymmetrical configuration of the lifting beam requiring eccentric support by the strands. The current method also requires the lifting beam to carry the support member which is released when the assembly reaches its final location and the support member is engaged with a support member receptacle.

In many embodiments of the current method for constructing core-supported high-rise buildings wherein lifting beams are directly coupled with structural assemblies, such lifting beams must be physically disconnected following the raising of assemblies. Because strands, strand anchor blocks, and lifting beams must be reused in raising further assemblies, lifting beams must be disconnected from the primary and secondary beams such that they may be coupled to the proceeding assembly. In the current method, the release of the support member, once the structural assembly has reached its final position, may cause the lifting beam to become unbalanced causing difficulty in disconnecting the lifting beam from the primary and secondary beams of the structural assembly. It may be necessary for construction personnel to access the lifting beam interface with the structural assembly to ensure that full disconnection is achieved.

Such disconnection may prolong construction and result in additional setbacks in the construction process. In some embodiments, for exemplary, the physical disconnection of lifting beams may take 2-3 hours for each assembly that is raised. In some embodiments, this may require construction personnel to manually perform the disconnection at height, which may pose a significant safety concern. Additionally, such work at height may be dependent on ambient weather conditions.

Therefore, it may be advantageous to provide a solution for raising structural assemblies in which lifting beams are not directly coupled with assembly slabs. Such a solution may allow for the reuse of strands, strand anchor blocks and lifting beams without the need to physically disconnect such embodiments from structural assemblies, thus saving time in construction. Additionally, such a solution may ease safety concerns associated with performing manual work at height and in ambient weather conditions.

Exemplary embodiments of such a solution may result in a stable and balanced hoisting system with sufficient load capacity to safely raise structural assemblies during construction of core-supported high-rise buildings. Exemplary embodiments of such a solution may include the use of hoisting devices that may connect strand jack cables to structural assemblies through the use of fixed strand anchor blocks. Exemplary embodiments of such hoisting devices may be designed for use with structural assemblies containing beams of varying depths, such that embodiments may be reused on a variety of projects with differing assembly configurations. Exemplary embodiments may be securely attached to the strand jack cables via fixed strand anchor blocks, such that hoisting devices may avoid interference with locking devices or other parts of the structural assembly.

Exemplary embodiments may be readily disengaged from structural assemblies following raising, allowing hoisting devices to be lowered to the ground for reuse on the following assembly. Exemplary embodiments may have adequate weight to maintain sufficient tension on strands when lowering hoisting devices and strands to ground level.

In one embodiment of the invention, a temporary carrier beam solution is provided. Such a solution may allow for the raising of structural assemblies through the use of strand jacks whilst preventing any physical disconnection from being made in order to disconnect hoisting devices from assemblies. Embodiments of carrier beams may be easily positioned beneath the structural assembly, allowing the entire assembly to be lifted along with the carrier beams. Each embodiment of carrier beams may be connected to the cables of two strand jacks and may be located at the side of a core. Thus, the number of carrier beams necessary may be equivalent to at least two times the number of cores, and the number of strand jacks necessary may be equivalent to at least four times the number of cores.

Each structural assembly to be raised may be comprised of a plurality of structural members. Such structural members may include at least two primary beams and a plurality of secondary beams. Exemplary embodiments of the aforementioned temporary carrier beams may temporarily engage with the underside of the lower flanges of the two primary beams, allowing temporary support of the structural assembly by the carrier beams.

Temporary carrier beams engage with the primary beams such that the bottom surfaces of the primary beams' lower flanges rest directly on the top surfaces of the carrier beams. No positive connection is used as the carrier beam needs to drop away from the primary beam once the structural assembly is locked in its final position and the strand jacks are reversed to lower the carrier beam to the ground level.

Exemplary embodiments of the aforementioned carrier beams may contain adjustable clips bolted to their upper surfaces. Such adjustable clips may laterally constrain the position of the carrier beam with regard to its position beneath the structural assembly. Adjustable clips, as well as the aforementioned engagement with primary beams, may allow carrier beams to fully support structural assemblies, in a stable and balanced manner, whilst making no positive connection between carrier beams and structural assemblies. This lack of a positive connection may allow carrier beams to be freely lowered from the structural assembly upon reversal of strand jacks, following the engagement of the locking devices.

The adjustable clips may accurately position the temporary carrier beam beneath the assembly ensuring that strands are located correctly with respect to the anticipated load points and the strand openings in the structural assembly.

In another embodiment of the invention, a method for implementing and operating the aforementioned carrier beams is provided. The method may first include securely attaching two sets of strand jack cables to each carrier beam. Such attachment may be facilitated through the use of fixed strand anchor blocks located at the underside of carrier beams. In the proposed method the strand anchor blocks are attached to temporary carrier beams using bolted connections. Strands may be anchored into the anchor blocks by means of two-or-three-part anchor wedges that are forced into a tapered hole, as described in detail further above. This attachment of the carrier beams to strand jack cables may be maintained for the duration of construction.

In some embodiments wherein structural assemblies are excessively large or heavy, two strand jacks may be used to raise each end of a temporary carrier beam. This may necessitate the use of four strand jacks per carrier beam. In such embodiments, strands and anchorages of strand jacks may be located on each side of the carrier beams.

The method may further include positioning temporary carrier beams on temporary support pedestals located at the base of the building core. Temporary support pedestals may be of varying shapes and sizes, allowing the support of structural assemblies with differing primary member shapes and sizes. Temporary support pedestals may be located adjacent to the core walls and positioned such that the carrier beams may be aligned perpendicular to the primary beams. Exemplary embodiments of carrier beams may be located between a secondary beam and the core wall. Such a location may minimize the offset distance resulting from the load transfer between the carrier beams and the locking device. In many embodiments, two carrier beams may be used for supporting and raising structural assemblies for each core.

Temporary carrier beams may initially be placed on temporary pedestals in readiness to support the primary beams of a structural assembly. The carrier beam may be set at the required elevation by adjusting the temporary support pedestal height. Primary beams may be positioned above the carrier beams and the roof or floor framework can then be assembled around the core. As the framework is assembled, the elevation of each beam may be set with precision to introduce camber into the framework. This is necessary to counter the deflections that may occur once the framework is raised by the carrier beams and subsequent loads are added to complete the assembly. Camber may be calculated through structural analysis with the objective of having the assembly deflect to a near-level configuration when under full dead load conditions. Full dead load conditions may be achieved when all permanent material and equipment loads are applied to a structural assembly. This includes loads resulting from the hardenable substance such as concrete, that may be poured on top of the decking, and loads due to the façade system.

By locating the temporary carrier beam between the secondary beam and the building core wall, the position of the assembly load support on the carrier beam may be at the closest distance to the final support position, as provided by the locking device bracket to the assembly's primary beam. By minimizing this offset between carrier beam support position (during assembly and raising operations) and locking device support position (during permanent condition), the change in deflection may also be kept to a minimum.

The method may further include coupling at least one of a plurality of structural members with at least one other of a plurality of structural members to create a structural assembly. In some embodiments, this structure may be a roof assembly. In other embodiments, this structure may be a floor assembly. In some embodiments, one or more of the plurality of structural members may define at least one cavity through themselves. Another structural member or members may then be passed through these cavities and coupled together by a variety of methods such as welding or mechanical fastening. In these or other embodiments, some shorter structural members may be employed and coupled without cavities and pass-through type couplings. This construction of structural assemblies may occur above the placed carrier beams, such that the primary beams may be directly supported by carrier beams through engagement described further above. The aforementioned adjustable clips may serve as guides for precise positioning of the primary beams.

Following completion of the structural assembly, the method may further include the raising of said structural assembly through the use of temporary carrier beams and the synchronized operation of strand jacks. As described in detail further above, strand jacks may be located at the top of the building core(s) to raise the aforementioned structural roof and floor assemblies using hydraulic cylinders with sets of steel cables or strands. A detailed description of the operation of strand jacks is provided below.

The raising and lowering of structural assemblies and carrier beams may be accomplished by alternating between gripping and releasing strands while the strand jack's hydraulic cylinder expands and contracts. During the raising operation, an upper set of clamps grip the strands while a lower set of clamps release the strands allowing the strands to be raised during expansion of the hydraulic cylinder. At the limit of the cylinder's stroke, the lower set of clamps grip the strands while the upper set of clamps release the strands, allowing the strands to be raised again during contraction of the cylinder. These actions are reversed to allow a strand to be lowered. Once strand jacks are coupled with the top of the building core(s), the strands may then be coupled with the temporary carrier beams, and the strand jacks activated to raise the structural roof or floor assembly. When more than one strand jack is employed, automatic systems may assist in ensuring the roof or floor assembly is raised in a level manner.

It is worth noting that, in many embodiments, strand jack cables may have a life limited to approximately ten hoisting or jacking cycles. A jacking cycle may be defined as a sequence of jacking operations that include raising loaded strands followed by lowering of the unloaded strands. Such a limitation on the number of jacking cycles is due to the physical deformation effects the strand jack grips may have on the cables. In some embodiments, incidental damage may further limit the life of the aforementioned strand jack cables to less than ten jacking cycles. In other embodiments, the inspection and protection of strand jack cables may allow for a life of over ten jacking cycles.

Once the structural assembly reaches its final elevation, the method may further include securing the structural assembly to the core via the automated engagement of locking devices. As described in detail further above, locking devices may engage with embedded steel components in the building core via vertical rotation. Locking devices may allow for the full support of structural assemblies and support members.

The method may further include the reversal of the strand jacks to lower temporary carrier beams to ground level. In contrast to the current method of raising structural assemblies, carrier beams do not need to be physically disconnected from structural assemblies prior to their lowering. This is due to the lack of direct connection between structural assemblies and carrier beams. The method may finally include the repositioning of carrier beams on temporary support pedestals, as described above. This may allow for the construction of the succeeding structural frame.

There is no positive connection between the carrier beams and the structural assembly. Reversing the strand jacks, following engagement of the locking devices, will allow the carrier beams to freely drop away from the primary beams.

In proposed method strand anchor blocks are only disconnected from the carrier beams once all floors have been jacked into place. Bolted connections between the anchor blocks and the carrier beams are disconnected manually at the conclusion of all jacking operations.

Figure 11A:
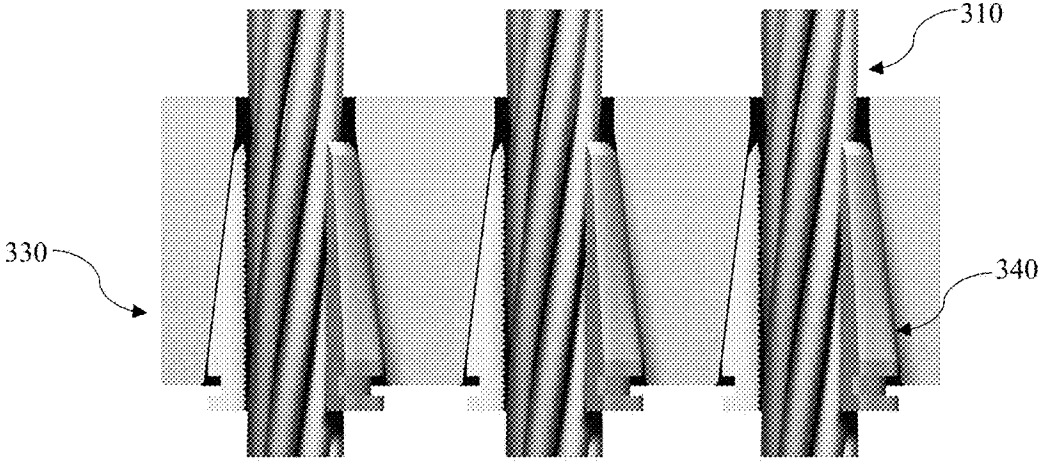
FIGS. 11A-11B are schematics illustrating the attachment of strand jack cables or hoisting strands to an anchor block below a temporary carrier beam, according to various exemplary embodiments.
Figure 11B:
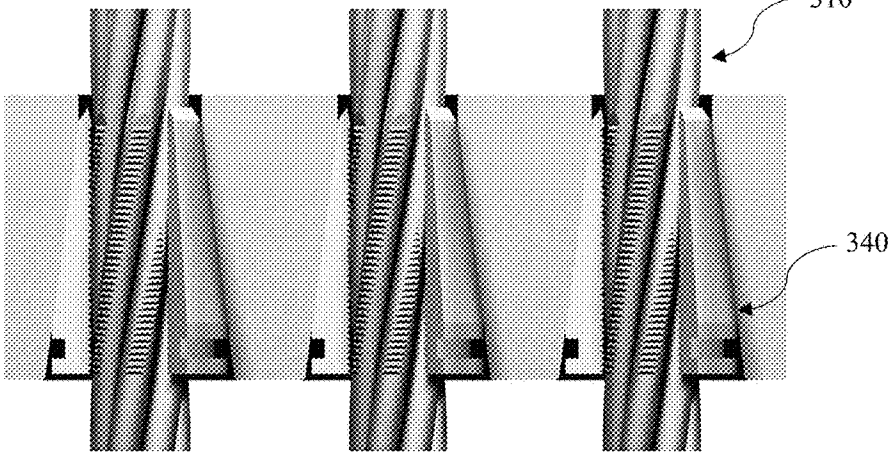

Turning now to FIG. 11A-11B, exemplary embodiments of fixed strand anchor blocks are shown. FIG. 11A illustrates the initial strand and wedge positions for a set of three strands. Each strand 310 is securely anchored into the anchor block 330 by means of two- or three-part anchor wedges 340 that are forced into a tapered hole. FIG. 11B illustrates the final strand and wedge positions. Exemplary embodiments of the steel wedges 340 have hardened teeth to grip the strands 310.

Figure 12:
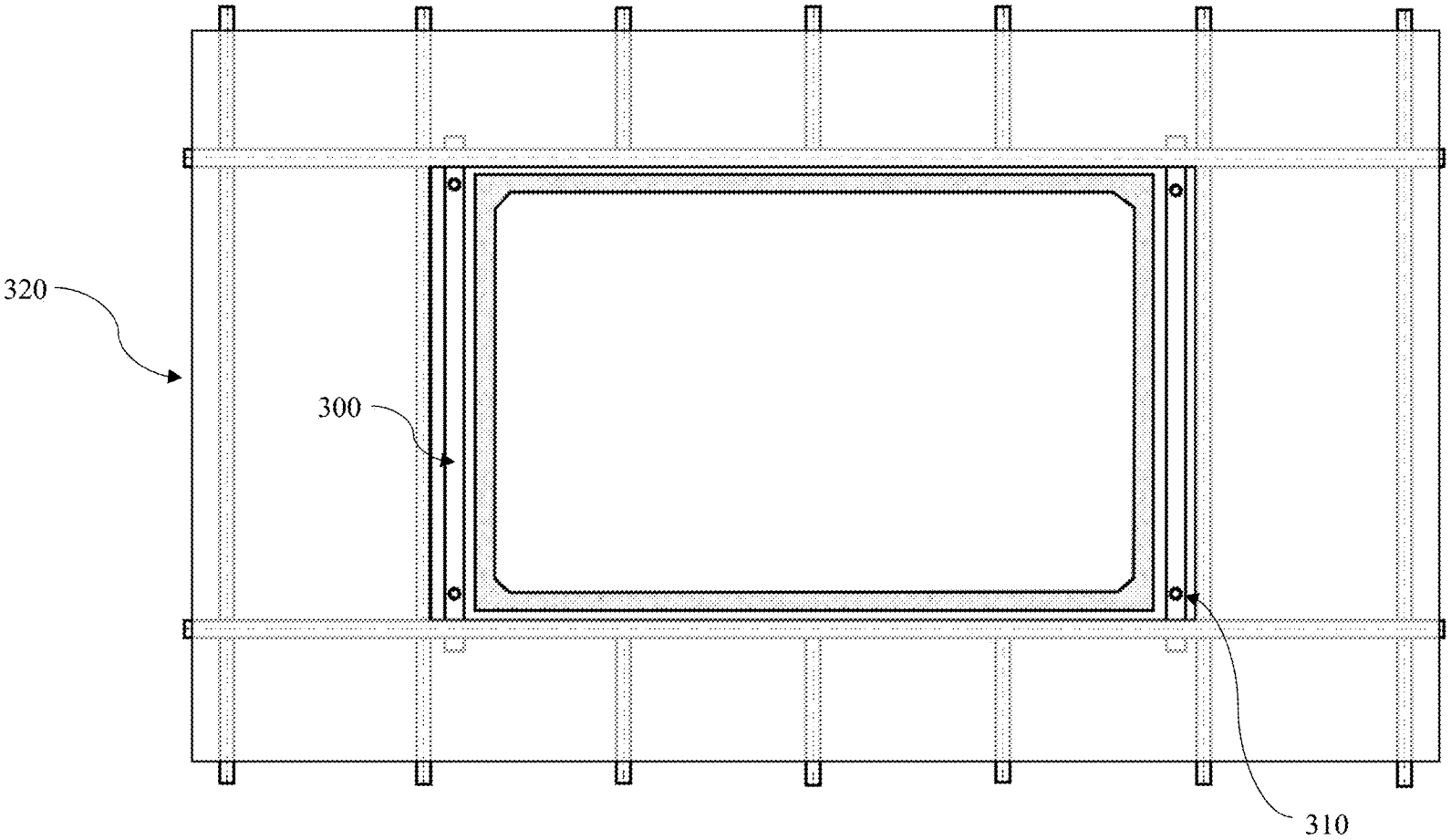
FIG. 12 is a schematic illustrating the plan view of temporary carrier beams raising a structural assembly into place around a building core, according to various exemplary embodiments.
Figure 13:
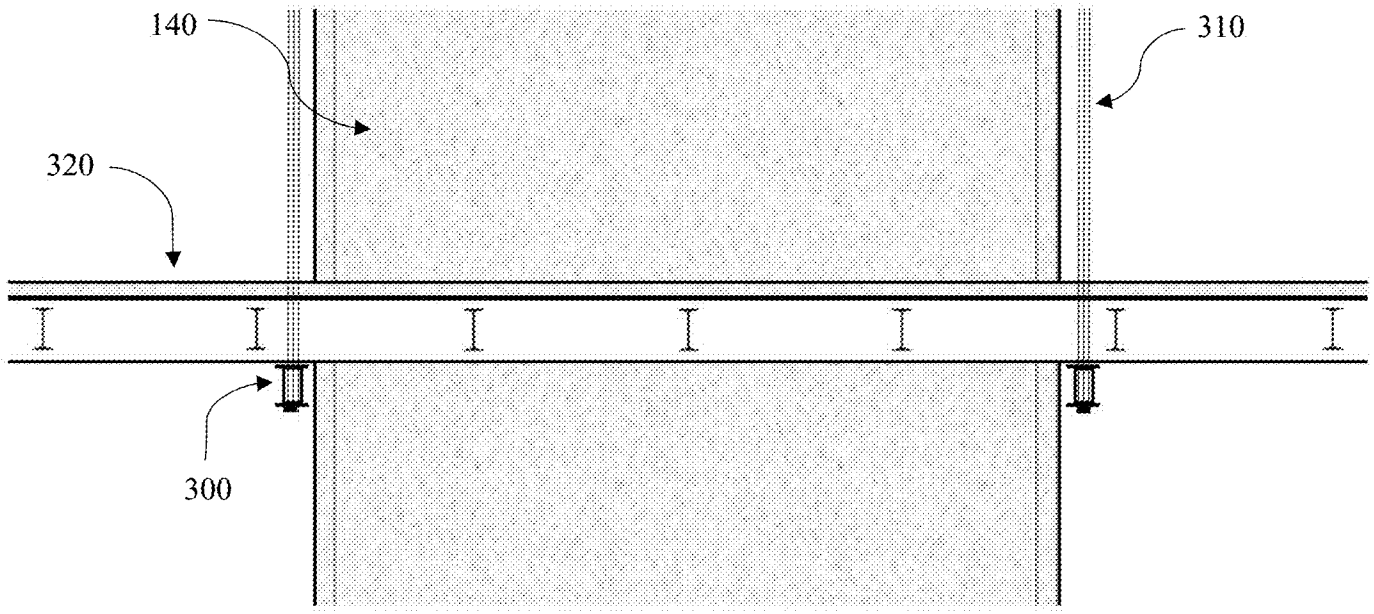
FIG. 13 is a schematic illustrating a section view of temporary carrier beams raising a structural assembly into place around a building core, according to various exemplary embodiments.

FIG. 12 is a schematic illustrating a plan view of the attachment of the carrier beam 300 to the structural assembly 320 using strand jack cables 310. FIG. 13 is a section view of this attachment, illustrating temporary carrier beams 300 raising structural assembly 320 up the building core wall 140 by means of strand jack cables 310.

Figure 14:
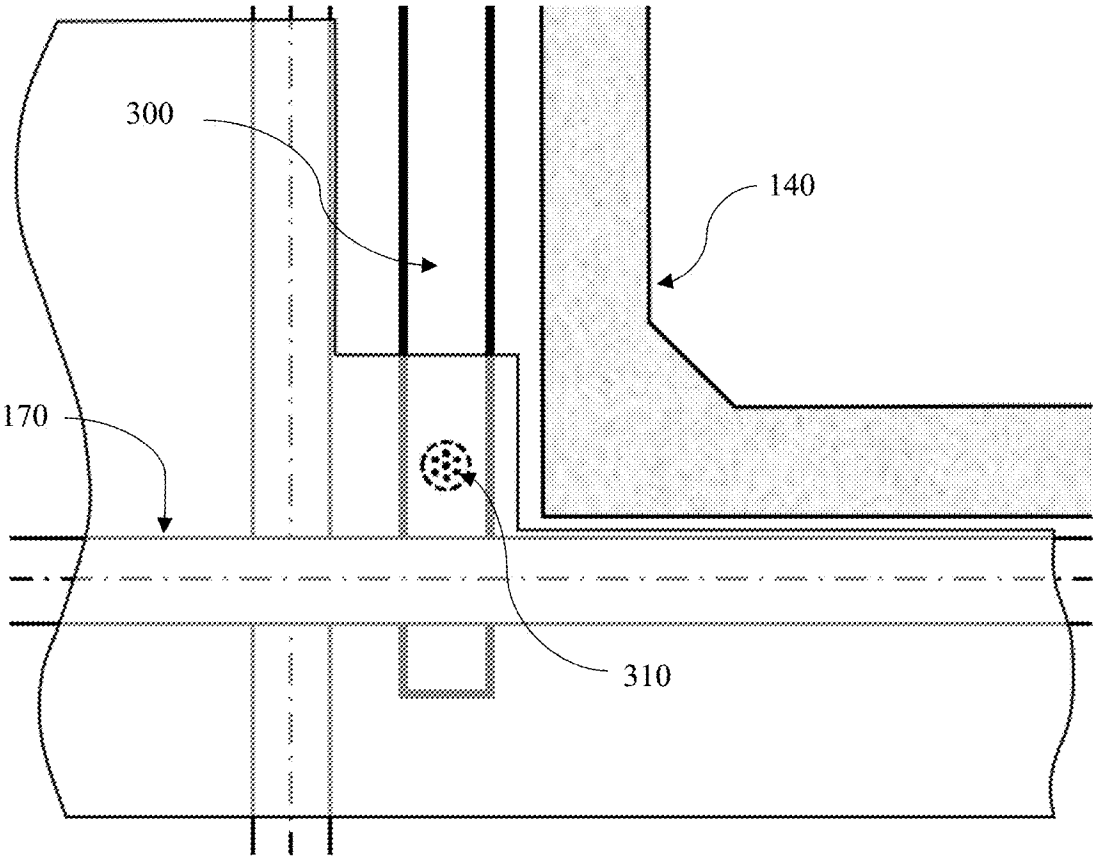
FIG. 14 is a schematic illustrating a plan view of a temporary carrier beam supporting or carrying a primary beam that is part of a larger structural assembly, according to various exemplary embodiments.
Figure 15B:
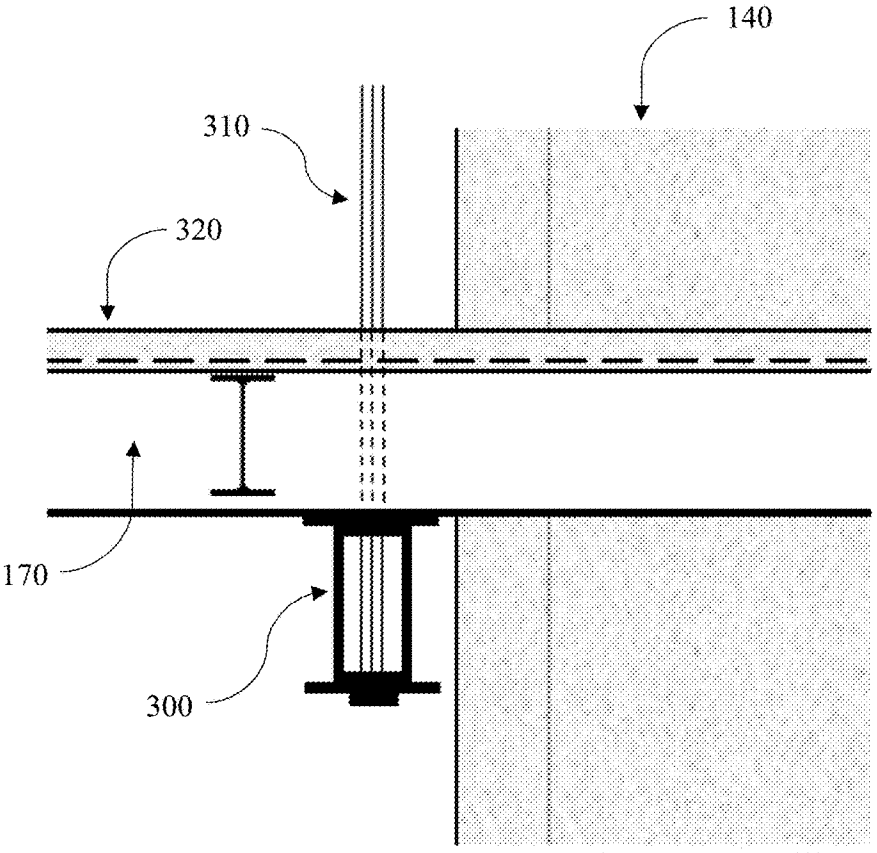
FIGS. 15A-15B are schematics illustrating elevation views of a temporary carrier beam coupled to strand jack cables or hoisting strands, through mechanical attachment of the strands to an anchor block, and supporting a structural assembly, according to various exemplary embodiments.
Figure 15A:
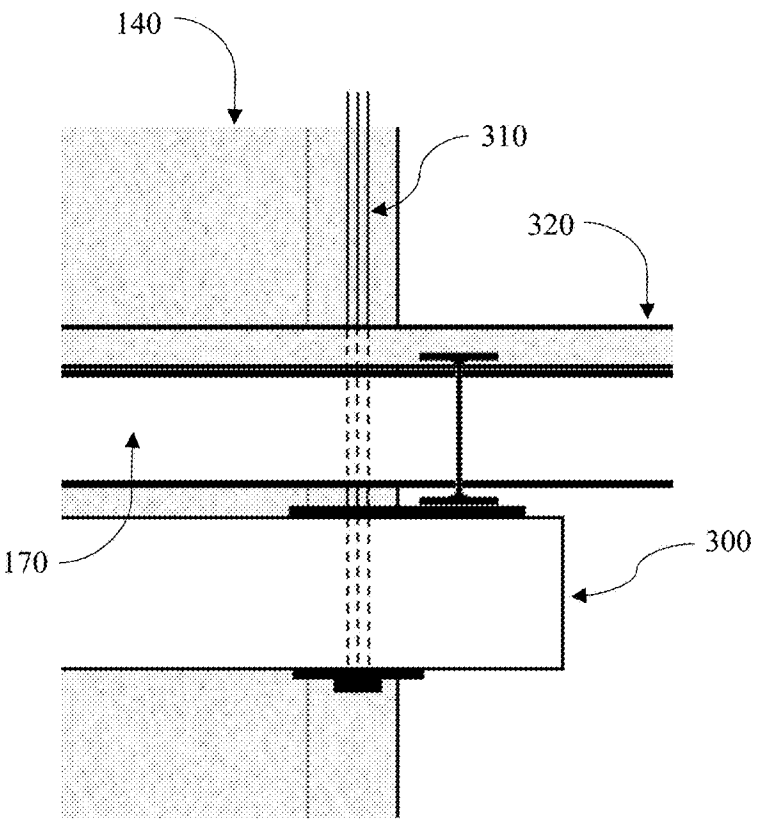

FIGS. 14-15B are schematics illustrating additional views of temporary carrier beam exemplary embodiments. FIG. 14 is a plan view wherein a carrier beam 300 is attached to primary beam 170 alongside a building core wall 140, using strand jack cables 310. FIGS. 15A-15B are elevation views of FIG. 14, wherein carrier beam 300 is again visibly attached to primary beam 170 supporting structural assembly 320 by means of strand jack cables 310. Structural assembly 320 is raised up the core wall 140 using carrier beam 300 and synchronized usage of strand jacks and cables 310.

IV. Facade Mounting and Stack Joint

A greater description and discussion of façade mounting and stack joint embodiments is provided below.

Construction of all buildings requires the use of external architectural cladding or façades. Such façades may exist in a variety of systems and materials, with the primary function being to isolate the interior building environment from exterior conditions including temperature, humidity, air movement due to wind, natural and artificial light levels, noise and airborne pollutants.

In some embodiments, for exemplary, façade materials may include wood, concrete, glass, stainless steel, aluminum sheet, aluminum composite panels, natural stone panels, terracotta, copper cladding, zinc cladding, fiber cement board cladding, high pressure laminate, and phenolic resin cladding may be used as an architectural method for enclosing buildings. In other embodiments, curtainwall and storefront-type facades may be used with exterior fixed shading louvers, rainscreens and double skin facades as methods for enclosing high-rise buildings.

In the construction of core-supported high-rise buildings, the building core acts as the primary vertical structural element supporting the entirety of the structure. In addition to the construction benefits of lessening construction time and decreasing construction costs, such a method may provide additional benefits to the completed building structure. For exemplary, the core-supported high-rise system may allow for additional floor space in buildings by eliminating perimeter columns and shear walls. Additionally, the core-supported high-rise construction system may allow for design features that may include a variety of non-load-bearing design features on the exterior of buildings. Examples of such external design features may be consisted of any of the façade examples described above.

In many embodiments of core-supported high-rise buildings, due to the support provided by the building core(s), curtain walls may be used to architecturally finish and enclose buildings. Curtain walls may be defined as thin exterior walls wherein wall framing is attached to the building structure and does not carry any floor or roof loads from the building. Due to their non-load-bearing nature, curtain walls may be constructed of lightweight materials, thereby significantly reducing loading on the structural assemblies, and the construction costs associated with the corresponding reduction in load-carrying capacity of the structural assemblies. For this reason, along with the increased variety of design possibilities, curtain walls may be an ideal solution for finishing core-supported high-rise buildings in many embodiments. In some embodiments, curtain walls may contain aluminum framing and in-fills of glass. In other embodiments, such in-fills may be comprised of solid panels of a variety of materials as described above.

In some embodiments, curtain walls may be fabricated and installed in pieces, with each piece of framing and in-fill panel installed and connected together piece by piece. In other embodiments, curtain walls may consist of unitized façade panels wherein they may consist of large, prefabricated units that may then be installed on the building. Due to the cost-reducing and time-saving benefits of the latter method, unitized façade panels may be ideal for enclosing core-supported high-rise buildings.

In one embodiment of the current conventional method for constructing high-rise buildings in which unitized façade panels are to be installed, such panels may be hoisted into position individually by crane. In another embodiment of the current conventional method, multiple unitized façade panels may be delivered to a project site in factory-loaded shipping frames or bunks, to be raised in a material hoist or construction elevator and positioned on floors that are adjacent to their final installed location. Subsequent placement of individual panels is performed using a small portable hoist or mini crane that operates from the floor above to set each panel into position.

Such individual placement of panels may be time-consuming and prolong construction. In some embodiments, this placement may be disrupted by conditions that affect hoist or crane operations. Examples of such conditions may include inclement or extremely cold weather and high wind speeds. Additionally, in many embodiments, the current method may require the final positioning and connecting of panels to the building structure to be performed at-height by construction personnel, following strict fall-protection measures. Such final positioning and connecting of the panels may be dependent on suitable weather conditions with low wind speeds, which may further prolong construction, in addition to generating additional safety concerns for the personnel working at height as well as those below who may be exposed to a potential for falling objects.

In an embodiment of the current method for constructing core-supported high-rise buildings in which unitized façade panels are to be installed, a floor framework may first be assembled on temporary support pedestals. Before the façade panels may be installed around the perimeter of the floor, the floor framework is raised from the temporary support pedestals and a hardenable material, such as concrete, is placed on the decking and allowed to cure. Facade panels may then be installed on the structural floor assembly, obviating the need for a crane to lift such facade components up to the floor after it is in its final elevated position.

The facade panels installed on the completed first floor assembly will provide the exterior wall between the roof and the first floor assembly (the top floor of the building).

In examples of this such embodiment, each façade panel must be aligned with the panels on the roof or floor above. Such alignment requires individual manual adjustment of façade panels by construction personnel prior to the final positioning and locking of the structural assembly. Such a process may be labor-intensive and prolong the construction process, as well as exposing construction personnel to possibly dangerous work at-height and inclement weather conditions.

Therefore, it may be advantageous to provide a solution wherein the complete façade may be installed in the safest possible manner while avoiding the labor-intensive and slow processes described above. Exemplary embodiments of such a solution may be independent of weather conditions. Exemplary embodiments of such a solution may include completing the entire façade installation at ground level, prior to raising each assembly. Further, exemplary embodiments of such a solution may allow the method to be performed independent of weather conditions involving high wind speeds. Further, exemplary embodiments of such a solution may require minimal work following the final positioning of the structural assembly, allowing the prevention of delays in construction, as well as promoting an improvement in safety conditions for construction personnel.

In an embodiment of the proposed method for constructing core-supported high-rise buildings in which unitized façade panels are to be installed, a floor framework may first be assembled on temporary support pedestals. As the framework is assembled, the elevation of each structural member or beam may be set with precision to introduce camber into the framework. This is necessary to counter the deflections that may occur once the framework is raised by the carrier beams and subsequent loads are added to complete the assembly. Camber may be calculated through structural analysis with the objective of having the assembly deflect to a near-level configuration when under full dead load conditions. Before the façade panels may be installed around the perimeter of the floor, the floor framework may be raised from the temporary support pedestals and a hardenable material such as concrete, is placed on the decking and allowed to cure once the framework has deflected to near level conditions. Facade panels may then be installed on the structural floor assembly, obviating the need for a crane to lift such facade components to the floor after it is in its final elevated position.

In one embodiment of the invention, a solution for installing unitized façade panels includes the use of self-aligning guides to complete the horizontal interface between upper and lower panels when installed on adjacent levels. Such a solution may consist of a curtain wall that is comprised of unitized façade panels with self-aligning guides connected to the horizontal facade framing. In some embodiments, façade panels may include framing with two extensions that facilitate the creation of flexible, but weathertight façade seals, and one extension that serves as an alignment guide. The first of the extensions may consist of rigid linear extensions of the upper horizontal framing that may extend vertically upwards from the interior side of the panel. The second of these extensions may consist of rigid linear extensions of the lower horizontal framing that may extend vertically downwards from the exterior side of the panel. The third of these extensions may serve as a façade guide and consist of rigid linear extensions of the lower horizontal framing that may extend obliquely downwards from the interior side of the panel.

In exemplary embodiments, such a solution may include the engagement of the upper frame extensions from one first assembly with the lower frame extensions from another second assembly, forced into place by oblique façade guides. The second assembly may be already locked into place and located directly above the first. In exemplary embodiments, such a solution may include the automatic coupling of façade panels with those above, through the aforementioned engagement. This coupled interface between vertically stacked façade panels is henceforth known as and referred to as a stack joint and may be closed to create a weathertight seal during the raising of the lower floor assembly. Exemplary embodiments of such a stack joint may allow for accommodation of full overjack of the assembly.

In some embodiments of the solution, firestopping may be installed between the edge of the assembly slab and the façade framing. Such installation may be performed at ground level. In some embodiments, such firestopping may consist of multiple layers of gypsum board. In other embodiments, such firestopping may consist of mineral wool or other fireproof materials.

Typically, the façade panels are mounted outside of the outer edge of the structural assembly, leaving a gap between the façade panel and the edge of the assembly. This space must be closed against fire and smoke spread to ensure that the structure meets fire codes. Firestopping may be a flexible fire-resistant material that is compressed when installed such that it is held in place by friction between the firestop material and the façade framing and outer edge of the structural assembly.

In the current method, firestopping is installed at height, requiring materials and tools to be taken up to the roof or floor level. In the proposed method the firestopping will be installed while the structural assembly is near ground level, prior to the jacking operation. The earlier installation of the firestopping (before the assembly is locked into its final position) will minimize risks in the event of a fire during construction by creating an effective flame and smoke barrier prior to adjacent levels being occupied by construction personnel.

In another embodiment of the invention, a method for implementing and utilizing the aforementioned façade panels and self-aligning guides is provided. The method may first include securing support brackets known henceforth as façade support brackets to the perimeter of the fully assembled structural assembly. Such installation may be performed at ground level. Following installation, façade support brackets may be checked for consistent elevation.

Façade support brackets are required for attachment of most curtainwall or panelized façade systems that are mounted on the outside of the building framing. This form of attachment allows the façade to behave as a continuous weathertight cladding system without any interruptions by floor slabs. The façade support brackets typically allow for some movement or deflection of the structure; however, this is limited to ensure that the façade's weathertight seals remain effective during this movement. This is achieved through use of brackets that accommodate three-way adjustment of the unitized façade panels.

In conventional high-rise construction, the façade support brackets are installed at height, requiring materials and tools to be taken up to the roof or floor level. All adjustments of the brackets typically occur at height prior to the façade panels being hoisted into place and landed onto the façade support brackets. Weather conditions must be suitable for this activity (low wind speeds and no rain or snow) and due to exposure of construction personnel to potential fall conditions, harnesses and lifelines must be employed.

In both the current method and the proposed method for construction of core-supported high-rise buildings, where cores are constructed first and the roof and floors are then jacked into place, the façade support brackets will be installed while the structural assembly is near ground level, prior to the jacking operation. As the façade panels will also be installed before jacking commences, most of the adjustments will occur at ground level and therefore will be readily accomplished under almost any weather conditions from the ground or stable, low-level work platforms.

All façade support brackets for the entire floor must be installed at a consistent level. This will minimize the amount of adjustment necessary to achieve uniformly level and flush conditions for the façade system. Façade support brackets will be connected directly to the structural assembly using bolts or anchors that may be fastened to structural framing or embedded into a concrete roof or floor slab.

The method may further include the mounting of unitized façade panels upon the support brackets, thus securely coupling them to the structural assembly. Following the installation of panels, they may be plumbed to vertical through the use of temporary facade braces. Such temporary facade braces may be installed to connect the top of the panel with the floor, thus verifying that panels may be completely vertical.

Unitized façade panels may be mounted onto the façade support brackets using standard three-way adjustable anchor saddles and jack bolts. These adjustable features allow for final alignment and leveling of the façade panels. Facade level adjustment involves use of standard equipment, which may include rotating laser levels, optical levels or simple construction levels, to check panel elevations.

In the current conventional construction method for high-rise buildings, these adjustments are made at height during installation of each façade panel, requiring construction personnel to be secured by fall protection devices.

In the proposed construction method, facade adjustments may also be made during installation of each panel; however, the panels may be installed at ground level where working conditions are safe and more easily controlled.

Façade support brackets are permanent components connecting the façade panels to the structural assemblies. Temporary facade braces may be used to keep the façade panels in a vertical orientation during raising of the structural assembly. Once the assembly has been locked into its final location and the façade stack joint has been closed, the temporary facade braces may be removed.

The method may further include raising the structural assembly, with the façade in place, to its final elevated position. In many embodiments, such raising may be achieved through the use of carrier beams and the synchronized operation of strand jacks, as described in detail further above. The raising of the assembly may result in the creation of a secure, weathertight enclosure via the aforementioned façade panels. In some embodiments, such an enclosed platform may eliminate many safety hazards that may be associated with performing work at-height. In some embodiments, additionally, such an enclosed platform may eliminate many safety and construction hazards that may be associated with performing work in ambient weather conditions, allowing many elements of the construction process to be performed independent of weather circumstances.

As the structural assembly approaches its final elevated position, the method may further include the engagement of the façade system. In many embodiments, such engagement may be facilitated by rigid linear frame extensions extending vertically from the upper and lower frames of the façade panels, as well as oblique linear extensions below the panel known as façade guides. Exemplary embodiments of extensions are described in further detail above. In many embodiments of the aforementioned façade engagement, the upper frame extension of a first, lower façade panel may be forced into place with the lower frame extension of a second, higher façade panel, which may already be fixed in position with the associated structural assembly being locked in place. The lower façade panel may be forced into place by the façade guide located at the bottom of the second façade panel. The upper frame extension may then form a horizontal interface, or stack joint, with the lower frame extension whereby all seals and gaskets between two façade panels on adjacent levels may be closed automatically, following overjack of the structural assembly and engagement of the locking devices.

Façade panels generally have seals and gaskets installed on all edges. As panels are moved together, either vertically or horizontally, the joints containing the seals and gaskets may be closed to create weathertight joints.

In the current conventional method, facade joints are all closed manually at height during installation of each façade panel, requiring construction personnel to be secured by fall protection devices. This manual closure of the joints requires careful positioning of each façade panel by portable hoist or mini crane such that seals and gaskets can be engaged.

In the proposed method, Vertical façade joints may be closed during installation of adjacent panels at ground level. Horizontal facade joints may all be closed automatically when the structural assemblies are locked into their final positions. This may be achieved through utilization of self-aligning framing extensions. As an assembly approaches its final position, a rigid linear extension of the lower edge of the façade frame or façade guide that is mounted on the assembly above, may guide into place a corresponding linear extension of the upper edge of the façade frame that is mounted on the assembly being raised. During overjack and final locking operations, the horizontal façade joints or stack joints may be automatically closed to create a permanently weathertight building envelope.

The method may further include the removal of temporary façade braces. In some embodiments, horizontal closure strips may be installed at the interior of the stack joint between the upper and lower façade frame extensions following the removal of facade braces. Such stack joint closure strips may allow for concealment of the façade guide, thus providing an aesthetically acceptable cover at the interior of the stack joint. The stack joint closure strips may be fabricated from anodized aluminum to match the color and finish of the façade framing.

The method may finally include returning temporary facade braces to ground level for reuse on the succeeding structural assembly. In some embodiments, this may be accomplished through use of material hoists or operational freight elevators.

Figure 16:
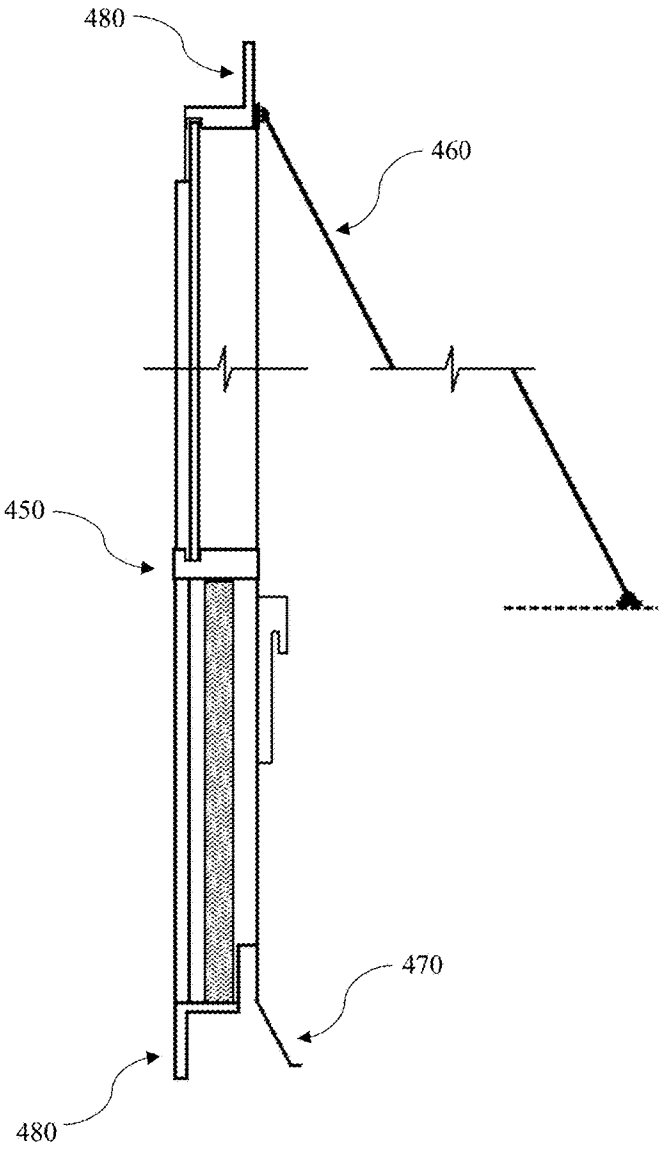
FIG. 16 is a schematic illustrating a façade panel independent of a structural assembly, according to various exemplary embodiments.

Turning now to FIG. 16, a side view illustration of a façade panel exemplary embodiment is shown. As shown, the façade panel 450 may be supported by a temporary façade brace 460, which may be extended further and attached to the structural assembly. The façade panel 450 may further include an upper linear frame extension 480 and a lower linear frame extension 490, which may form a stack joint during the engagement of the façade system. The façade panel 450 may also include an oblique façade guide 470, which may serve as a guide during the aforementioned engagement of the façade system.

Figure 17:
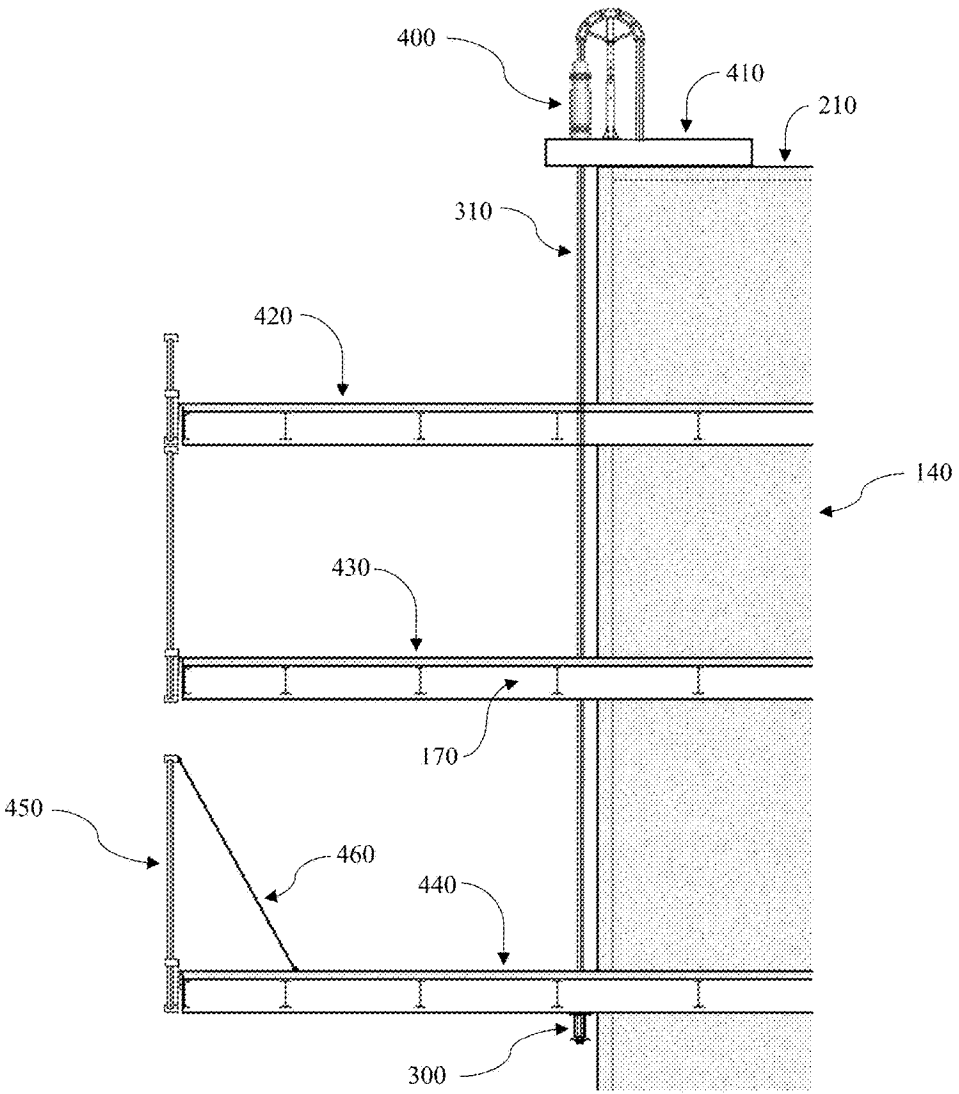
FIG. 17 is a schematic illustrating the section view through a building and facade panels, according to various exemplary embodiments.

FIG. 17 is a side view illustration of a structural assembly being raised with façade panels in place. Such raising may be achieved through the use of strand jacks 400 mounted upon jacking beams 410 at the core cap 210. Exemplary embodiments of such a core cap may be located at the top of building core walls 140, above the roof assembly 420. Strand jack cables 310 may pass through openings in structural assemblies and between primary beams 170 to connect to temporary carrier beams 300, located at the underside of the floor assembly to be raised 440. As shown, temporary façade braces 460 are coupled to a floor assembly 440 and are used to support façade panels 450. As the floor assembly is raised, it may be locked into place with its associated façade panels being coupled with the façade panels located on the roof or floor assembly 430 above.

Figure 18:
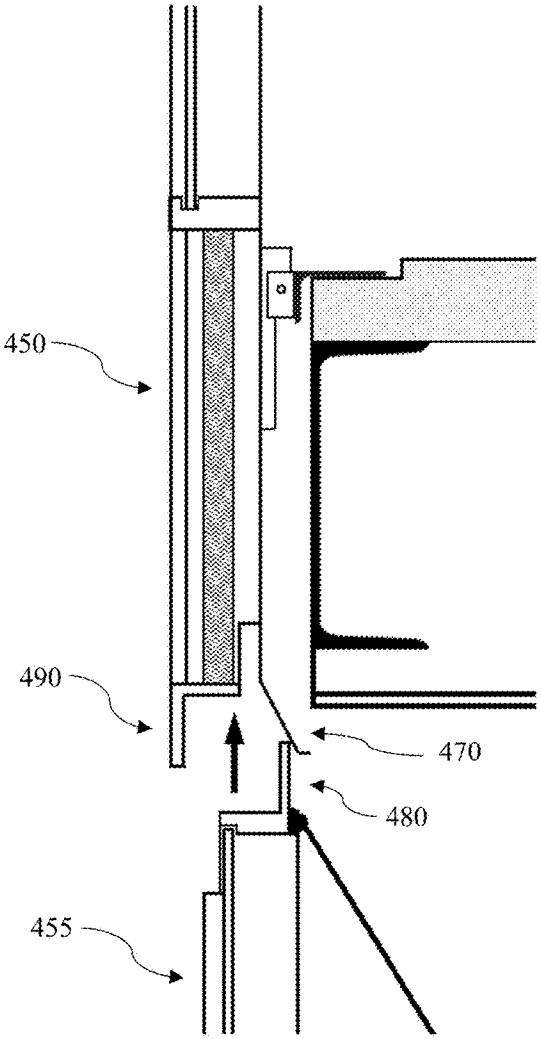
FIG. 18 is a schematic illustrating façade engagement with a self-aligning, linear guide, according to various exemplary embodiments.

FIG. 18 is a side view illustration of the engagement of the façade system. As the structural assembly is raised, the upper frame extension 480 of lower façade panel 455 may be forced into place with the lower frame extension 490 of upper façade panel 450. As shown, the façade guide 470 may serve as a guide for facilitating such engagement. The upper frame extension 480 may then form a stack joint with the lower frame extension 490.

Figure 19:
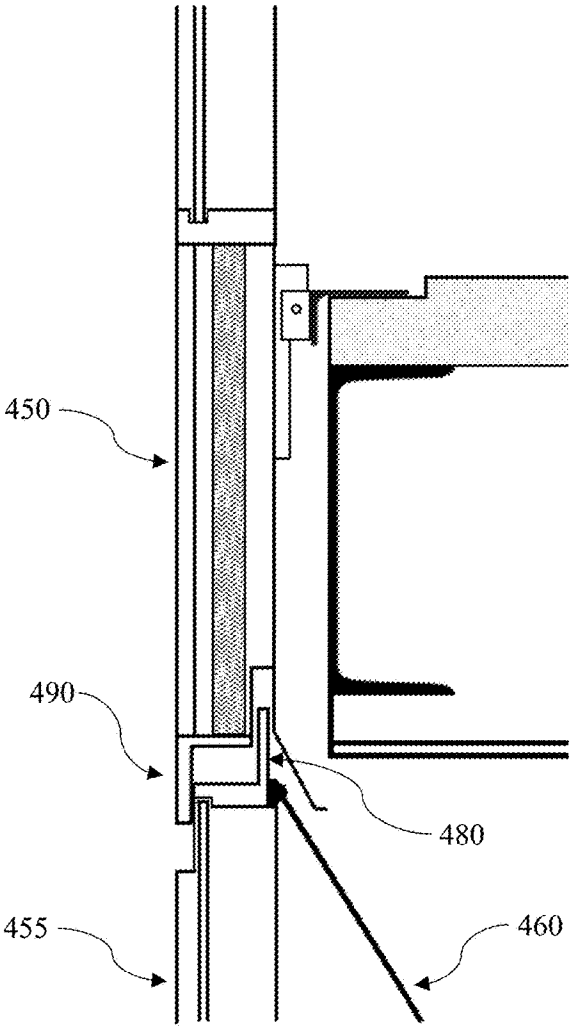
FIG. 19 is a schematic illustrating the final position of a façade panel, once a structural assembly has been locked into place, according to various exemplary embodiments.

FIG. 19 is a side view illustration of the final, locked and engaged positioning of the façade system following full overjack of the floor assembly and subsequent engagement of locking devices. As shown, the stack joint between the upper frame extension 480 of the lower façade panel 455 and the lower frame extension 490 of the upper façade panel 450 is closed and secured. Temporary façade braces 460 may no longer be necessary and may be returned to ground level for reuse on successive floor assemblies.

V. Deflection Control Tie

A greater description and discussion of deflection control tie exemplary embodiments is provided below.

One of the benefits of core-supported high-rise buildings, as stated above, is the opportunity for flexibility in design features and the use of various materials as part of the exterior façade of the building. Because all structural support is provided by the building core(s), the structural members of the roof and floor assemblies are said to cantilever from the core(s), and the structural members are known as cantilevers. Once placed under load conditions, these cantilevers are subject to shear and bending forces, and will deflect, or displace vertically under the weight of loads such as building occupants, furniture, equipment and self weight. This deflection is due to and dependent on the number of occupants, and the amount and weight of furniture, and equipment. Because structural members are cantilevered and only supported at the building core(s), there is no secondary support at the free end of the cantilever to help reduce the magnitude of this deflection. The amount of allowable deflection is governed by deflection tolerances whereby deformation of secondary components, such as façade systems or building finishes that are attached to the structure, do not result in damage or distortions that are aesthetically unacceptable. Acceptable deflections of a building structure may also be limited whereby the effect of dynamic forces, such as the movement of occupants walking across a floor, do not cause vibrations to become noticeable.

Deflection of structural members may be calculated based on material properties, moment of inertia of a member's cross-section, force applied, and distance from support. As stated above, deflection is governed by deflection limits. Such deflection limits are defined as maximum amounts of allowable deflection that may exist such that buildings and assemblies are still structurally sound, and free from excessive vibrational movement or damage due to distortion of façade or wall components. In many embodiments, deflection limits may be set according to building codes, and are dependent on type, use, and material of member. For exemplary, in some embodiments, structural members may have a deflection limits prescribed to prevent damage of non-structural materials or systems that are being supported by the structural members. A deflection limit of L/360 (length of the member divided by 360) may be applied to brittle, non-flexible finishes, while a deflection limit of L/240 (length of the member divided by 240) may be applied to less rigid, flexible finishes. Deflection should be kept at a minimum, as excessive deflection may result in damage to facades, finishes and other non-structural components that are connected to the deflecting assemblies.

The magnitudes of vertical deflection of horizontal structural members in core-supported high-rise buildings are dependent on several parameters. Vertical deflection is directly proportional to member length, member stiffness, and the magnitude of applied vertical forces. Member stiffness is dependent on its moment of inertia and modulus of elasticity. In many embodiments, length/span of horizontal members may directly affect deflection magnitude. This is because shorter members may experience smaller bending moments. Thus, in many embodiments, deflection magnitude may be reduced by decreasing the lengths of horizontal members, or structural assemblies. Thus, decreasing the length of such horizontal members means decreasing the length of roof and floor assemblies, which may decrease usable floor and roof space in the completed building.

In addition to member length, member stiffness may be a large factor of deflection, as increased stiffness inversely correlates with deflection magnitude. Thus, increasing member stiffness will decrease deflection. In some embodiments, stiffness may be increased by altering the geometry of members, as different shaped assemblies may have different moments of inertia which are proportional to the stiffness. For exemplary, wide flange beams of greater depth may have a greater moments of inertia than shallower beams. Therefore, altering the geometry of primary support beams may increase moment of inertia and stiffness, thus reducing deflection magnitude. Increased stiffness results in increased resistance to bending and decreased deflection. Increased stiffness of members may be accomplished by increasing depth of the members. Thus, in many embodiments, deflection may be reduced by increasing depths of horizontal members, or primary beams. However, increasing the depths of such members may result in heavier and more costly members. Additionally, increasing depths may result in increased building height, which may procure additional construction expenses and may even result in a decreased number of occupiable floors. Similarly, modifying a beam's material composition such that it's modulus of elasticity is increased may reduce deflection magnitude. Such modification of material composition may involve use of higher strength materials. However, modifying the shape or material composition of beams may procure additional expenses, and may significantly increase costs of construction, particularly in embodiments of large buildings.

Furthermore, deflection of cantilevered members may be directly proportional to the magnitude of loads applied to structural assemblies. As deflection is caused primarily by loading applied upon the structural members, heavier loads placed upon such members will result in increased deflection, and lighter loads will result in decreased deflection. Thus, in some embodiments, deflection may be decreased by lightening loads placed upon structural members. However, many embodiments may require the use of heavy equipment, especially in buildings that may be used as hospitals or laboratory facilities. Additionally, loading of occupied buildings may be consistently changing as new equipment and occupants are added to completed buildings. Thus, for both of the aforementioned reasons, it may not be wise or feasible for deflection limits to be overly dependent on initial loading conditions of structural assemblies.

Along with the aforementioned primary factors of deflection, secondary parameters such as material composition of structural components and composite behavior of structural assemblies, may have an effect on deflection. Because differing materials will have differing levels of stiffness, material of structural members may be a factor affecting deflection. For exemplary, embodiments in which high-strength steel is used in construction of primary and secondary beams, and concrete with fiber-reinforcement is used in the slab construction of structural assemblies, may result in stiffer horizontal structural assemblies. In contrast, embodiments in which lower-strength steel is used in construction of primary beams, and regular wire-mesh reinforced concrete is used in the slab construction of structural assemblies, may result in less stiff horizontal structural assemblies. Thus, in some embodiments, deflection may be reduced by modifying the material used to construct primary beams or structural assemblies. However, altering material of members or assemblies may procure additional expenses and significantly increase costs of construction, especially in embodiments of large buildings. Thus, it may be beneficial to limit deflection resulting from applied vertical loads.

Therefore, due to the aforementioned negative effects of limiting deflection, it may be advantageous to provide a solution wherein deflection may be limited without the negative effects of decreasing floor space through the reduction of member lengths, or substantially increasing construction expenses through modification of member geometry, increase in member depth or enhancement of material composition. Exemplary embodiments of such a method for limiting deflection may not force the decreasing of member lengths, for the reasoning provided above. Exemplary embodiments may not force the altering of beam geometry, for the reasoning provided above. Exemplary embodiments may not force the increasing of member depth, for the reasoning provided above. Exemplary embodiments may not rely solely on decreasing member loading, for the reasoning described above. Exemplary embodiments may not rely solely on increase in material strength of structural members, for the reasoning described above.

In one embodiment of the invention, a deflection control tie apparatus is provided. In many embodiments, deflection control ties may be vertical members installed above select structural roof and floor assemblies. Deflection control ties may have a length equivalent to the vertical distance between two adjacent structural assemblies. Exemplary embodiments of such vertical members may link two or more adjacent structural assemblies together. This may allow vertical loads to be shared between cantilevered members of multiple assemblies. Such sharing of loads is possible due to differing loads on different assemblies.

The number of structural assemblies that may be linked by deflection control ties is not limited. The need for deflection control ties may be governed by the results of structural analyses of adjacent assemblies under varying load conditions. Use of deflection control ties may be appropriate where any assembly deflections, as predicted for adjacent floor assemblies, may exceed the tolerance limitation of the façade stack joint.

Deflection control ties may be deployed to transfer vertical loads between vertically adjacent assemblies. These deflection control ties are structural members that may act as vertical posts or ties, and must be fabricated to withstand both axial compression and tension forces. Deflection control ties may be fabricated from structural steel, aluminum, or composite materials. Ideal structural sections may be square, rectangular or circular cross-sections. These tubular sections provide optimum resistance to buckling failure under compressive loading.

For exemplary, without deflection control ties, a first assembly with an extremely heavy load may deflect a great amount, which may be over the allowable deflection governed by deflection limits. In contrast, a second assembly with no loading may not deflect at all. In this instance, the deflection of the first assembly must be controlled by traditional deflection controlling solutions, problems with which are described in detail above. In contrast, if deflection control ties are implemented, a first assembly with an extremely heavy load may transfer half of its load to a second assembly with no loading, thus generating a small, allowable amount of deflection on both assemblies and eliminating differential deflections.

In some embodiments, deflection control ties may at least partially define a cavity. Such a cavity may be defined at the top of the deflection control tie for a first, lower assembly. In other embodiments, deflection control ties may contain tapered extensions known as and referred to henceforth as tapered conical guides. Such tapered conical guides may be located at the underside of the structural assembly for a second, higher assembly. In some embodiments wherein deflection control ties may link three or more assemblies together, the intermediate assemblies (those assemblies that may not be the uppermost or lowermost assemblies) may contain both the deflection control tie with the defined cavity on the top, and the tapered conical guide on the underside of the assembly.

In many embodiments, the aforementioned cavities and tapered conical guides may serve as means of engagement of the deflection control tie system. Thus, the defined cavities may have a length, width, and depth equivalent to the length, width, and depth of the tapered conical guides. This may further facilitate proper engagement of the two embodiments.

In another embodiment of the invention, a method for installing and utilizing deflection control ties is provided. The method may first include installing deflection control ties above the free end of select cantilevered members. Select cantilevered members may be primary or secondary members associated with the structural framing of those intermediate and lowermost assemblies for which deflection control ties may be used. Such installation of deflection control ties may be installed at ground level during construction of the structural assemblies. In embodiments wherein members are the uppermost or intermediate assemblies to be connected with deflection control ties, the method may include installing tapered conical guides at the underside of structural assemblies at locations that approximately align with the final locations of the deflection control ties.

Deflection control ties may be most effective when they are structurally connected directly to the free ends of those cantilevered members that exhibit excessive deflections when under load. The lower end of each deflection control tie may be bolted or welded to the top flange of the cantilevered beam member.

Tapered conical guides may also be installed on the underside of the structural framing during assembly at ground level.

A tapered conical guide may be structurally connected directly to the bottom flange of the cantilevered beam members. These connections will be bolted, welded, or use other standard structural connecting devices and systems.

The method may further include securing structurally the aforementioned deflection control ties to provide sufficient support for load transfer and deflection control. Additionally, the method may include plumbing the deflection control ties to vertical to assure a successfully aligned system. Each deflection control tie may be checked for alignment and elevation prior to the installation of unitized façade panels, which is explained in detail further below.

Deflection control ties may be aligned and plumbed concurrently with the façade panels. Where a bolted connection to the top flange of the cantilever beam member is used, adjustment of its horizontal position will be accomplished through use of slotted holes in the deflection control tie's base plate. The deflection control tie will be plumbed to vertical through use of steel shim plates inserted under its base plate. The base plate may then be permanently secured through final tightening of bolts, or welding.

The method may further include the raising of the structural assemblies with deflection control ties in place. Such raising may be achieved through the use of carrier beams and the synchronized operation of strand jacks, as described in detail further above. As the structural assembly reaches its final elevated position, the method may further include the engagement of the deflection control tie's self-aligning guides. Such self-aligning guides may be defined as the tapered conical guides and defined cavities. The aforementioned engagement may be facilitated by such embodiments. In many embodiments, the engagement may consist of the insertion of the tapered conical guides located on the underside of the second, higher assembly into the defined cavities located at the top of the deflection control ties of the first, lower assembly. Such a connection may be automatically closed during overjack and final engagement of the locking devices, which is described in detail further above.

The method may finally include the examination and confirmation of the engagement of the deflection control ties. Such examination may be performed by construction personnel once access to the raised assembly is possible. The method may finally include fixing the connection into place to allow for the full transfer of loads between adjacent assemblies.

The upper end of the deflection control tie may be fixed in place through installation of structural fasteners that rigidly connect the deflection control tie to the tapered conical guide. This permanent, fixed connection may structurally link the adjacent assemblies together, eliminating any differential deflection that would be experienced by the assemblies if they were not connected by the deflection control ties.

Figure 20:
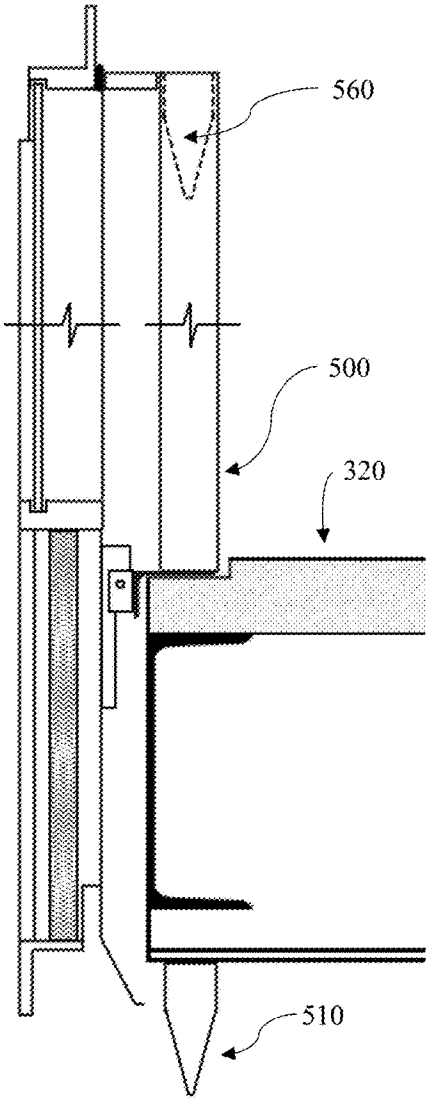
FIG. 20 is a schematic illustrating a façade panel and deflection control tie connected to a structural assembly, according to various exemplary embodiments.

Turning now to FIG. 20, a side view illustration of a deflection control tie exemplary embodiment is shown. The deflection control tie 500 is a vertical structural member located above a structural floor assembly 320. In this instance, the structural assembly exemplary embodiment is serving as an intermediate structural assembly, as it is in the middle of a deflection control tie system that may be connecting three or more assemblies together. The deflection control tie 500 may at least partially define a cavity 560 which may be used to facilitate engagement of the system. The tapered conical guide 510 is located at the underside of the structural assembly 320, which may further aid in facilitating engagement of the system.

Figure 21:
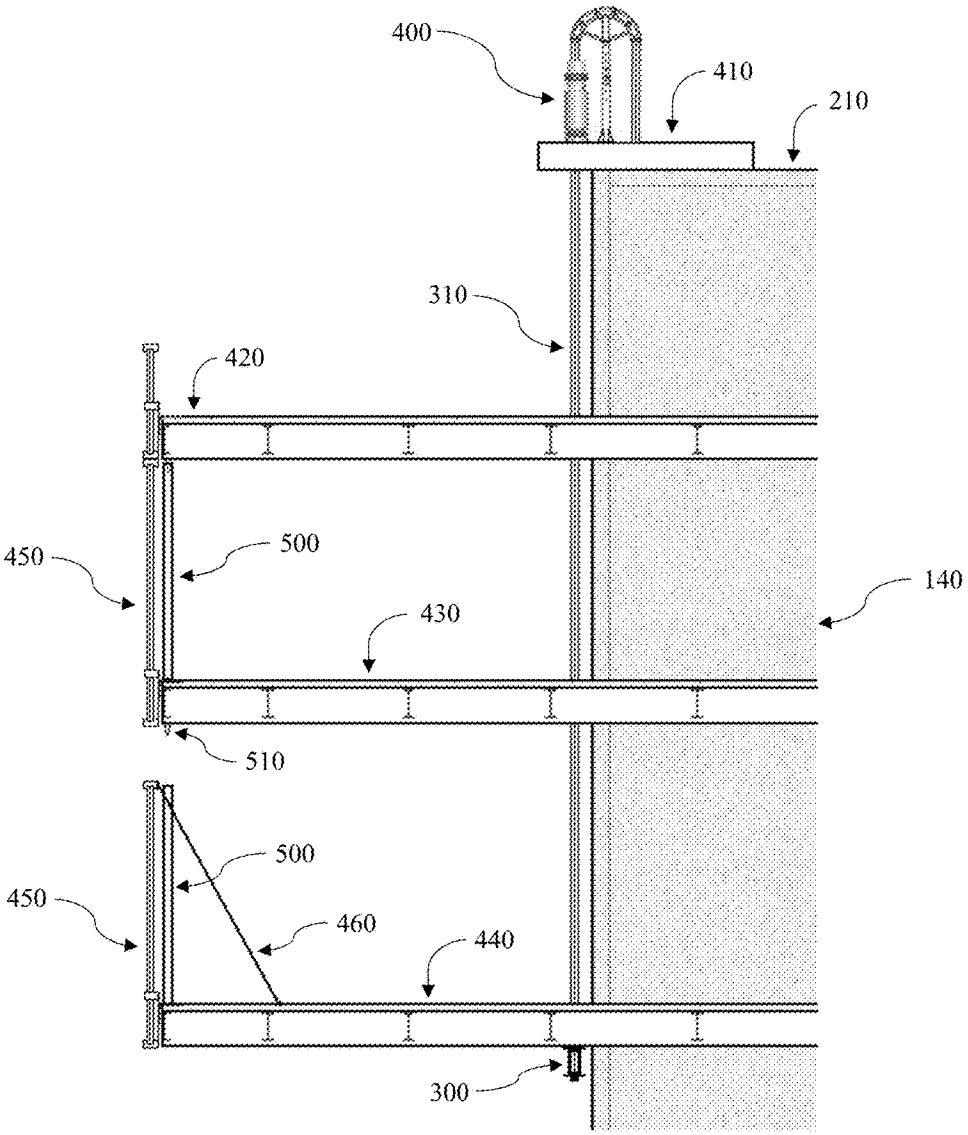
FIG. 21 is a schematic illustrating the section view through a building with façade panels and deflection control ties in place, according to various exemplary embodiments.

FIG. 21 shows a section view illustration of the deflection control tie system in place as an assembly is raised. In many embodiments, assembly raising may be achieved through the use of strand jacks 400 that are mounted upon jacking beams 410 at the core cap 210. Exemplary embodiments of such a core cap may be located at the top of core walls 140, above the roof slab 420. Strand jack cables 310 may pass through openings in structural assemblies and between primary beams to connect to temporary carrier beams 300, located at the underside of the floor slab to be raised 440. As shown, deflection control ties 500 are located directly to the interior side of façade panels 450 on intermediate assembly 430 and lower assembly 440. A tapered conical guide 510 is located at the underside of the intermediate structural assembly 430.

Figure 22:
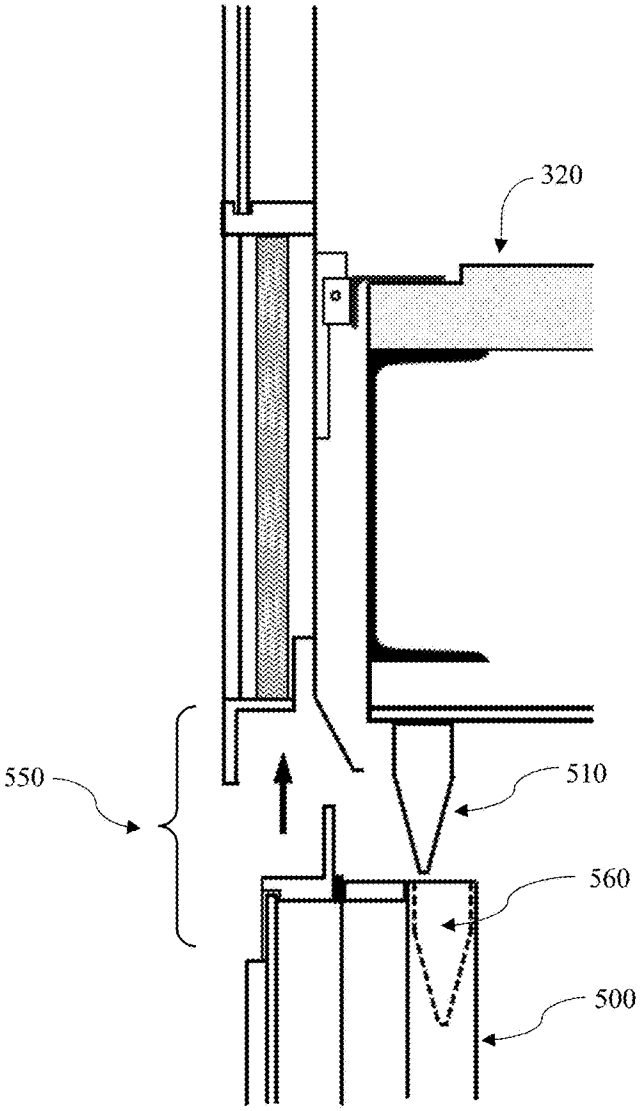
FIG. 22 is a schematic illustrating deflection control tie engagement with a self-aligning tie guide, according to various exemplary embodiments.

FIG. 22 is a side view illustration of the engagement of the deflection control tie system. As shown, the tapered conical guide 510 is inserted into the defined cavity 560 within the deflection control tie 500. The engagement of the system is facilitated as the façade stack joint 550 is closed, following overjack and final engagement of locking devices.

Figure 23:
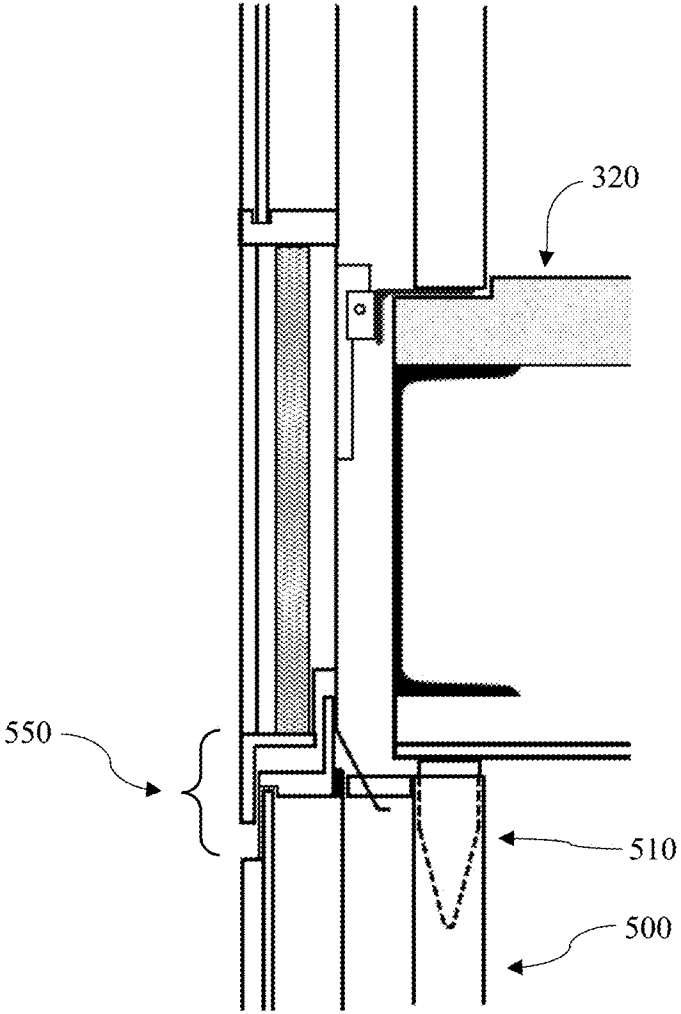
FIG. 23 is a schematic illustrating the final position of a deflection control tie, once the structural assembly has been locked into place, according to various exemplary embodiments.

FIG. 23 is a side view illustration of the final engaged and locked positioning of the deflection control tie system. As shown, the tapered conical guide 510 located at the underside of the structural assembly 320 is inserted into the defined cavity in the deflection control tie 500. The connection is then closed, along with the façade stack joint 550.

Figure 24:
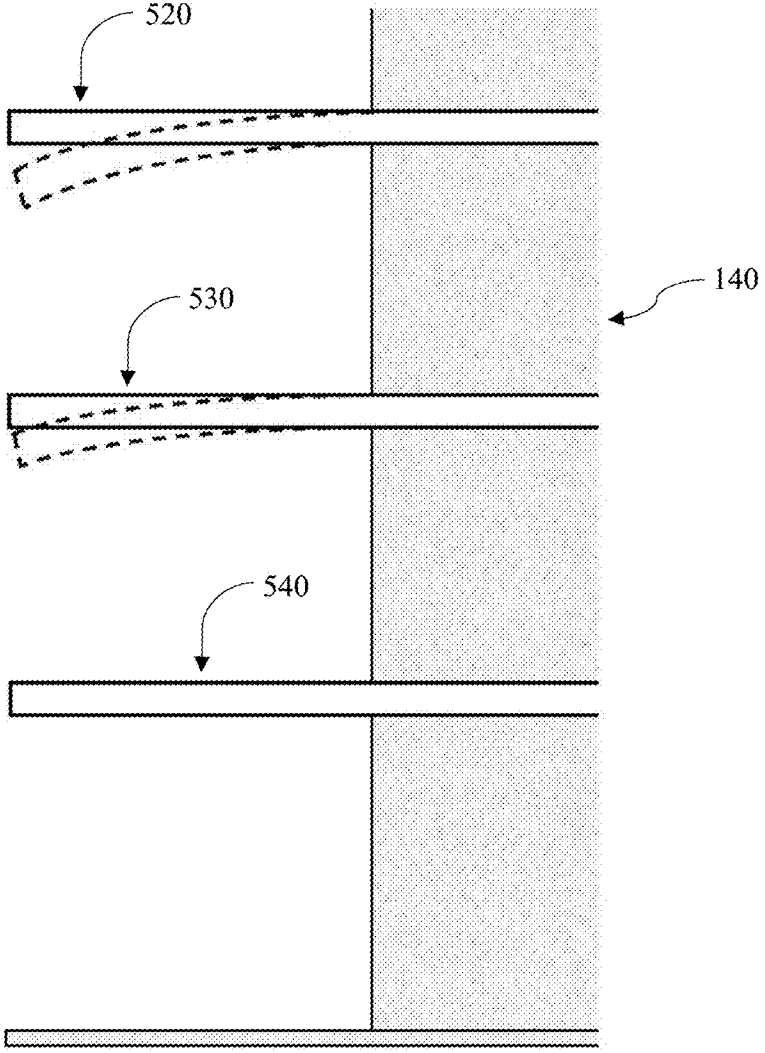
FIG. 24 is a schematic illustrating the deflection of independent cantilevered floors under varied loading without deflection control ties in place, according to various exemplary embodiments.

FIG. 24 is a schematic illustrating deflection of members cantilevered from the core 140 without deflection control ties in place. Deflection is illustrated for assemblies under heavy loading 520, light loading 530, and no loading 540. As illustrated by dotted lines on the schematic, assemblies with heavy loading may experience large deflection, assemblies with light loading may experience moderate deflection, and assemblies under no loading may experience no deflection.

Figure 25:
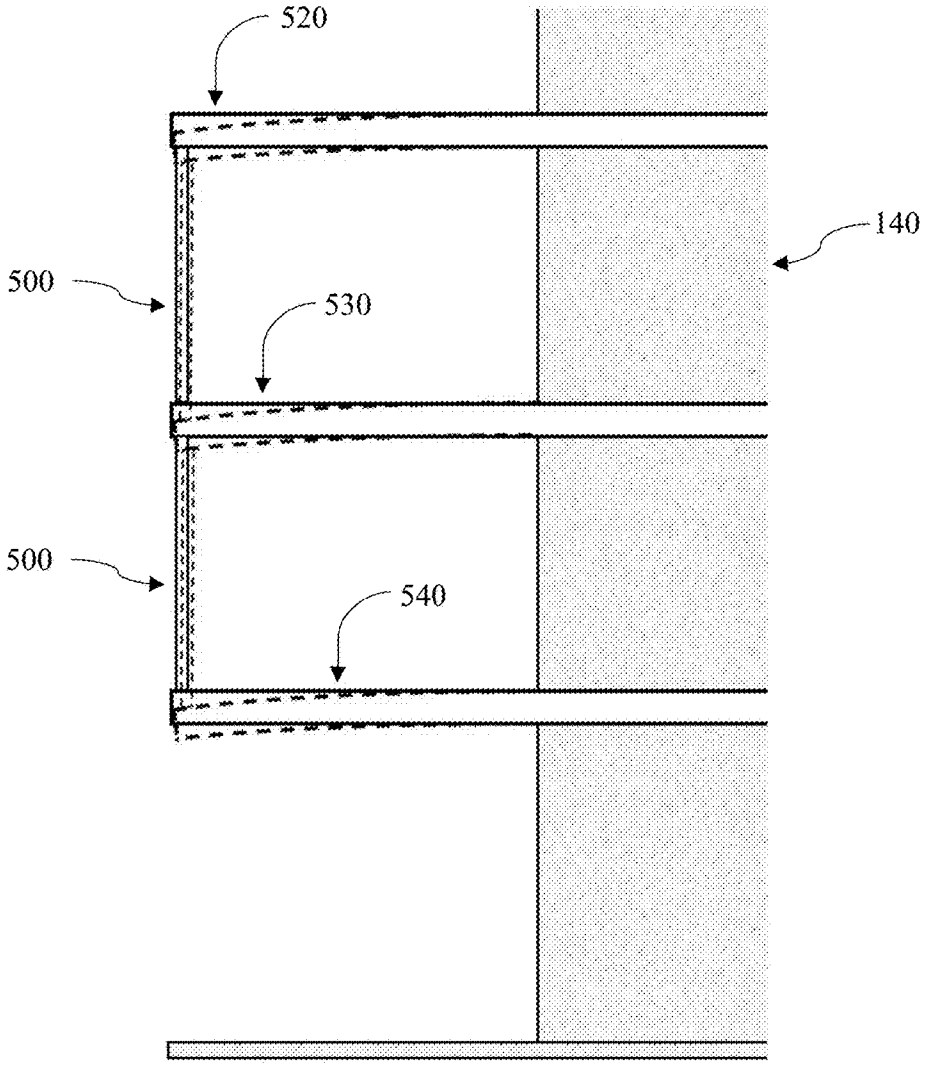
FIG. 25 is a schematic illustrating the deflection of linked cantilevered floors under varied loading with deflection control ties in place, according to various exemplary embodiments.

FIG. 25 is a schematic illustrating deflection of members cantilevered from the core 140 with deflection control ties 500 in place. Deflection is illustrated for assemblies under heavy loading 520, light loading 530, and no loading 540. As illustrated by dotted lines on the schematic, all assemblies, regardless of load, may experience small deflections, due to equal sharing of loads as enabled by the application of deflection control ties. Thus, differential deflection is eliminated by such deflection control tie embodiments, as described.

VI. Strand Protection System

A greater description and discussion of strand protection system exemplary embodiments is provided below.

In the construction of core-supported high-rise buildings, as described in detail further above, structural roof and floor assemblies may be constructed upon temporary support pedestals located at the base of slip formed building cores. Roof assemblies may be constructed by coupling one structural roof member with at least one other roof member, and may then be raised to a first elevation, supported with a first plurality of support members or locking devices. Floor assemblies may be constructed by coupling one structural floor member with at least one other floor member, and may then be lifted to a second elevation, where the second elevation is lower than the first elevation and supported with a second plurality of support members or locking devices.

In some embodiments, the raising of the aforementioned structural roof and floor assemblies may be accomplished by coupling one or more strand jacks with the top of the building core or cores. Strand jacks are used to lift very heavy loads vital in construction of core-supported high-rise buildings, as they allow for the raising of assemblies weighing up to thousands of tons. An embodiment of a strand jack is a hollow hydraulic cylinder with a set of steel cables or strands that pass through the open center, with each strand passing through two independent sets of clamps that grip the strands. The jack operates to raise or lower the strands by alternating between gripping and releasing strands while the hydraulic cylinder expands and contracts. During the raising operation, an upper set of clamps grip the strands while a lower set of clamps release the strands allowing the strands to be raised during expansion of the hydraulic cylinder. At the limit of the cylinder's stroke, the lower set of clamps grip the strands while the upper set of clamps release the strands allowing the strands to be raised again during contraction of the cylinder. These actions are reversed to allow a strand to be lowered. Once strand jacks are coupled with the top of the building core(s), the strands may then be coupled with the structural roof or floor assembly, and the strand jack(s) activated to raise the roof or floor assembly. When more than one strand jack is employed, automatic systems may assist in ensuring the roof or floor assembly is raised in a level manner.

Strand jack cables or hoisting strands, are critical components of the strand jack system and may be reused to prevent the additional cost of strand replacement. The life of a hoisting strand may be dependent on the amount of wear or incidental damage that may be incurred during the jacking process. In many embodiments, the typical wear that occurs on the strands is due to the action of the strand jack's gripping mechanism on the outer perimeter of the strand. In such embodiments, hardened steel teeth impart small indentations in the outer wires of each strand when jacking is underway. In some embodiments, for exemplary, this typical wear forces the life of strands to be limited to approximately ten jacking cycles on a particular length of strand. However, in some embodiments, inspection of the strands may allow additional jacking cycles based on the condition of the strands. In other embodiments, inspection of the strands may allow fewer jacking cycles based on the condition of the strands.

In many embodiments of the current solution to constructing core-supported high-rise buildings, the strand jack cables must securely attach to a fixed strand anchor block located at the underside of the structural assembly to be raised. In some embodiments, this attachment may be facilitated by the use of temporary lifting or carrier beams located at the underside of the structural assembly. The implementation and use of temporary carrier beams is described in detail further above.

Due to the location of these strand anchor blocks and temporary carrier beams, the strand jack cables must pass through openings in the structural assemblies to reach the hoisting components. In many embodiments, lateral movement of the strands may result in contact between the cables and the edges of the aforementioned openings. Such contact may result in damage or deterioration to the strands. In some embodiments, additionally, lateral movement of the strands may result in contact between the cables and other objects located within close proximity to the openings in the assemblies, such as stored materials or equipment. This may, again, result in damage or deterioration to the strands. For exemplary, in some embodiments, damage may include abrasion or scraping of strands. In other embodiments, damage may result in strand breakage. In all embodiments, damage and deterioration of strands may result in a need for the strands to be replaced prematurely, providing an unnecessary and costly delay to construction. Such a delay may procure additional construction expenses, as well as prolonging construction times.

In addition to procuring additional costs and delays in construction, damage to strands may result in safety hazards for construction personnel. Because strands must pass through all structural assemblies to reach the temporary carrier beam (located at the bottom of the lowermost assembly), they may pass through previously raised assemblies where construction personnel may be working. Any contact with these strands from construction personnel may result in scrapes or cuts from the hardened steel and may significantly impact construction personnel safety.

Therefore, it may be advantageous to provide a method of protecting strand jack cables such that incidental damage of the strands may be virtually eliminated, and wherein safety hazards that may result from contact with strands may be virtually eliminated. In exemplary embodiments of such a method of protection, strand bundles may be protected from contact with any outside objects, and moving strands may be adequately separated from any construction personnel, equipment, and materials during the construction process. Additionally, in many embodiments, such a solution may provide a means of inspection for strands during the raising of each structural assembly, allowing damage or wear to be identified earlier such that damaged strands can be replaced in a timely manner.

In one embodiment of the invention, a strand protection sleeve apparatus is provided. Exemplary embodiments of such strand protection sleeves may be vertical sleeves to be installed around each strand bundle for protection of strands from damage or wear, and protection of construction personnel from injuries. Exemplary embodiments may be split-pipe sections of a diameter that will enclose the strand bundle without restricting the travel of the strands. Exemplary embodiments may be standardized for a specific size of strand bundle.

Strand protection sleeves may be fabricated from readily available pipe materials. Standard nominal pipes may be used such that clearance from the extremities of the strand bundle may be a minimum of one inch (25 mm).

Strand jacks that are likely to be used for core-supported high-rise buildings may typically be of such capacity that strand bundles may be adequately protected by pipes with diameters of between 6 and 8 inches (150 to 200 mm).

Exemplary embodiments of strand protection sleeves may be made of a material which is durable enough to provide satisfactory protection for strand bundles, but malleable enough to avoid causing any additional damage in the event that the sleeve comes into contact with the moving strands. In some embodiments, sleeves may be constructed of Schedule 40 PVC. In other embodiments, sleeves may be constructed of Schedule 80 PVC. Exemplary embodiments may be reusable and readily replaced when needed, which may prevent the procurement of additional expenses associated with replacing the protection sleeves.

Selection of pipe materials will be based on serviceability, durability, suitability for installation, and availability. Appropriate materials shall be corrosion-resistant, rigid pipe with consistent diameter that can be easily fitted and installed around the strands.

In some embodiments of the strand jacking process described above, inspection of strands may allow for additional jacking cycles based on the condition of the strands. In such embodiments, this inspection may result in decreased costs, as strands may be reused for additional jacking cycles and new strands may not be purchased until later. For exemplary, in an embodiment where the construction of a thirty-story building requires thirty jacking cycles, thorough inspection of strands following each jacking cycle may allow for each bundle of strands to have a life greater than ten jacking cycles. In such an embodiment, the total number of sets of cable bundles needed may be decreased from three to two. This is an additional cost that is saved by the thorough inspection of strands. In other embodiments, such inspection may result in the identification of damaged strands. In these embodiments, such identification may prevent strands from being used where there may be risk of strand failure. Failure of a limited number of strands within a strand bundle may require assembly raising to be halted followed by lowering of the assembly back to ground level, so that strands can then be replaced. Such additional raising and lowering may procure additional expenses and construction time. Thus, the thorough and regular inspection of strands in this embodiment may decrease costs as well.

Thus, exemplary embodiments may be equipped with a method for inspecting each strand prior to raising, in order to detect damage and deterioration, allow for additional jacking cycles and prolonged use, and prevent procurement of unnecessary additional costs. In some embodiments, such a solution may be a section of transparent Schedule 40 or Schedule 80 PVC piping acting as a window for inspection. Construction personnel may use this clear window to manually inspect strands for damage while they move through the fixed sleeve. In other embodiments, sleeves may be equipped with a device wherein automated scanning of the strands may occur, identifying damage and wear.

Inspection of strands is typically a tedious procedure that requires visual examination of the entire length of each strand. It is proposed that an automated system such as optical computer vision may be used to allow continuous monitoring of all strands by multiple cameras mounted in a light box. This non-destructive method of detecting surface flaws may be used to scan each strand for signs of mechanical wear during the jacking process, and evaluate whether there may be concern about the condition of any individual strand.

In another embodiment of the invention, a method for installing and utilizing strand protective sleeves is provided. The method may first include installing a split-pipe strand protection sleeve, as described in detail above, around each strand bundle at ground level. For many embodiments, the number of protection sleeves necessary may be equivalent to four times the number of building cores. This is because, as mentioned further above, two carrier beams are typically needed for each core, and two strand jacks are typically needed to raise each carrier beam. Protection sleeves may be installed during the construction of each structural assembly to be raised. In some embodiments, sleeves may consist of two or more components, including a short portion that may extend through the structural assembly and become a permanent part of the assembly that is comprised of the hardenable substance, for example concrete, that may be poured on top of the metal decking. Another portion of the sleeve may extend from the top of the assembly for a vertical distance equivalent to the final distance between the upper and lower assemblies.

During construction of the structural assembly, consisting of a framework of beams, a metal form deck and a poured slab of a hardenable substance such as concrete, openings may be created for the strand jack strand bundles. These openings are proposed to be circular to allow the strand bundles to pass through and are to be maintained until all structural assemblies have been raised and locked into place. At each strand bundle location, a permanent circular sleeve, with an outside diameter that equals the inside diameter of the strand protection sleeve, may be positioned vertically through the form deck to create a void when the concrete slab is poured. The permanent sleeve may extend above the top of the slab by about 3 inches (75 mm) and below the form deck by about 3 inches (75 mm) to allow connection to the strand protection sleeves.

The strand protection sleeve may extend over the full height of the exposed strands between the top of the structural assembly that it is mounted on and the underside of the assembly above. This may provide full protection to the strands during construction, preventing any interference with the moving strands by construction personnel, equipment, and materials being stored or handled near the strands.

The method may further include securing strand protection sleeves to the structural assembly and checking for clearance from the strand bundles. The method may further include raising the structural assembly, with all strand protection sleeves in place, by means of temporary carrier beams and the synchronized operation of strand jacks, as described in further detail above.

Strand protection sleeves may be connected directly to the permanent sleeves that have been cast into the concrete slab as part of the structural assembly. The embedded sleeve may protrude approximately 3 inches (75 mm) above the top of the slab and approximately 3 inches (75 mm) below the form deck. The permanent sleeves may be accurately positioned directly above the strand anchor blocks which may result in the strand bundle being centered within the sleeve. The two halves of the strand protection sleeves may be fitted around the permanent sleeve protrusion above the top of the slab and clamped together using bolted fasteners. This lower connection may be made at ground level prior to the assembly being raised.

As the structural assembly approaches its final elevated position, the method may further include the engagement of the strand protection sleeves with the sleeves protruding down from the assembly above. The strand protection sleeves between the uppermost structural assemblies may be equipped with a section of clear PVC pipe or automated device for inspection of the strands, as described in detail above. The aforementioned location between the uppermost structural assemblies is the only location where strands will pass both upwards and downwards through the strand jacks during each jacking cycle. Therefore, this location is where strands will endure the most damage and are exposed to the maximum wear. Thus, it may be most beneficial to observe and inspect strands at this location.

Once the assembly being raised has reached its final position, the strand protection sleeves may be connected to the permanent sleeve protrusions extending below the form deck of the assembly above, using bolted fasteners.

Figure 26A:
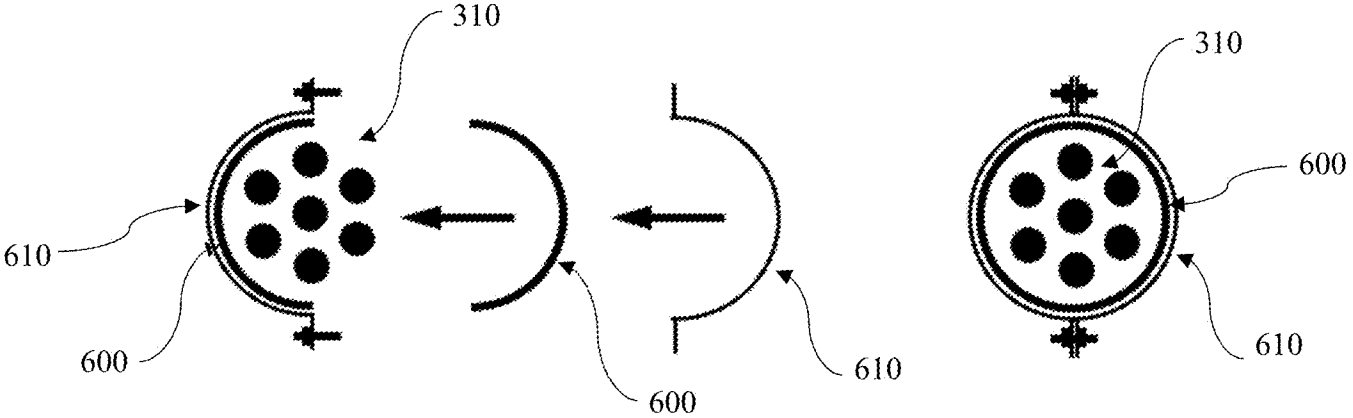
FIGS. 26A-26B are schematics illustrating sections through a 2-piece strand protection sleeve and a "U" strap clamp used to secure such sleeves, according to various exemplary embodiments.
Figure 26B:
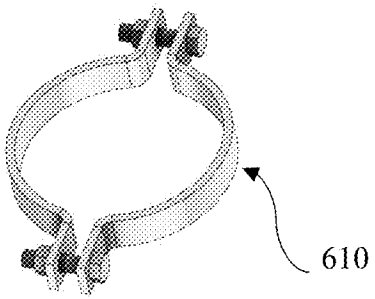

Turning now to FIG. 26A-26B, illustrations of strand protection exemplary embodiments are shown. Split-pipe protection sleeves 600 are installed around strand jack cables 310 at ground level as part of construction for each structural assembly.

The strand protection sleeves may be fabricated by cutting a cylindrical PVC pipe longitudinally into two equal halves. This split-pipe may be reassembled around the strand bundle using standard steel "U" strap clamps 610 that have been attached to each half of the sleeve. These clamps may be aligned and bolted together to create a complete strand protection sleeve.

Figure 27:
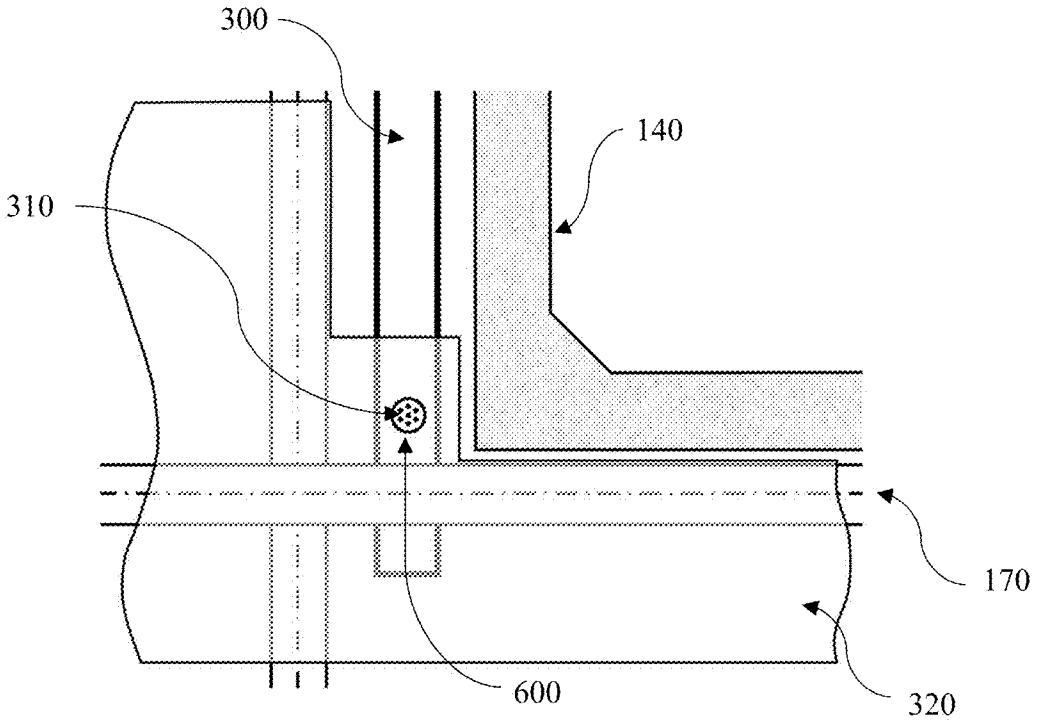
FIG. 27 is a schematic illustrating the plan view of a carrier beam raising a structural assembly with a protection sleeve around strand jack cables or hoisting strands in place, according to various exemplary embodiments.

FIG. 27 is a plan view illustration showing a structural assembly 320 being raised with temporary carrier beam 300 and jacking strands 310. The strand protection sleeve 600 around a strand bundle protects the strands as they pass through openings in the structural assembly adjacent to the primary beam 170.

Figure 28:
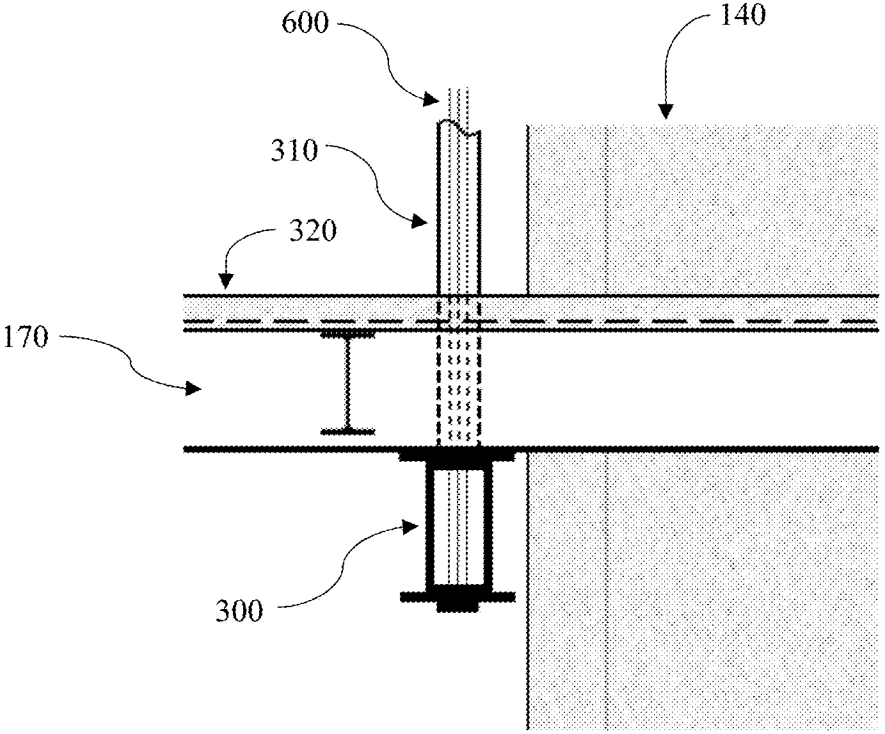
FIG. 28 is a schematic illustrating an elevation view of a carrier beam raising a structural assembly with a protection sleeve in place around a bundle of strand jack cables or hoisting strands, according to various exemplary embodiments.

FIG. 28 illustrates an elevation view of FIG. 27, with a carrier beam 300 and jacking strands 310 raising a structural assembly 320 along a core wall 140. Protection sleeves 600 are placed around strand bundles to protect them from any incidental damage occurring while passing through openings in assembly slabs 320 adjacent to the primary beam 170.

VII. Mechanical, Electrical, Plumbing, and Sprinkler Service Risers

A greater description and discussion of mechanical, electrical, plumbing, and fire protection service riser installation exemplary embodiments is provided below.

In high-rise buildings, vertical risers are defined as service distribution or conveyance components extending vertically through a building. However, the term is most commonly used in reference to pipes, ductwork, and cabling. In many embodiments of high-rise buildings, vertical risers may include mechanical, electrical, plumbing, and fire protection service risers. Such risers may provide necessary utilities to the completed building.

High-rise buildings require utility services to be distributed horizontally across every floor and the roof level. Utilities may include mechanical (HVAC ductwork, hot or chilled water piping, refrigerant piping, condensate piping, and natural gas piping), electrical (conduits, busways, cabling, lightning conductors and generator fuel lines), plumbing (hot and cold water supply, waste water drains and vent piping), fire protection (water supply and dry standpipes), and data/communication/low-voltage systems (conduits and cabling).

Utility service risers are the vertical component of the utility distribution system and connect all floors to the building's utility service which is generally located at or below street level. Building codes typically require separation of the utility service risers from normally occupied spaces to satisfy safety concerns. This separation generally results in the creation of riser shafts that may be constructed of fire-resistant materials. Multiple riser shafts may be necessary to further separate utilities from each other to minimize risk of service interruption or fire hazards. Electrical and data/communication services are typically not run within common shafts with wet risers (water service or drains). Fire water supply risers or standpipes are typically installed within enclosed stair towers such that fire hose valves and sprinkler system check valves can be accessed from the protection of a fire-rated stair tower.

For exemplary, electrical service risers may be used to carry electricity to levels of high-rise buildings. In many embodiments, a building's power source may be located in the basement. Thus, a method for bringing power to upper levels of the building may be required. Electrical service risers may be used in this instance and may consist of electrical busways or cabling that run from level to level. Such busways or cabling are necessary for all electrical use in the building, including lighting, and equipment or device power.

Additionally, plumbing service risers may be used to carry water between floors. In embodiments wherein water storage is contained on the roof, such plumbing risers may be pressurized as they carry water to lower floors. Plumbing risers may further include vent pipes and wastewater drains.

Additionally, heating, ventilation and air-conditioning service risers may include piping used to convey heated or chilled water, and ductwork used to convey conditioned or fresh air between floors.

Finally, fire protection risers are embodiments that connect to sprinklers located throughout the building. In embodiments wherein water storage is contained on the roof, such sprinkler risers may carry water from the storage tank to sprinklers on lower floors. Such sprinklers are vital for a completed high-rise building, as they provide necessary protection against the potential for occurrence of fire events.

In many embodiments of the current method for constructing high-rise buildings, mechanical, electrical, plumbing, and fire protection utility risers are installed after all structural framing has been constructed and enclosed. This can make installation operations extremely complex and can pose considerable safety hazards for construction personnel. In some embodiments, risers are raised into positions in sections by temporary material hoists operating within enclosed shafts. As the working space within these shafts is extremely limited, these operations can become extremely complex due to excessive congestion and limited workspace, which may prolong construction durations. Due to this complexity, material hoists may not be able to accurately place riser sections in their final positions. Thus, in such embodiments, the final positioning of each riser section may need to be completed manually by construction personnel. In many embodiments, this positioning may be performed at-height under poorly illuminated conditions, and in cramped, unventilated spaces, which can impose considerable safety concerns for construction personnel.

In the current method for installing utility service risers in high-rise buildings, riser shafts may first be constructed over the full height of the building. As floors are progressively completed (typically from the ground level upwards), vertical risers are installed within the shafts with standard lengths being stacked vertically from ground level. Sectional valves or dampers are incorporated into the vertical risers to allow horizontal distribution systems to be connected to the risers as each floor becomes ready to access a particular permanent utility service. Assembly of each riser is typically done using a temporary winching system whereby an electric winch is located at the top of the shaft and its cable is lowered to ground level. The winch cable may then be used to lift each riser component into position, to complete the riser by stacking components from ground level upwards. This may be a slow and potentially dangerous operation requiring construction personnel to be present within the shaft to monitor the lifting activities and make the permanent connections between each riser section.

Therefore, it may be advantageous to provide a solution wherein the installation of service risers may be completed prior to the construction and enclosure of the building's utility shafts to their full height. Such a solution may decrease complexity of installation, prevent prolonging of construction duration, and decrease safety concerns for construction personnel, for the reasons listed above. Exemplary embodiments of such a solution may take advantage of the strand jack hoisting system used in constructing core-supported high-rise buildings. Exemplary embodiments of such a solution may minimize exposure to safety hazards including performing work at-height under poorly illuminated conditions, and in cramped, unventilated spaces. In one embodiment of the invention, a method for installing mechanical, electrical, plumbing, and fire protection service risers during the raising of each structural assembly is provided. Exemplary embodiments of such a method may take advantage of the strand jack hoisting system used in constructing core-supported high-rise buildings. Such a strand jack hoisting system may include the coupling of one or more strand jacks with the top of the building core or cores. Strand jacks are used to raise large, heavy loads that may be associated with construction of high-rise buildings, as they allow for the raising of assemblies weighing up to thousands of tons.

The method may include locating and constructing utility service risers outside the core. Vertical utility service risers may be attached beneath each structural assembly, adjacent to the core. Such attachment may be performed at or near ground level. Risers may then be extended downwards as each assembly is raised via temporary carrier beams and the synchronized operation of strand jacks, as described above. A fire-rated enclosure may be extended around the risers and sealed to the core using fire-resistant materials.

A further description and discussion of the method for installing service risers is provided below.

The method for installing service risers may first include temporarily attaching the upper ends of utility risers to the underside of each structural assembly. Such attachments may be made within a riser shaft zone, which may be immediately adjacent to the core. Riser sections, lengths of piping, duct work, and busway, may be laid out horizontally below the assembled frames. The free ends of the risers may be supported on a moveable bogie. Each riser may have a length equivalent to the distance between the current assembly and the below assembly.

For fire sprinkler risers/standpipes that need to become operational as early as possible during construction, assembly may proceed from the ground level upward to the roof level. These risers may either be built during construction of the core containing the egress stairs and the water tank, or, where the water tank is supported on the roof outside of the core, during the raising of the roof assembly. In the second case, the roof assembly may be temporarily stopped at each level to allow a length of riser to be added. In both cases the lengths of pipe may be stacked vertically and connected using standard bolted flanges or mechanical grooved couplings.

All other utility risers may preferably be located outside of the core and will be constructed from the roof level downward as successive floors are raised into their permanent positions. Each length of riser may be temporarily attached to the underside of the structural assembly being raised, such that it may be suspended vertically during the raising operation. This temporary attachment may use collars, brackets and/or slings which may allow final connection of the riser section to the portion that is already fixed in place above. Those connections may be made using standard bolted or welded flanges, and the risers may be tied to the core wall and fully supported by the assembly, both during raising operations and once the floor has been locked into its final position.

In all types of high-rise buildings, a riser shaft is a vertical opening through all floors that are served by the utilities carried within the shaft. Utility risers are contained within the riser shaft, which may also be equipped with operable hatches or removeable panels to allow access by maintenance personnel.

In accordance with building and fire code requirements, vertical shafts that penetrate floor assemblies generally need to be enclosed by materials that serve as fire and smoke barriers. Shaft enclosures are required to be continuous and exhibit a fire-resistant rating where a number of stories are connected by the shaft enclosure. All penetrations of the riser shaft must be protected through use of fire-resistant materials. This includes use of fire-rated access hatches or removable panels, fire dampers within horizontal air ducts that serve floor spaces, and materials that create fire-resistant seals around piping and ductwork such that flames or hot gases are prevented from passing between a floor space and the shaft.

Due to the need to minimize the amount of space dedicated to the utility service risers and the costs associated with construction of the fire-rated enclosures, compatible risers may typically be bundled into a common shaft with a single enclosure. All riser shafts may typically be located within a zone that is immediately adjacent to the core as the core may have been constructed from fire-rated materials and can perform as one side of the shaft.

Riser sections may be comprised of standard manufactured lengths that are available in the market or they may be customized to suit the spacing between assemblies. Fewer joints in risers may generally result in more economical installations and material lengths that are greater than the distance between two adjacent assemblies can be considered as long as the riser length does not become unwieldy during the raising of the assembly. An appropriate length may typically be equal to (or nearly equal to) the height between two adjacent assemblies, however a double-height length may also be feasible.

The method may further include the raising of the structural assembly. Such raising may be achieved through the use of temporary carrier beams and the synchronized operation of strand jacks, as described above. As the assembly is lifted, the lower ends of riser sections may be continuously supported on a movable wheeled bogie that runs on a smooth horizontal surface at ground level. As the assembly is raised to its final elevated height the bogie, while supporting the lower ends of the riser sections, may travel towards the core until all riser sections are hanging vertically from the rising structural assembly.

As the structural assembly reaches the first elevation wherein it may be temporarily supported by the locking devices, the method may further include halting the jacking process. In many embodiments, such a height may be approximately 10 to 20 feet (3 to 6 meters) above ground level and may be indicated by the first set of steel components encountered by the locking devices. The method may further include securing the riser sections in their vertical positions.

Risers may be secured in a vertical orientation by means of riser support frames that prevent or limit lateral or swinging movements of each riser during the raising of the assembly. These frames may form the basis for construction of the shaft enclosure and may be rigidly attached to the structural assembly that is being raised. The support frame may be constructed of lightweight steel members and may be installed around the risers at ground level during construction of the associated structural assembly. Each riser may be restrained within the riser support frame which may be laid out horizontally beneath the roof or floor assembly. The upper end of the riser support frame (located nearest to the building core before the assembly is raised) may be temporarily attached to the underside of the structural assembly within the riser shaft zone immediately adjacent to the core. The lower end of the riser support frame together with the risers may be supported on a movable wheeled bogie which may then travel horizontally along a smooth horizontal surface at ground level as the structural assembly is raised. As the assembly is raised, the bogie may be pulled by the supported riser sections towards the building core, until the action of the rising assembly lifts the riser support frame off the bogie allowing the riser support frame and the associated riser sections are hanging vertically. When the structural assembly reaches the first position where it can be temporarily supported by the locking devices at approximately 10 to 20 feet (3 to 4 meters) above ground level, the jacking process may be stopped to allow the riser support frame to be rigidly secured in a vertical position to the underside of the assembly.

The method may further include the disengagement of the locking devices from their temporarily engaged steel components. Such disengagement is described in detail further above and may allow for the raising of the structural assembly to its final, elevated position. Once the assembly has reached this final position, it may be permanently locked into place by overjack and engagement of the locking devices. The method may further include coupling riser sections to previously raised riser sections extending down from the floor above.

Successive riser sections may be connected to each other using standard bolted flanges or mechanical grooved couplings. Riser support frames may similarly be bolted to previously raised frames.

During finish-out of a floor, or interior construction of the floor, the method may further include constructing a fire-rated enclosure around the utility service risers. Such a fire-rated enclosure may be necessary to prevent the ignition or spreading of fires from the risers. For exemplary, in the case of electrical fires igniting from electrical service risers, the fire-rated enclosure may prevent such a fire from spreading beyond the riser shaft zone. Exemplary embodiments of fire-rated enclosures may be constructed within a service shaft, which may be a contained within the steel framing of each floor assembly. Such a shaft may be enclosed using metal studs and fire-resistant materials. In some embodiments, enclosures may be constructed of multiple layers of gypsum boards. In other embodiments, enclosures may be constructed of other fire-resistant materials that have undergone testing and certifications for fire-rated assemblies. The walls of such a fire-rated enclosure may run continuously through each floor assembly and may ensure that occupied spaces and any ceiling voids containing fire-proofed steel framing are completely isolated from the interior of the shaft. In some embodiments, fire-rated hatches may be included within the walls of the enclosure for maintenance access at each floor. The method may further include, during finish-out of the floor, the extension of service lines out to the floor.

Fire-rated enclosures may be constructed using materials and assemblies exhibiting fire-safety properties that are defined by their fire resistance, surface-burning characteristics and noncombustibility. The construction industry relies on assemblies that have been tested and certified by Underwriters Laboratories, Inc. Such certified assemblies meet safety criteria that satisfy building code requirements for hourly rated fire-resistance and limitation of the spread of fire and smoke within a building. In addition to traditionally used assemblies, involving the use of gypsum boards, there may be numerous other fire-rated assemblies that have Underwriters Laboratories certifications and are approved for use in shaft construction.

In all high-rise buildings, utility service lines may be necessary to distribute services out to each floor and may be connected directly to the vertical service risers at each level. These service lines may include both horizontal trunk lines, and smaller branch lines that are fed by the trunk lines. Generally, this distribution network may be run within the ceiling, floor or walls of each floor space. When run overhead these services can be either exposed (surface-mounted) or concealed in a ceiling plenum.

While installation of the horizontal distribution network of services may be installed in the same manner for most high-rise buildings, conventional construction methods require materials to be installed in-situ after the structure has been erected. In core-supported high-rise buildings, the horizontal service lines may be installed at ground level prior to the structural assembly being raised. This avoids use of typical hoisting methods including cranes and material hoists, resulting in safer material handling and installation conditions.

In the current method, installation of horizontal service lines at ground level may be limited to primary duct trunks and fire protection piping.

In the proposed method for construction of core-supported high-rise buildings, a more complete installation of utility service lines at ground level may be anticipated with most branch lines being included. As installed service lines may be exposed during the raising of the structural assembly, they may be required to be securely attached to the assembly. In order to minimize the risk of components becoming detached and falling to the assembly area below safety netting may be installed beneath the structural assembly. This netting may be attached following installation of all horizontal service lines and may remain in place until the floor below has been raised and locked into position. At that time the net may be readily accessible from the lower floor and may be removed and transferred to ground level for reuse on a subsequent structural floor assembly.

Turning now to FIG. 29, a plan view illustration of the installation of service risers is shown. The structural assembly 320 is raised by temporary carrier beams 300 and the synchronized operation of strand jacks and strand jack cables or strands 310. Mechanical, electrical, plumbing and fire protection service risers 700 in their final vertical position are located in a riser shaft zone 750 immediately adjacent to the core wall 140. Utility service risers 710 are assembled together in a horizontal orientation and constrained by a riser support frame. The lower end of this service riser assembly is placed upon a moveable bogie 720 such that the entire riser assembly may be raised and coupled with existing vertical service risers 700 above.

FIG. 30 illustrates a section view of FIG. 29, showing the raising of a structural assembly from its initial position 440 to its final position 740 using temporary carrier beams 300 and the synchronized operation of strand jacks 400 placed upon jacking beams 410, located at the core cap 210 above roof level 420. A utility service riser assembly to be raised 710 is placed horizontally upon a moveable bogie 720. As the structural floor assembly rises from its initial position 440 to interim positions 730, the moveable bogie 720 travels towards the building core 140. Temporary attachments between raising service riser assembly 710 and the structural assembly force such ductwork to become incrementally more vertical as the assembly is raised.

VIII. Modular High-Rise Building

A greater description and discussion of modular high-rise building construction exemplary embodiments is provided below.

In high-rise modular buildings, modular units are defined as prefabricated six-sided volumetric modular units. Such modular units may be comprised of a three-dimensional unit of enclosed space that has been manufactured off-site and can include all necessary plumbing, electrical and mechanical systems, as well as furniture, fixtures and finishes.

Embodiments of current conventional high-rise construction in which modular buildings are to be constructed, require prefabricated six-sided volumetric modular units to be hoisted into position individually by crane. Modular units can be large, heavy and unwieldy components that are lifted to their permanent positions, where they are manually positioned and secured by construction personnel working at height. Lifting of such large components that may be up to 12 feet (5.6 meters) wide, 56 feet (17 meters) long and 10 feet (3 meters) high requires the load to be suspended or swung over public streets or other structures. Such processes, involving large loads being lifted by cranes, that are subject to conditions of excessive wind and other inclement weather conditions, and requires construction personnel to be located at the highest, exposed level of the structure to receive and connect the components to the structure, can result in significant safety risks to the public, construction personnel, and property.

Finally, embodiments of current conventional modular high-rise construction, require prefabricated modular units to be engineered and fabricated to support the full weight of any modular units that may ultimately be stacked above it. This results in modular units from different levels being engineered and fabricated to be capable of supporting different loads, which may require variation in the materials and structural members used for fabrication of each unit. Such a requirement may reduce the repetition that is desired in modular construction, and in turn, may prolong fabrication duration and increase costs of construction.

The proposed method for core-supported modular high-rise building construction can improve safety for the public, construction personnel, and property, decrease time required for construction, and decrease costs of construction when compared with conventional high-rise modular building construction. Exemplary embodiments of the proposed method for core-supported modular high-rise building construction can further improve safety for construction personnel, decrease the time required for construction, and decrease costs of construction, as modular units are installed onto structural assemblies at ground level and high levels of quality assurance are more readily achieved as many construction inspections are not required to be performed at-height.

Core-supported modular high-rise building construction allows prefabricated six-sided volumetric modular units to be incorporated into a structural assembly prior to the assembly being raised to its permanent position. A core-supported modular high-rise building has these modular units installed directly onto a structural framework at ground level such that the modular units are securely and permanently attached to a structural framework, prior to the resulting structural assembly being raised and subsequently connected to the supporting building cores.

Turning now to FIG. 31, a plan view illustration of the installation of modular units is shown. The structural assembly 320 is raised by temporary carrier beams 300 and the synchronized operation of strand jacks and strand jack cables or strands 310. Modular units 800 are placed on the structural framework and securely connected such that they become part of the structural assembly.

FIG. 32 illustrates a section view of FIG. 31, showing the raising of a structural assembly from its initial position 440 to its final position 430 using temporary carrier beams 300 and the synchronized operation of strand jacks 400 placed upon jacking beams 410, located at the core cap 210 above roof level 420. A modular unit to be raised 800 is placed on the structural assembly 320.

What is claimed is:

1. A lock for securing a structural assembly having a primary beam usable for constructing a high-rise building having a building core wall defining an outer face, the building also having a roof and floor levels, the lock comprising:

a fixed bracket configured to be rigidly coupled to the primary beam of the structural assembly;

a structural pin;

a movable component connected to the fixed bracket by the structural pin, the moveable component having a center of gravity offset from the structural pin to enable vertical rotation of the moveable component around the structural pin due to gravitational force;

a bearing surface, configured to be in direct contact with the outer face of the building core wall during raising of the structural assembly; and a steel component forming a recessed pocket, the steel component embedded in the building core wall at predetermined positions and elevations corresponding to the roof and floor levels, the recessed pocket being configured to receive the moveable component of the lock if the structural assembly reaches one of the predetermined positions;

wherein the moveable component is configured to engage with and disengage from the steel component in the building core wall as the structural assembly rises, enabling temporary support and securement of the structural assembly at the one of the predetermined positions during construction.

2. The lock of claim 1, wherein the the steel component includes a structural anchor attached to the steel component and embedded into a concrete building core of the building.

3. The lock of claim 1, wherein a minimum of four locks are attached to the primary beams, located at each corner of the building core, to fully support the structural assembly on the building core.

4. The lock of claim 3, wherein the moveable component disengages from the steel component to allow the structural assembly to continue rising along the face of the building core if the current level is not the intended final position for the structural assembly.

5. The lock of claim 4, wherein the structural assembly is overjacked above the intended predetermined position, allowing the moveable component to freely rotate into the recessed pocket, and subsequently lowered by strand jacks until the entire weight of the assembly is fully supported by the plurality of locks.

6. The lock of claim 5, wherein the moveable component is configured to engage with the steel component if the structural assembly is temporarily stopped for any reason, providing full support and securement at the current level.

7. The lock of claim 6, wherein the apparatus facilitates coupling of materials and components with significant weight, such as concrete, to the structural assembly while supported by the locks, allowing deflection of the structural members to occur before hardening of the concrete, thereby minimizing cracking of the finished surface of the roof or floor.

8. The lock of claim 1, wherein the moveable component is configured to automatically disengage from the steel component, facilitated by vertical rotation around the pin, when the structural assembly continues to rise.

9. The lock of claim 1, wherein the structural pin is positioned to offset the center of gravity of the moveable component, allowing for rotation of the moveable component around the pin.

10. The lock of claim 1, wherein the moveable component's engagement and disengagement with the steel component is facilitated by gravitational force acting upon its center of gravity.

11. The lock of claim 1, wherein the fixed bracket and moveable component are comprised of materials selected for strength, durability, and resistance to environmental conditions.

12. The lock of claim 1, wherein the steel component is embedded into the building core at predetermined positions and elevations corresponding to each roof and floor level.

13. A high-rise building construction method, comprising:

constructing a structural assembly including primary beams, secondary beams, and decking at ground level on temporary support pedestals positioned around the base of the building core;

raising the structural assembly along a building core using strand jacks coupled to the top of the building core and temporary carrier beams that engage with the underside of the primary beams without positive connection; and engaging a lock as recited in claim 1, wherein the lock supports the structural assembly at one of the predetermined positions or the intended final position.

14. A system for constructing a high-rise building, comprising:

a building core having a plurality of steel components, each steel component forming a recessed pocket at predetermined positions;

a structural assembly including primary beams;

and a plurality of locks as recited in claim 1, wherein the locks are attached to the primary beams and configured to engage and disengage with the plurality of steel components in the building core as the structural assembly is raised and lowered.

15. The high-rise building construction method of claim 13, further comprising, overjacking the structural assembly above the predetermined position and subsequently lowering the structural assembly until it is fully supported by the engaged lock.

16. The high-rise building construction method of claim 13, wherein the method further includes temporarily stopping the raising operation and securing the structural assembly by engaging the lock with at least one of the plurality of steel components at a level in close proximity to ground level, allowing for coupling of materials and components with significant weight.

17. The high-rise building construction method of claim 13, wherein the method further includes temporarily stopping the raising operation at any level where at least one of the plurality of steel components are positioned, engaging the lock with at least one of the plurality of steel components, and providing access for construction personnel to perform tasks such as removing temporary filling, blockouts, or performing finishing tasks on the building core.

18. The system for constructing a high-rise building of claim 14, wherein the system further comprises synchronized strand jacks and carrier beams for raising and lowering the structural assembly along the building core.

19. The system for constructing a high-rise building of claim 14, wherein the lock engages and disengages with at least one of the plurality of steel components in response to the structural assembly's upward and downward movement.

20. The system for constructing a high-rise building of claim 14, wherein the plurality of locks are positioned at each corner of the building core to provide adequate support for the structural assembly.

* * * * *